US009010012B2

(12) United States Patent
Matthews et al.

(10) Patent No.: US 9,010,012 B2
(45) Date of Patent: Apr. 21, 2015

(54) GUN SIGHT

(71) Applicant: SureFire, LLC, Fountain Valley, CA (US)

(72) Inventors: John W. Matthews, Newport Beach, CA (US); Murray Dunn, Encinitas, CA (US); Michael LaSavio, La Verne, CA (US); Michael D. Picciotta, Yorba Linda, CA (US); Loc Nguyen, Santa Ana, CA (US); Ammar Burayez, Silverado, CA (US); Mark Buczek, Oceanside, CA (US); Mark Squire, San Diego, CA (US)

(73) Assignee: SureFire, LLC, Fountain Valley, CA (US)

( * ) Notice: Subject to any disclaimer, the term of this patent is extended or adjusted under 35 U.S.C. 154(b) by 129 days.

(21) Appl. No.: 13/797,095
(22) Filed: Mar. 12, 2013

(65) Prior Publication Data

US 2013/0283660 A1 Oct. 31, 2013

Related U.S. Application Data

(63) Continuation-in-part of application No. 13/359,925, filed on Jan. 27, 2012, now Pat. No. 8,448,373, which is a continuation of application No. 12/785,781, filed on May 24, 2010, now Pat. No. 8,117,780.

(60) Provisional application No. 61/751,597, filed on Jan. 11, 2013.

(51) Int. Cl.
*F41G 1/38* (2006.01)
*F41G 1/30* (2006.01)
(Continued)

(52) U.S. Cl.
CPC *F41G 1/30* (2013.01); *F41G 1/345* (2013.01); *F41G 11/004* (2013.01); *F41A 33/00* (2013.01); *F41G 1/16* (2013.01); *F41G 1/26* (2013.01)

(58) Field of Classification Search
USPC ..... 42/113, 130, 131, 140; 356/138, 143
See application file for complete search history.

(56) References Cited

U.S. PATENT DOCUMENTS 3,230,627 A 1/1966 Rickert et al.
3,645,635 A 2/1972 Steck
(Continued)

FOREIGN PATENT DOCUMENTS

DE 202007010552 11/2007
DE 102009056208 7/2010
(Continued)

OTHER PUBLICATIONS msnbc.com, "New device could improve marksmanship", http://www.msnbc.msn.com/id/34384750/ns/technology_and_science-innovation/, Dec. 11, 2009, pp. 1-2.

(Continued)

*Primary Examiner* — J. Woodrow Eldred

(74) *Attorney, Agent, or Firm* — Haynes and Boone, LLP

(57) ABSTRACT

Various gun sights and related methods are provided. In one embodiment, a gun sight includes a light source adapted to project light, a user-viewable interface, and an optical element. The optical element includes a first surface adapted to pass the light to provide a reticle at the user-viewable interface. The optical element also includes a second surface adapted to refract the light to provide a light guide at a peripheral area of the user-viewable interface to aid a user to substantially align the user's eye with the reticle. Various mechanisms for aligning gun sights, attaching gun sights, related methods, and other embodiments are also provided.

41 Claims, 71 Drawing Sheets

(51) Int. Cl.

| | |
|---|---|
| ***F41G 1/34*** | (2006.01) |
| ***F41G 11/00*** | (2006.01) |
| ***F41A 33/00*** | (2006.01) |
| ***F41G 1/16*** | (2006.01) |
| ***F41G 1/26*** | (2006.01) |

(56) References Cited

U.S. PATENT DOCUMENTS

| | | | | |
|---|---|---|---|---|
| 3,994,597 | A | 11/1976 | Calder et al. | |
| 4,057,318 | A | 11/1977 | Schindl | |
| 4,367,949 | A * | 1/1983 | Lavering | 356/144 |
| 4,483,598 | A | 11/1984 | Leightner et al. | |
| 4,531,052 | A | 7/1985 | Weaver et al. | |
| 4,730,104 | A * | 3/1988 | Rogers | 235/412 |
| 4,806,007 | A | 2/1989 | Bindon | |
| 5,140,151 | A | 8/1992 | Weiner et al. | |
| 5,924,234 | A | 7/1999 | Bindon et al. | |
| 6,487,809 | B1 | 12/2002 | Gaber | |
| 6,490,060 | B1 | 12/2002 | Tai et al. | |
| 7,069,685 | B2 | 7/2006 | Houde-Walter | |
| 7,319,557 | B2 | 1/2008 | Tai | |
| 7,325,354 | B2 | 2/2008 | Grauslys et al. | |
| 7,421,816 | B2 | 9/2008 | Conescu | |
| 7,656,579 | B1 | 2/2010 | Millett | |
| 7,721,481 | B2 | 5/2010 | Houde-Walter | |
| 7,764,431 | B2 | 7/2010 | Domjan et al. | |
| 7,796,329 | B2 | 9/2010 | Dobschal et al. | |
| 7,866,247 | B2 | 1/2011 | Son et al. | |
| 8,117,780 | B2 | 2/2012 | Matthews et al. | |
| 8,448,373 | B2 | 5/2013 | Matthews et al. | |
| 8,474,173 | B2 | 7/2013 | Matthews et al. | |
| 2005/0057808 | A1 | 3/2005 | Houde-Walter | |
| 2005/0219690 | A1 | 10/2005 | Lin et al. | |
| 2006/0010761 | A1 | 1/2006 | Staley, III | |
| 2006/0230665 | A1 | 10/2006 | Narcy et al. | |
| 2007/0214701 | A1 | 9/2007 | Grauslys et al. | |
| 2008/0163536 | A1 | 7/2008 | Koch et al. | |
| 2008/0163749 | A1 | 7/2008 | Reimer | |
| 2009/0015935 | A1 * | 1/2009 | Szapiel et al. | 359/674 |
| 2010/0095578 | A1 | 4/2010 | Elpedes et al. | |
| 2012/0030985 | A1 | 2/2012 | Mauricio et al. | |
| 2012/0033195 | A1 | 2/2012 | Tai | |
| 2012/0106170 | A1 | 5/2012 | Matthews et al. | |
| 2013/0312310 | A1 * | 11/2013 | Geller | 42/122 |

FOREIGN PATENT DOCUMENTS

| | | |
|---|---|---|
| EP | 0 548 625 | 6/1993 |
| GB | 869627 | 5/1961 |
| GB | 1405122 | 9/1975 |
| GB | 1 579 796 | 11/1980 |
| GB | 2428929 | 2/2007 |
| WO | WO 2009/137860 | 11/2009 |

OTHER PUBLICATIONS

Texas Instruments DLP in the Optoma Pico-Projector, "Technology Insider", http://chipworks.com.blogs.aspx?id=5618&blogid=86, Jan. 12, 2009, pp. 1-2.

"Reticle", http://en.wikipedia.org/wiki/Reticle, Jul. 22, 2009, pp. 1-4.

"Reflex sight", http://en.wikipedia.org/wiki/Reflex_sight, Jul. 24, 2009, pp. 1-4.

"Advanced Combat Optical Gunsight", http://en.wikipedia.org/wiki/Advanced_Combat_Optical_Gunsight, May 15, 2010, pp. 1-3.

American Rifleman, "Burris Eliminator Laserscope", Aug. 2011, pp. 86-87.

"Schmidt-Pechan prism", http://en.wikipedia.org/wiki/Schmidt%E2%80°/093Pechan_prism, Aug. 21, 2011, pp. 1-3.

"Telescopic sight", http://en.wikipedia.org/wiki/Telescopic_sight, Oct. 18, 2011, pp. 1-15.

Burris Company: "AR-332 Prism Sight", Sep. 21, 2010, http://webarchive.org/web/20100921180853/http://www.burristactical.com/ar332.html, retrieved Jan. 20, 2012, 1 page.

Brownells: "AR-332 Prism Sight", Jan. 1, 2012, http://www.brownells.com/.aspx/pid=31976/Product/AR-332-PRISM-SIGHT, retrieved Jan. 20, 2012, 1 page.

* cited by examiner

| FIG. 38A | FIG. 38B |
|---|---|

KEY TO FIG. 38

| FIG. 39A | FIG. 39B |
|---|---|

KEY TO FIG. 39

GUN SIGHT

CROSS-REFERENCE TO RELATED APPLICATIONS

This application claims the benefit of U.S. Provisional Patent Application No. 61/751,597 filed Jan. 11, 2013 and entitled "GUN SIGHT", which is hereby incorporated by reference in its entirety.

This application is a continuation-in-part application of U.S. patent application Ser. No. 13/359,925 filed Jan. 27, 2012 and entitled "GUN SIGHT", which is a continuation application of U.S. patent application Ser. No. 12/785,781 filed May 24, 2010 and entitled "GUN SIGHT", all of which are hereby incorporated by reference in their entirety.

BACKGROUND

1. Field of the Invention

The present invention relates to weapon sighting devices in general, and more particularly to sights for use on firearms.

2. Related Art

Over the years, sighting devices have been developed to permit the user of small arms such as rifles, muskets, revolvers, shotguns, machine guns, and pistols, to align the weapon accurately relative to a target such that a projectile fired from the weapon may hit the target reliably.

Such sighting devices, or gun sights, may be seen as falling into two broad groups, namely, "active" and "passive" sights. Active sights typically illuminate the target with some form of radiation, and rely on a reflection of the radiation from the target to ensure correct alignment of the weapon with the target. An example of an active sight is commonly referred to as a laser sight. A laser sight generates a beam of laser light that is projected onto the target field such that the light beam actually illuminates the point of impact at a certain range. Such sights are highly effective in certain conditions, but suffer from a number of disadvantages. For example, depending on conditions the target may be able to see the light beam or its reflection, and when there are multiple weapons illuminating the same target it may become difficult for each user to know which reflection is associated with which firearm.

Passive sights typically rely on ambient illumination of the target and include the familiar open sights or "iron sights" comprising a front sight (e.g., a dispart sight such as a blade or tang disposed at the front end of the barrel of the weapon) and a rear sight (e.g., a complementary notch, groove, or circular aperture disposed at the rear end of the receiver or slide of the weapon). Passive sights also include "telescopic" sights that use a reticle, such as a set of adjustable "crosshairs" disposed inside the optics of a magnifying or non-magnifying telescope.

One type of passive sight, commonly referred to as a reflex sight, uses a refractive or reflective optical system to generate a collimated beam of light that is projected toward the user to create an illuminated reticle. The resulting plane wave seen by the user appears as a small, approximately circular disc of light that is focused at infinity. In a standard open reflex sight this illuminated reticle is projected such that it is superimposed over the field of view observed through the sight. This allows the user to see the target field through the sight as well as the illuminated reticle (e.g. an illuminated red dot) in one eye simultaneously. This gives the user a theoretically parallax-free image of the reticle, superimposed over the field of view through the sight.

Another type of passive gun sight that is particularly advantageous in close combat and similar situations is often referred to as an "occluded eye gun sight" (OEG). A common form of an OEG is essentially a closed reflex sight, in which the field of view through the sight is occluded such that the user sees the illuminated dot of the reflex sight superimposed over a blank background instead of an open field of view through the sight. When using such an OEG, the user's dominant eye is positioned behind the OEG and focused on the illuminated dot. That dominant eye is blocked or occluded by the OEG such that it does not see the target and instead sees only the illuminated dot.

The user's other eye is not obscured by the OEG and is focused on the target. When aiming the firearm, the user's brain superimposes the illuminated dot seen by the occluded dominant eye onto the target seen with by the user's other eye such that if the firearm is properly oriented the illuminated dot appears to the user to be projected onto the target. Effective use of an OEG requires both of the user's eyes, sometimes referred to as binocular vision. One example of a commercially available OEG for use on rifles, handguns, and grenade launchers, is the Trijicon "Armson O.E.G.®." OEGs have significant advantages over other types of sighting devices in high-stress and close combat situations that require extremely fast target acquisition without compromising the user's overall situation awareness.

Like other prior art OEGs, the Armson O.E.G. mounts on either the side or the top of the receiver of the weapon. However, neither of these arrangements is a natural location for binocular viewing, and mounting an OEG on the top of the receiver interferes with the use of conventional open sights. These mounting arrangements also change the balance of the firearm, require the use of a custom or modified holster, and require the use of a substantially modified shooting position depending on which sighting device is being used. The term OEG may be used herein to refer to a sight designed to be used as an occluded eye gun sight or to a standard reflex sight that may be occluded such that it can be used as an occluded eye gun sight.

Accurate use of all firearms requires extensive repetitive use. However, the use of live ammunition for training is expensive and requires access to a shooting range. Dry firing—firing the weapon without ammunition—may be an effective training exercise because it allows for the repetition needed to develop muscle memory, and the user may practice in a wide range of locations and situations. However, absent highly specialized and expensive training simulation systems, dry firing does not provide real-time user feedback regarding the accuracy of the practice "shot." This lack of user feedback significantly undermines the value of dry fire training.

A long felt but as yet unsatisfied need therefore exists for an improved sighting device that overcomes the disadvantages of prior art sighting devices and provides for improved dry fire training.

SUMMARY

Various gun sights for firearms and related methods of use are provided. In one embodiment, an optical sight for a handgun is provided. The sight includes a light source. The sight also includes an optical system that projects an approximately collimated beam of light from the light source toward a user of the sight to create an image of an illuminated reticle. The optical sight is positioned behind a barrel of the handgun such that it is generally centered on a longitudinal axis of the barrel of the handgun. Other embodiments are also provided as further disclosed herein.

In one embodiment, a gun sight includes a light source adapted to project light; a user-viewable interface; and an optical element comprising: a substantially central external surface adapted to pass the light to provide a reticle at a substantially central area of the user-viewable interface, and a substantially peripheral external surface adapted to refract the light to provide a guide at a peripheral area of the user-viewable interface to aid a user to reposition the gun sight to view the reticle.

In another embodiment, a method of operating a gun sight includes projecting light from a light source; passing the light through a substantially central external surface of an optical element to provide a reticle at a substantially central area of a user-viewable interface; and refracting the light by a substantially peripheral external surface of the optical element to provide a guide at a peripheral area of the user-viewable interface to aid a user to reposition the gun sight to view the reticle.

In another embodiment, a method of operating a gun sight includes moving the gun sight to a first position; viewing a guide at a peripheral area of a user-viewable interface of the gun sight while the gun sight is at the first position; moving the gun sight to a second position based on the guide; and viewing the reticle at a substantially central area of the user-viewable interface while the gun sight is at the second position, wherein the reticle is not viewable by the user while the gun sight is at the first position.

In another embodiment, a gun sight alignment apparatus includes a first alignment member adapted to be mounted substantially behind a barrel of a gun; a second alignment member adapted to be mounted substantially between the first alignment member and a gun sight; and wherein the first and second alignment members are adapted to rotate independently of each other to adjust an alignment of the gun sight relative to the gun.

In another embodiment, a method of aligning a gun sight includes rotating a first alignment member mounted substantially behind a barrel of a gun to adjust an alignment of the gun sight relative to the gun; rotating a second alignment member mounted substantially between the first alignment member and the gun sight to further adjust the alignment of the gun sight relative to the gun; and wherein the first and second alignment members rotate independently of each other.

In another embodiment, an apparatus includes a retaining member adapted to be secured to a gun and comprising a plurality of first surfaces exhibiting compound angles relative to a plane corresponding to a top surface of the gun; a mounting member adapted to be secured to a gun sight and comprising a plurality of second surfaces exhibiting compound angles substantially complementary to the first surfaces; wherein the mounting member is adapted to be inserted into the retaining member to attach the gun sight to the gun; wherein the first and second surfaces are adapted to contact each other as the mounting member is inserted into the retaining member; and wherein the compound angles of the first and second surfaces are oriented to cause the retaining member to push the mounting member toward the gun as the mounting member is inserted into the retaining member.

In another embodiment, a method includes inserting a mounting member into a retaining member to attach a gun sight to a gun, wherein: the retaining member is secured to the gun and comprises a plurality of first surfaces exhibiting compound angles relative to a plane corresponding to a top surface of the gun, and the mounting member is secured to a gun sight and comprises a plurality of second surfaces exhibiting compound angles substantially complementary to the first surfaces; and contacting the first and second surfaces against each other as the mounting member is inserted into the retaining member, wherein the compound angles of the first and second surfaces cause the retaining member to push the mounting member toward the gun as the mounting member is inserted into the retaining member.

In another embodiment, an apparatus includes a mounting member adapted to be secured to a gun sight and comprising an engagement member and a plurality of flanges extending from the engagement member; a retaining member adapted to be secured to a gun and comprising an aperture shaped to substantially correspond to at least one of the flanges; and wherein the engagement member is adapted to be inserted into the retaining member through the aperture and rotated within the retaining member to attach the gun sight to the gun.

In another embodiment, a method includes inserting an engagement member of a mounting member through an aperture of a retaining member; rotating the engagement member within the retaining member to attach a gun sight to a gun; wherein the mounting member is secured to the gun sight and comprises a plurality of flanges extending from the engagement member; and wherein the retaining member is secured to the gun and the aperture is shaped to substantially correspond to at least one of the flanges.

In another embodiment, a gun sight alignment apparatus includes a mounting member adapted to be fixed relative to a gun and comprising first and second alignment surfaces; a spring in contact with the first alignment surface to rotate a gun sight in a first direction to adjust an alignment of the gun sight relative to the gun; and a screw in contact with the second alignment surface to rotate the gun sight in a second direction substantially opposite to the first direction to adjust the alignment of the gun sight relative to the gun in response to a user manipulation of the screw.

In another embodiment, a method of aligning a gun sight includes providing a mounting member adapted to be fixed relative to a gun and comprising first and second alignment surfaces; providing a spring in contact with the first alignment surface to rotate the gun sight in a first direction to adjust an alignment of the gun sight relative to the gun; and manipulating a screw in contact with the second alignment surface to rotate the gun sight in a second direction substantially opposite to the first direction to adjust the alignment of the gun sight relative to the gun.

In another embodiment, an apparatus includes a retaining member adapted to be secured to a gun; a mounting member adapted to be secured to a gun sight and inserted into a cavity of the retaining member in a direction substantially perpendicular to a top surface of the gun to attach the gun sight substantially behind a barrel of the gun; and a screw adapted to pass through the retaining member into the cavity and push against a front surface of the mounting member to secure the mounting member to the retaining member.

In another embodiment, a method includes inserting a mounting member into a cavity of a retaining member to attach a gun sight substantially behind a barrel of a gun, wherein: the retaining member is secured to the gun, and the mounting member is secured to the gun sight and inserted into the cavity in a direction substantially perpendicular to a top surface of the gun; and tightening a screw against a front surface of the mounting member to secure the mounting member to the retaining member, wherein the screw passes through the retaining member into the cavity to contact the mounting member.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE FIGURES

FIGS. 51D-53 illustrate alignment members for a gun sight in accordance with embodiments of the invention.

Embodiments of the present invention and their advantages are best understood by referring to the detailed description that follows. It should be appreciated that like reference numerals are used to identify like elements illustrated in one or more of the figures.

DETAILED DESCRIPTION

The following description is presented to permit any person skilled in the art to make and use the invention. For purposes of explanation, specific nomenclature is set forth to provide a thorough understanding of various embodiments of the invention. Descriptions of specific embodiments or applications are provided only as examples. Various modifications to the embodiments will be readily apparent to those skilled in the art, and general principles defined herein may be applied to other embodiments and applications without departing from the spirit and scope of the invention. Thus, the invention is not intended to be limited to the embodiments shown, but is to be accorded the widest possible scope consistent with the principles and features disclosed herein.

In one exemplary embodiment of the present invention, a reflex sight, shown here as an opaque or occluded eye gun sight (OEG), is positioned on a firearm such that the illuminated reticle or dot is disposed such that it is substantially centered on the longitudinal axis of the barrel of the gun. In the various example embodiments described below, the general description is made in the context of an M1911 45 caliber Colt/Browning automatic pistol. However, it should be understood that the invention described herein may be utilized with a wide variety of firearms, including automatic pistols with and without exposed hammers (striker fired) and including automatic pistols manufactured by Glock, Smith & Wesson, Colt, Beretta, Ruger, Desert Arms, SIG-Sauer, Steyr, Israel Weapon Industries, and others where appropriate. Discussion herein at times refers to an OEG, but those of skill in the art will understand that the concepts disclosed are equally applicable to any reflex or similar type of sight.

Figure 2:
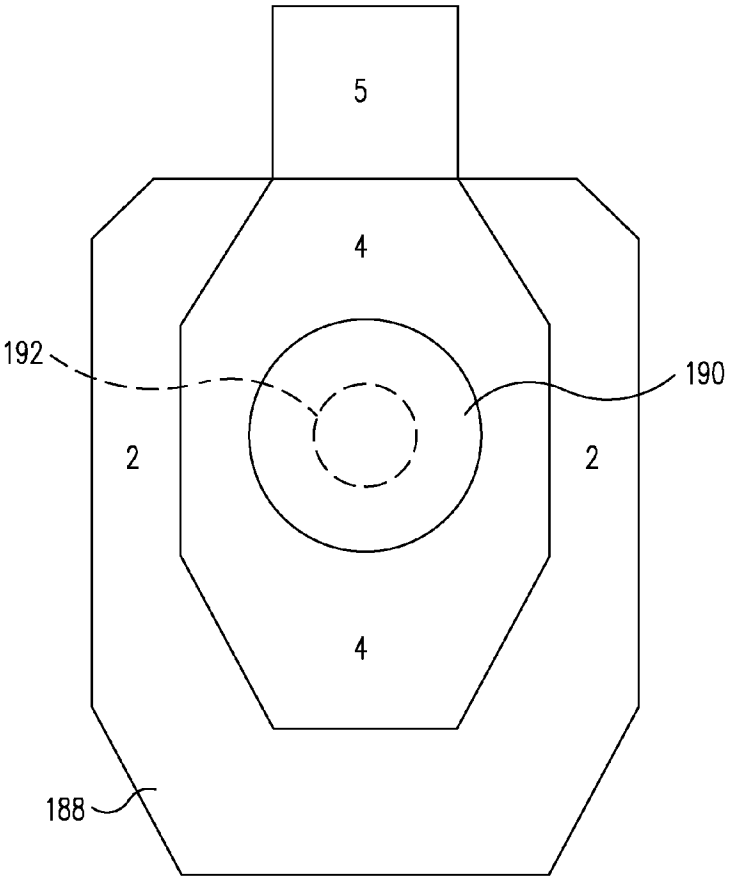
FIGS. 1-2 illustrate various uses of an OEG in accordance with embodiments of the invention.
Figure 1:
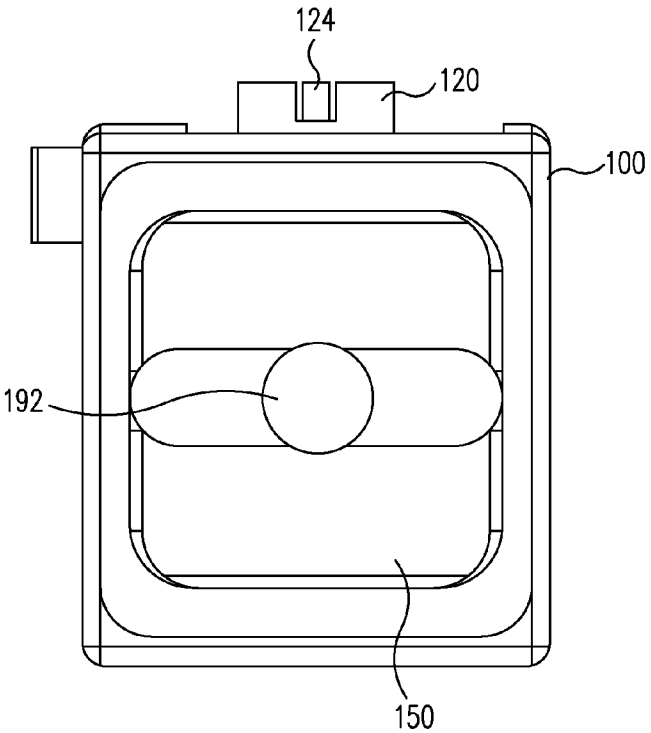

Unlike most dispart and telescopic sights, which require the user to close one eye and sight the firearm through their other eye, OEGs require binocular vision. Thus, the user must have both eyes open when sighting the weapon. Referring to FIGS. 1 and 2, the use of an OEG 100 will be described. FIG. 1 shows an OEG 100 from the user's perspective, with the rear sight 120 (e.g., a conventional notched iron sight or other appropriate sight) and front sight 124 (e.g., a conventional dispart iron sight or other appropriate sight) visible above the OEG 100. FIG. 2 shows a target field 188 in the form of a typical cut-out paper or cardboard target.

With reference to both FIGS. 1 and 2, one eye of the user is used to view the target field 188, including the specific desired point of impact 190. The second eye, typically the user's dominant eye, is positioned behind the OEG 100 such that the OEG 100 obscures the view of the target field 188 from that second eye. The OEG 100 includes some form of an indicator that is viewed with the user's second eye. This indicator is typically an illuminated feature such as an illuminated dot 192, most commonly formed by a beam of collimated light that is projected toward the user's eye from the OEG. This indicator will commonly be referred to herein as an illuminated dot, an aim dot, or a reticle, but it will be understood by those skilled in the art that the indicator may take a wide variety of forms including various shapes and/or colors. The user's second eye thus sees the lens assembly 150 and the illuminated dot 192 of the OEG 100, but does not see the target field 188. The user's first eye sees the target field 188 but does not see the OEG 100.

The two different images seen by the user's first eye and second eye are then superimposed by the user's brain, such that when the OEG 100 is properly positioned relative to the target field the user "sees" the illuminated dot 192 of the OEG 100 superimposed onto the target field 188, as indicated by the dashed outline 192 in FIG. 2. To the user, the illuminated dot 192 thus appears to be projected onto the target field 188, even though it is actually being projected toward the user's second eye from the OEG 100 and nothing is being physically projected onto the target field 188. As with other sights, the user aligns the weapon such that illuminated dot 192 is disposed directly on the desired point of impact. If the OEG 100 is accurately aligned with the bore of the barrel of the gun, the point of impact may be accurately conveyed to the user by the apparent position of the illuminated dot 192 on the target field 188.

The OEG 100 includes a light source that provides light to an optical device (e.g., a reflector, a lens, and/or one or more other appropriate optical members). The optical device may pass the light to the user (e.g., by reflection, refraction, and/or one or more other appropriate optical techniques) as a beam of collimated light which appears to the user as the illuminated dot 192.

Figure 3:
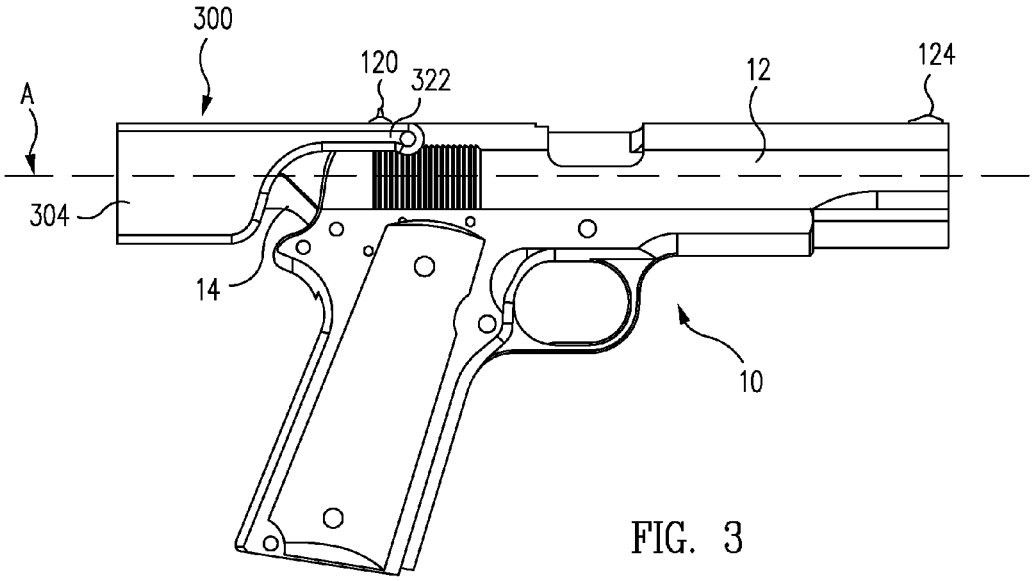
FIGS. 3-4 illustrate various mountings of a gun sight on a pistol in accordance with embodiments of the invention.
Figure 4:
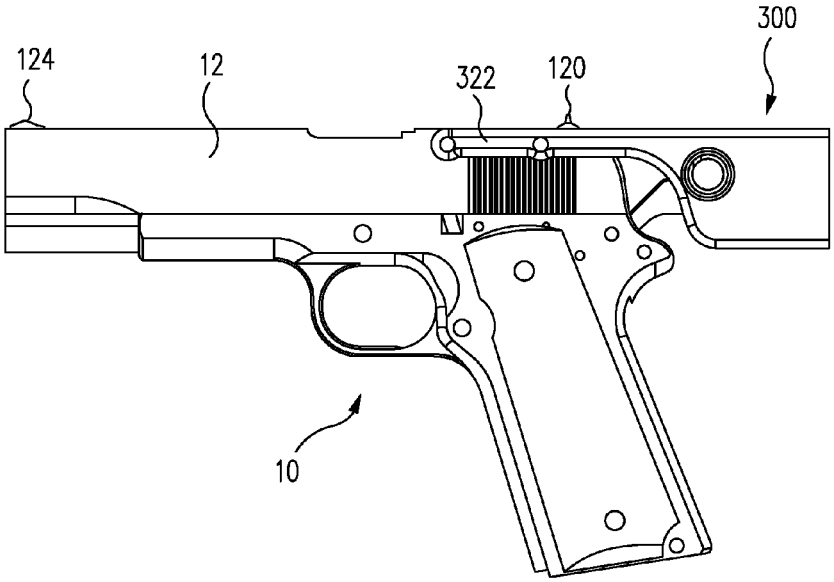
Figure 5:
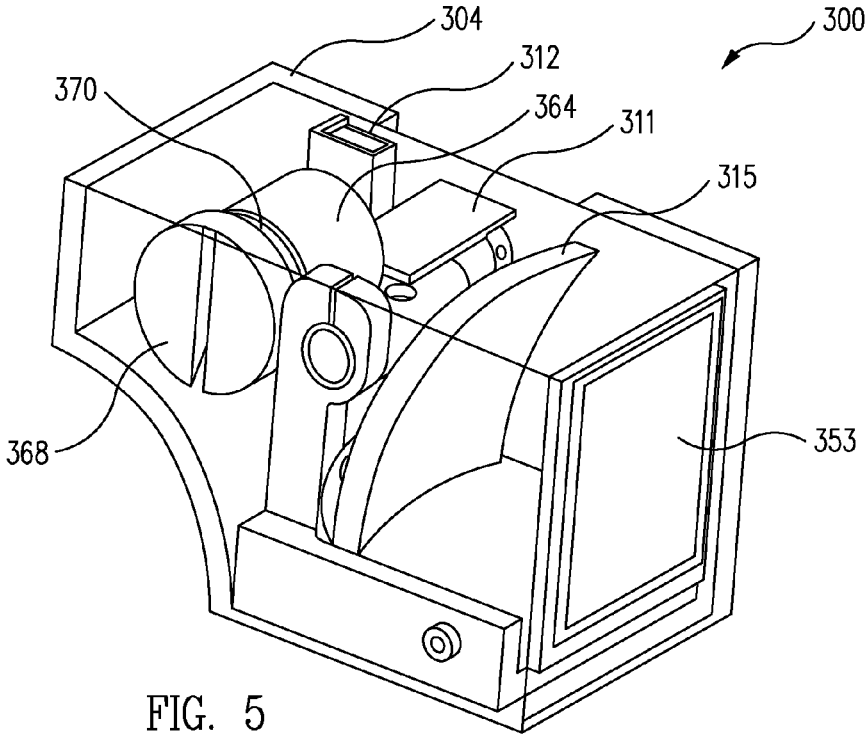
FIGS. 5-16 illustrate various implementations of a gun sight employing a reflective optical implementation in accordance with embodiments of the invention.
Figure 6:
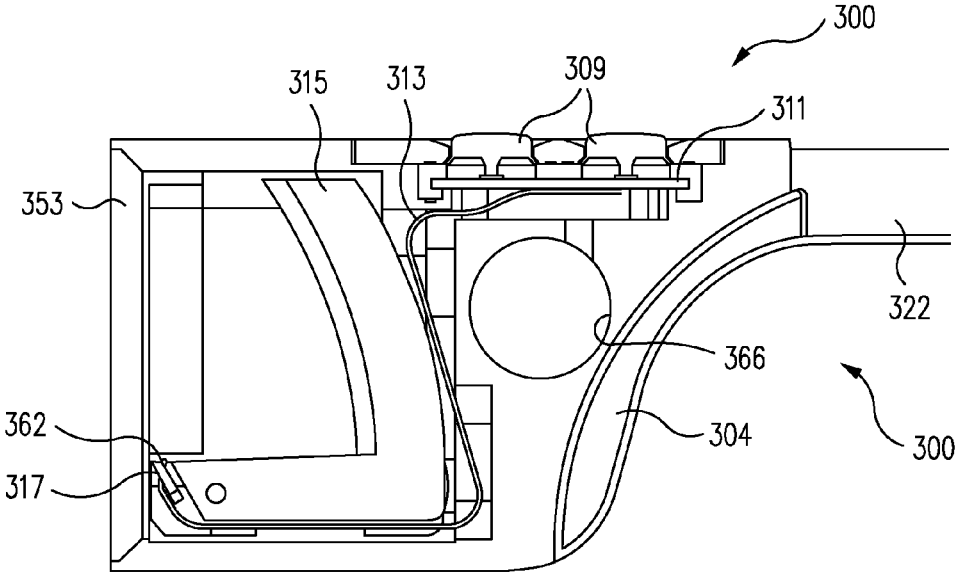
Figure 7:
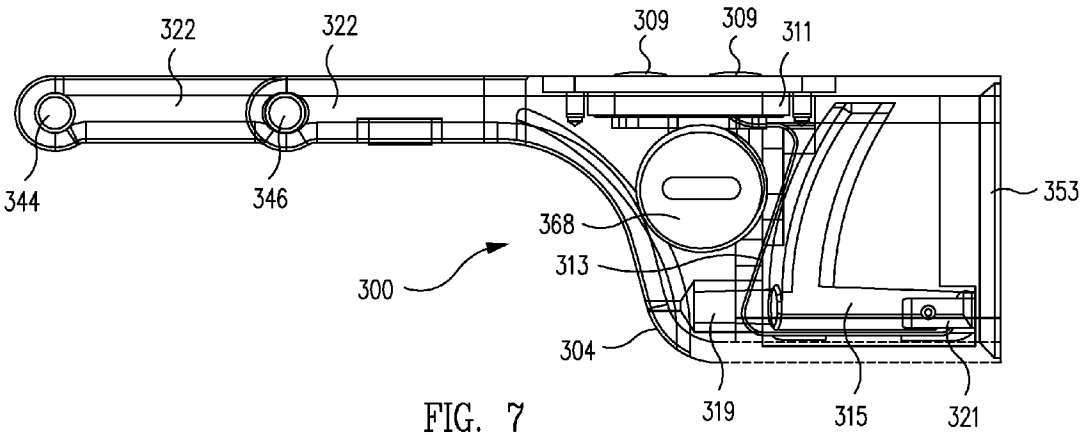

Referring to FIGS. 3-4, an embodiment of the invention is shown as it might be used on a typical 1911 pistol 10. The sight 300 is contained in a housing 304 that is attached to the slide 12 and it is positioned directly behind the firing mechanism such as the hammer 14 such that the sight 300 is aligned substantially co-axially with the longitudinal axis A of the barrel of the pistol 10 so that the illuminated dot 192 is generally centered on the central axis of the barrel. This mounting position minimizes any impact on the balance of the weapon and gives the user the impression of seeing "through" the pistol as their dominant eye is aligned with the longitudinal axis A of the barrel of the pistol. The sight 300 is also aligned consistent with the pistol's front and rear sights 120 and 124 that sit on the top of the slide 12, and is positioned so that it does not interfere with the use of the iron sights. This allows the user to have access to both the sight 300 and the front and rear sights 120 and 124, or any other sighting devices mounted on the top or side of the weapon, while requiring only a slight adjustment in shooting position and mechanics to switch between the various sighting options.

In an exemplary embodiment, the illuminated dot 192 seen by the user is created by an illuminated dot generator or plane wave generator disposed within the housing 304. The illuminated dot generator comprises a light source and some form of optical device, typically a collimating optical device, to produce a plane wave of light that appears to the user as an illuminated dot focused at infinity. In one embodiment, the illuminated dot generator must be mounted within the housing 304 to establish the nominal alignment of the illuminated dot 192 within the sight 300. The housing 304 is then mounted to the firearm 10 and may be pre-aligned at the factory for a standard range (typically 25 yards using standard ammunition) or its alignment may be user adjustable for range (up and down) and/or windage (side-to-side).

The illuminated dot generator may use a wide variety of mechanisms to generate the illuminated dot 192, including both refractive and reflective systems designed to create the desired collimated beam of light. In a reflective system, the light source projects light away from the user's eye. This light is then reflected back toward the user by a reflective surface such as a parabolic reflective mirror. In a refractive system, the light source typically projects light directly back toward the user's eye. This light is then shaped by a refractive optic, typically some type of lens.

An embodiment of a reflective sight 300 in accordance with an embodiment of the invention is illustrated in FIGS. 5-16. In this embodiment, the illuminated dot generator incorporates a parabolic mirror 315 that reflects light from a point light source 362 toward the rectangular aperture 353 of the sight 300 as a collimated beam of light. The aperture 353 is a transparent, planar, rectangular "window" through which the illuminated dot 192 is seen by the user. In one embodiment, the window 353 may be coated with an optical filter that passes only light of one or more selected wavelength(s).

Light source 362 is powered by a small battery 364, such as a ⅓ N cell lithium or NiCad battery, contained in a cylindrical battery compartment 366 in the housing 304 and held therein by a small, threaded battery door 368 and a compression spring 370.

The housing 304 of the sight 300 includes a pair of parallel, forwardly extending mounting ears 322, one of which, viz., the right ear 322, may be shorter than the other, or vice versa. In another embodiment, the ears 322 may be approximately equal in length. The forward pin 344 establishes two fixed positions on the slide of the firearm while the rearward pin 346 fixes the position of the housing rotationally. Removal of the rearward pin 346 allows the housing 304 to be rotated upward and removed from the slide for gun cleaning.

This embodiment may include a pair of light source 362 push button control switches 309 (e.g., up and down buttons in one embodiment). Selectively depressing one or both of the switches 309 may, for example, increase or decrease the brightness (e.g., intensity) of the light source 362 of the sight 300, turn the light source on or off, serve to program an on-off timer incorporated in appropriate control circuitry of the sight 300, and/or perform other operations as may be desired in various embodiments. In one embodiment, the pushbuttons 309 may be mounted on a printed circuit board (PCB) 311 and interconnected to the light source 362 via a thin, flat, flexible cable 313, as illustrated in, e.g., FIG. 6. The pushbuttons would signal the control unit on the PCB 311 to increase or decrease the brightness of the illuminated dot 192. The sight 300 may also include a potentiometer 312 that may be used to adjust the brightness of light provided by the light source 362 which permits adjustment of the brightness of the illuminated dot 192.

Figure 38A:
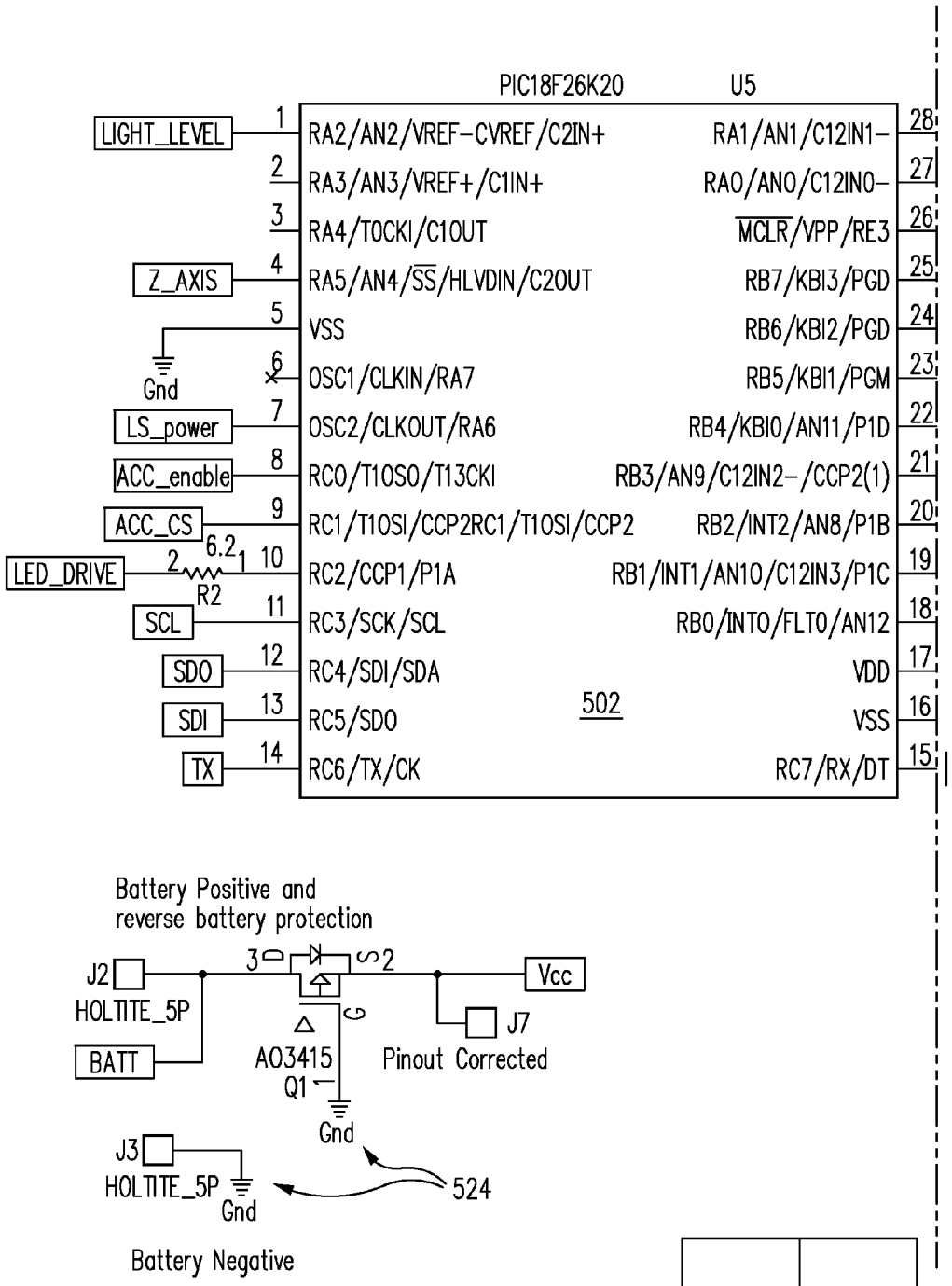
FIG. 38 (shown as FIGS. 38A-38B) and 39 (shown as FIGS. 39A-39B) illustrate various circuit components which may be provided as part of a gun sight in accordance with embodiments of the invention.
Figure 38B:
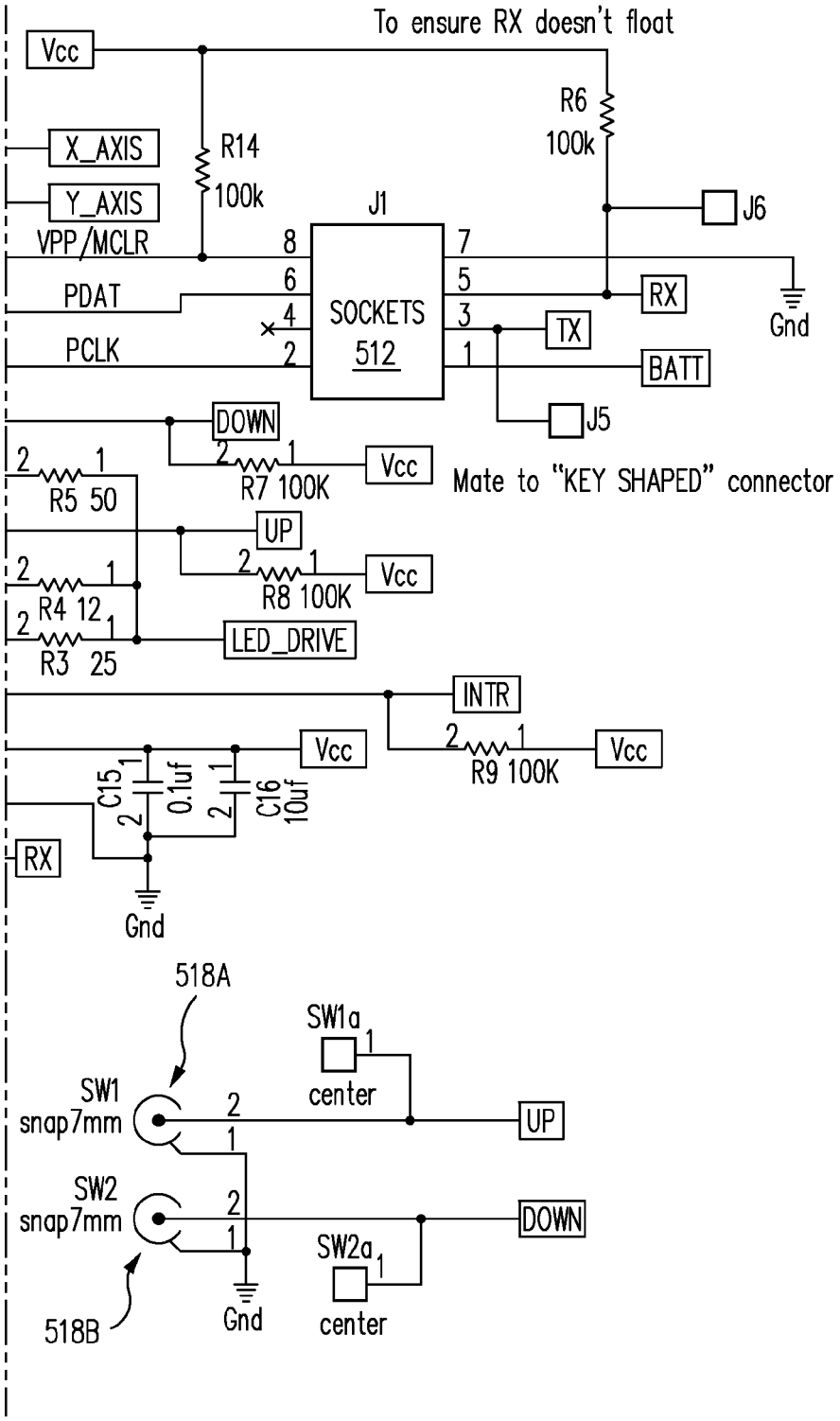
Figure 39A:
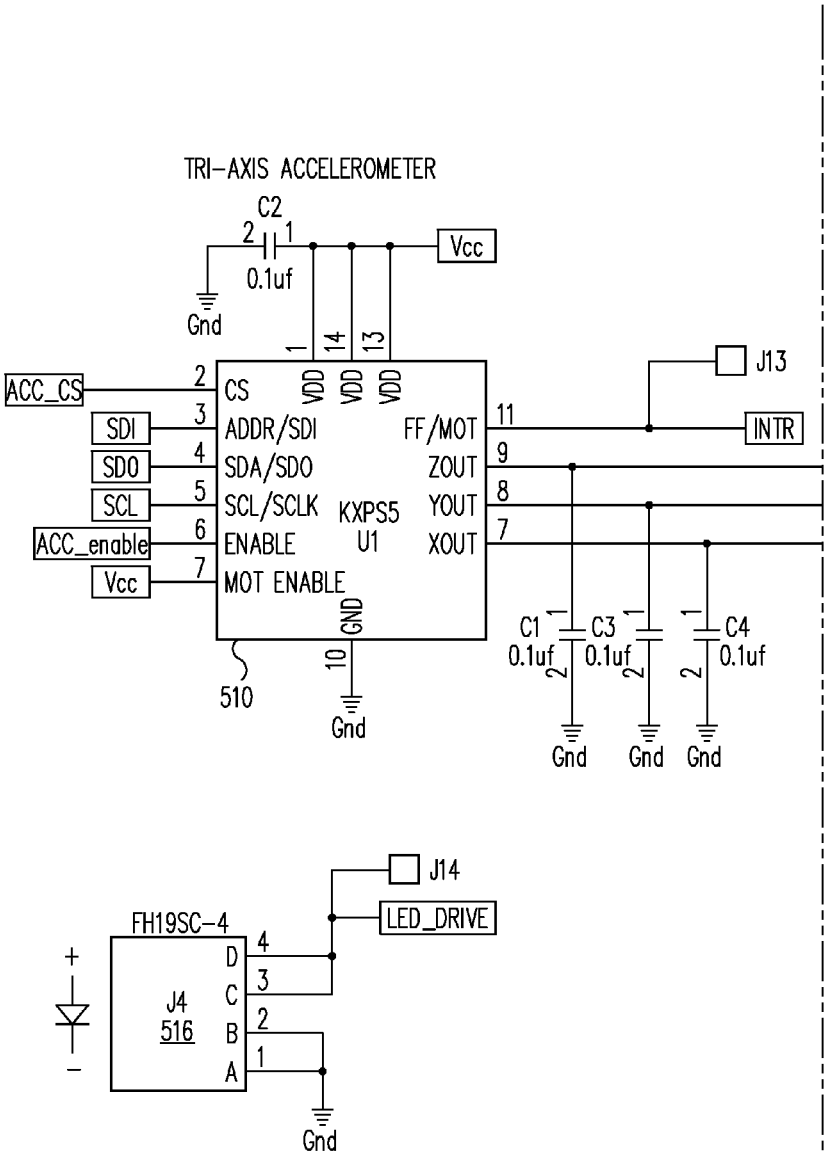
Figure 39B:
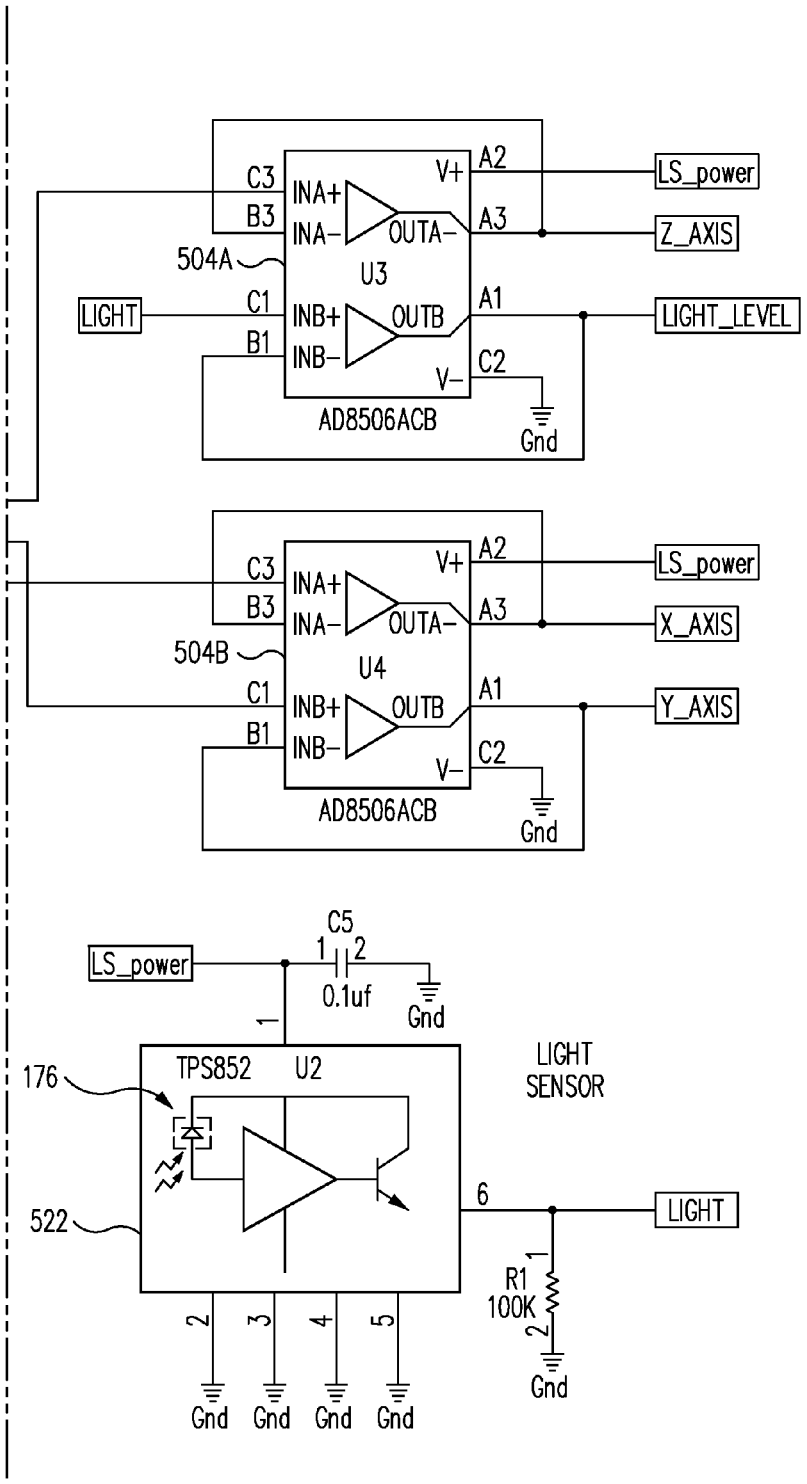

In one embodiment, PCB 311 may be used to provide one or more of various circuit components illustrated in FIGS. 38-39. The various components of FIGS. 38-39 may be used with any of the PCBs of any of the gun sights disclosed herein. Referring now to FIGS. 38-39, PCB 311 may include a microcontroller 502 (e.g., also referred to as "uC" which may be a PIC18F26K20 microcontroller available from Microchip Technology Inc. of Chandler, Ariz. in one embodiment), operational amplifiers 504A-B (e.g., 8506ACB operational amplifiers available from Analog Devices, Inc. of Norwood, Mass. in one embodiment), an accelerometer 510 (e.g., a KXPS5 series tri-axis accelerometer such as any of model numbers KXPS5-1050, KXPS5-2050, KXPS5-3157, KXPS5-4457, or others available from Kionix, Inc. of Ithaca, N.Y. in one embodiment), a socket 512 (e.g., to permit testing and programming of microcontroller 502 while PCB 311 is installed in a gun sight in one embodiment), a connector 516 (e.g., a FH19SC-4 socket available from Hirose Electric USA, Inc. of Simi Valley, Calif. to connect to cable 313 in one embodiment), switch contacts 518A-B (e.g., 7 mm spring snap contacts in one embodiment) for switches 309, an ambient light sensor 522 (e.g., which may include photodiode 176 and may be a TPS852 illumination sensor available from Toshiba America Electronic Components, Inc. of Irvine, Calif. in one embodiment), a battery connection and protection circuit 524, and various other components as shown.

It will be appreciated that various components of FIGS. 38-39 may be interconnected with each other through circuit connections (e.g., through pins, circuit board traces, or otherwise) labeled with various signals as shown. In one embodiment, the various pins of microcontroller 502 may be used in the manner set forth in the following Table 1:

TABLE 1 pins of microcontroller 502

| Pin | Signal/Connection Name (type) | Operation |
|---|---|---|
| 1 | LIGHT_LEVEL (analog) | Analog light level from ambient light sensor; digitized by microcontroller's A/D converter and used to adjust LED intensity for proper viewing |
| 2 | not connected | not connected |
| 3 | not connected | not connected |
| 4 | Z_AXIS (analog) | Z-Axis accelerometer signal; digitized by microcontroller's A/D converter and used for hammer fall detection; intelligent power control may be provided by selectively powering LED and/or other components in response to detection that gun sight is in use (e.g., a shooting mode) |
| 5 | Gnd (power) | System ground; power return path (1 of 2) |
| 6 | not connected | not connected |
| 7 | LS_power (power) | Power supply to ambient light sensor; light sensor may be powered down when not necessary for battery longevity when gun sight is not in use (e.g., not in a shooting mode) |
| 8 | ACC_enable (digital) | Communications enable for accelerometer; normally low, pulled high during serial communications with accelerometer via Serial Peripheral Interface (SPI) |
| 9 | ACC_CS (digital) | Chip select for accelerometer; may be used for accelerometer operation; low starts data acquisition/conversion; stays low until SPI data transfer from current conversion is completed |
| 10 | LED_DRIVE (digital/power) | Drive signal to illuminate LED; pulse width modulation (PWM) signal; PWM duty cycle controls LED's intensity (1 of 4); 4 outputs provide current to LED (e.g., each output may be limited to 25 mA maximum in one embodiment) |
| 11 | SCL (digital) | SPI clock; clock signal for SPI communications with accelerometer |
| 12 | SDO (digital) | SPI data out; data output signal for SPI communications with accelerometer |
| 13 | SDI (digital) | SPI data in; data input signal for SPI communications with accelerometer |
| 14 | TX (digital) | RS-232 data output; RS-232 data path used for system development/troubleshooting |
| 15 | RX (digital) | RS-232 data input; RS-232 data path used for system development/troubleshooting |

TABLE 1-continued

| pins of microcontroller 502 | | |
|---|---|---|
| Pin | Signal/Connection Name (type) | Operation |
| 16 | Gnd (power) | System ground; power return path (2 of 2) |
| 17 | Vcc (power) | System power; from battery; after reverse polarity protection field effect transistor (FET) |
| 18 | INTR (digital) | Interrupt from accelerometer; programmable interrupt from accelerometer; used to wake up sleeping systems in event of large acceleration as part of intelligent power control |
| 19 | LED_DRIVE (digital/power) | Drive signal to illuminate LED; PWM LED drive signal (2 of 4); see pin 10 |
| 20 | LED_DRIVE (digital/power) | Drive signal to illuminate LED; PWM LED drive signal (3 of 4); see pin 10 |
| 21 | UP (digital) | Signal from up button; normally high; low indicates that up button is depressed |
| 22 | LED_DRIVE (digital/power) | Drive signal to illuminate LED; PWM LED drive signal (4 of 4); see pin 10 |
| 23 | DOWN (digital) | Signal from down button; normally high; low indicates that down button is depressed |
| 24 | PCLK (digital) | Programming clock; clock signal for uploading program into microcontroller |
| 25 | PDAT (digital) | Programming data; data signal for uploading program into microcontroller |
| 26 | VPP/MCLR (power) | Programming voltage supply; pulled to programming voltage (Vpp) by external hardware to program microcontroller; held at Vcc for normal operation |
| 27 | Y_AXIS (analog) | Y-Axis accelerometer signal; digitized by microcontroller's A/D converter; see pin 3 |
| 28 | X_AXIS (analog) | X-Axis accelerometer signal; digitized by microcontroller's A/D converter; see pin 3 |

In one embodiment, microcontroller 502 may be configured with appropriate instructions (e.g., software instructions) to provide intelligent power control features for a gun sight. For example, microcontroller 502 may be used to detect weapon orientation and motion in response to various input signals such as, for example, signals received from accelerometer 510. Such detected information may be used by instructions running in microcontroller 502 to identify a current intended use of the weapon (e.g., to identify whether or not a user is ready to fire the weapon). In response to this identified intended use, microcontroller 502 may selectively provide (e.g., supply, limit, and/or interrupt) power to any desired electronic components of the gun sight.

For example, if microcontroller 502 identifies that a user is ready to fire the weapon, then microcontroller 502 may supply power to appropriate electronic components of the gun sight to operate the gun sight in a firing mode (e.g., in live fire or dry fire modes). As another example, if microcontroller 502 identifies that a user is not ready to fire the weapon (e.g., the weapon may be holstered or otherwise not in a firing position), then microcontroller 502 may limit and/or interrupt power to appropriate electronic components of the gun sight to conserve power (e.g., to permit longer battery life to be realized).

In one embodiment, the various pins of accelerometer 510 may be used in the manner set forth in the following Table 2:

TABLE 2

| pins of accelerometer 510 | | |
|---|---|---|
| Pin | Signal/Connection Name (type) | Operation |
| 1 | Vcc (power) | System power; from battery; after reverse polarity protection FET (1 of 3) |
| 2 | ACC_CS (digital) | Chip select; may be used for accelerometer operation; low starts data acquisition/conversion; stays low until SPI data transfer from current conversion is completed |
| 3 | SDI (digital) | SPI data in; data input signal for SPI communications with microcontroller |
| 4 | SDO (digital) | SPI data out; data output signal for SPI communications with microcontroller |
| 5 | SCL (digital) | SPI clock; clock signal for SPI communications with microcontroller |
| 6 | ACC_Enable (digital) | Communications enable; high from microcontroller permits accelerometer to communicate via SPI |
| 7 | XOUT (analog) | Accelerometer X axis signal; buffered by op-amp and presented to microcontroller's A/D converter |
| 8 | YOUT (analog) | Accelerometer Y axis signal; buffered by op-amp and presented to microcontroller's A/D converter |
| 9 | ZOUT (analog) | Accelerometer Z axis signal; buffered by op-amp and presented to microcontroller's A/D converter |

TABLE 2-continued

| pins of accelerometer 510 | | |
|---|---|---|
| Pin | Signal/Connection Name (type) | Operation |
| 10 | Gnd (power) | System ground; power return path |
| 11 | INTR (digital) | Accelerometer interrupt; Programmable interrupt; goes high if programmed acceleration value is exceeded in one embodiment; may be used by microcontroller to wake from sleep mode to support intelligent power control |
| 12 | MOT ENABLE (digital) | Interrupt enable; pulled high (Vcc) to allow generation of interrupt signal (see pin 11) |
| 13 | Vcc (power) | System power; from battery; after reverse polarity protection FET (2 of 3) |
| 14 | Vcc (power) | System power; from battery, after reverse polarity protection FET (3 of 3) |

In one embodiment, the various pins of ambient light sensor 522 may be used in the manner set forth in the following Table 3:

TABLE 3

| pins of ambient light sensor 522 | | |
|---|---|---|
| Pin | Signal/ Connection Name (type) | Operation |
| 1 | LS_power (power) | Light sensor power; may be supplied by microcontroller output; low/off saves power for intelligent power control; high/on allows operation |
| 2 | Gnd (power) | Ground; power return path |
| 3 | Gnd (power) | Ground; power return path |
| 4 | Gnd (power) | Ground; power return path |
| 5 | Gnd (power) | Ground; power return path |
| 6 | LIGHT (analog) | Analog output; voltage may be a function of detected ambient light in one embodiment |

In one embodiment, the various pins of operational amplifier 504A may be used in the manner set forth in the following Table 4:

TABLE 4

| pins of operational amplifier 504A | | |
|---|---|---|
| Pin | Signal/ Connection Name (type) | Operation |
| A2 | LS_power (power) | Light sensor power; may be supplied by microcontroller output; low/off saves power for intelligent power control; high/on allows operation |
| C2 | Gnd (power) | Ground; power return path |
| C1 | LIGHT (analog) | Analog light level from ambient light sensor; voltage may be a function of detected ambient Light in one embodiment |
| B1, A1 | LIGHT_LEVEL (analog) | Buffered light level; sent to microcontroller's A/D converter for digitization |
| C3 | ZOUT (analog) | Z axis signal from accelerometer; amplitude may be a function of Z axis measured acceleration in one embodiment |
| B3, A3 | Z_AXIS (analog) | Buffered Z axis level; sent to microcontroller's A/D converter for digitization |

In one embodiment, the various pins of operational amplifier 504B may be used in the manner set forth in the following Table 5:

TABLE 5

| pins of operational amplifier 504B | | |
|---|---|---|
| Pin | Signal/ Connection Name (type) | Operation |
| A2 | LS_power (power) | Light sensor power; light sensor may be powered down (e.g., when not needed) for battery longevity in response to detection that gun sight is not in use (e.g., not in a shooting mode) |
| C2 | Gnd (power) | Ground; power return path |
| C1 | YOUT (analog) | Y axis signal from accelerometer; amplitude may be a function of Y axis measured acceleration in one embodiment |
| B1, A1 | Y_AXIS (analog) | Buffered Y axis level; sent to microcontroller's A/D converter for digitization |
| C3 | XOUT (analog) | X axis signal from accelerometer; amplitude may be a function of X axis measured acceleration in one embodiment |
| B3, A3 | X_AXIS (analog) | Buffered X axis level; sent to microcontroller's A/D converter for digitization |

In one embodiment, the various pins of battery connection and protection circuit 524 may be used in the manner set forth in the following Table 6:

TABLE 6

| pins of battery connection and protection circuit 524 | | |
|---|---|---|
| Pin | Signal/ Connection Name (type) | Operation |
| 1 | Gnd (power) | System ground; reference pin for backwards battery detection |
| 2 | Vcc (power) | System power; if pin 1 is negative relative to reference pin 3 (battery inserted backwards), FET turns off and no current flows in one embodiment; if pin 1 is positive relative to reference pin 3 (battery inserted correctly), FET turns on to provide power supply to system in one embodiment |
| 3 | BATT (power) | Battery positive; connected to positive battery terminal |
| J2 | BATT (power) | System power (prior to polarity protection); power supply from battery |
| J3 | Gnd (power) | System ground; main power return path to battery |

In one embodiment, the various pins of switch contact 518A may be used in the manner set forth in the following Table 7:

TABLE 7 pins of switch contact 518A

| Pin | Signal/ Connection Name (type) | Operation |
|---|---|---|
| 1 | Gnd (digital) | System ground; power return path |
| 2 | UP (digital) | Up button pressed signal; pulled high internally by microcontroller; pulled to ground by up button press |

In one embodiment, the various pins of switch contact 518B may be used in the manner set forth in the following Table 8:

TABLE 8 pins of switch contact 518B

| Pin | Signal/ Connection Name (type) | Operation |
|---|---|---|
| 1 | Gnd (digital) | System ground; power return path |
| 2 | DOWN (digital) | Down button pressed signal; pulled high internally by microcontroller; pulled to ground by down button press |

In one embodiment, the various pins of socket 512 may be used in the manner set forth in the following Table 9:

TABLE 9 pins of socket 512

| Pin | Signal/ Connection Name (type) | Operation |
|---|---|---|
| 1 | BATT (power) | Remote power to system (prior to polarity protection); provides power to system if battery is not installed; provided by external hardware through connector |
| 2 | PCLK (digital) | Programming clock; clock signal for uploading program into microcontroller; provided by external hardware through connector |
| 3 | TX (digital) | RS-232 data output; RS-232 data path used for system development/troubleshooting |
| 4 | not connected | not connected |
| 5 | RX (digital) | RS-232 data input; RS-232 data path used for system development/troubleshooting |
| 6 | PDAT (digital) | Programming data; data signal for uploading program into microcontroller; provided by external hardware through connector |
| 7 | Gnd (power) | System ground; power return path; provided by external hardware |
| 8 | VPP/MCLR (digital) | Programming voltage supply; pulled to programming voltage (Vpp) by external hardware to program microcontroller; held at Vcc by onboard resistor for normal operation |

In one embodiment, the various pins of connector 516 may be used in the manner set forth in the following Table 10:

TABLE 10 pins of connector 516

| Pin | Signal/ Connection Name (type) | Operation |
|---|---|---|
| 1 | Gnd (power) | System ground; power return path (1 of 2) |
| 2 | Gnd (power) | System ground; power return path (2 of 2) |
| 3 | LED_DRIVE (digital/power) | Drive signal to illuminate LED; PWM signal; PWM duty cycle controls LED's intensity (1 of 2) |
| 4 | LED_DRIVE (digital/power) | Drive signal to illuminate LED; PWM signal; see pin 3 (2 of 2) |

In one embodiment, test connections shown in FIGS. 38-39 and may be used in the manner set forth in the following Table 11:

TABLE 11 test connections

| Pin | Signal/ Connection Name (type) | Operation |
|---|---|---|
| J5 | TX (digital) | RS-232 data output; RS-232 data path used for system development/troubleshooting |
| J6 | RX (digital) | RS-232 data input; RS-232 data path used for system development/troubleshooting |
| J7 | Vcc (power) | System power; power supply after reverse polarity protection FET |
| J13 | INTR (digital) | Accelerometer interrupt; programmable interrupt; goes high if programmed acceleration value is exceeded in one embodiment; may be used by microcontroller to wake from sleep mode to support intelligent power control |
| J14 | LED_DRIVE (digital/power) | PWM signal; PWM duty cycle controls LED's intensity |
| SW1a | UP (digital) | Up button pressed signal; pulled high internally by microcontroller; pulled to ground by up button press |
| SW2a | DOWN (digital) | Down button pressed signal; pulled high internally by microcontroller; pulled to ground by down button press |

Figure 8:
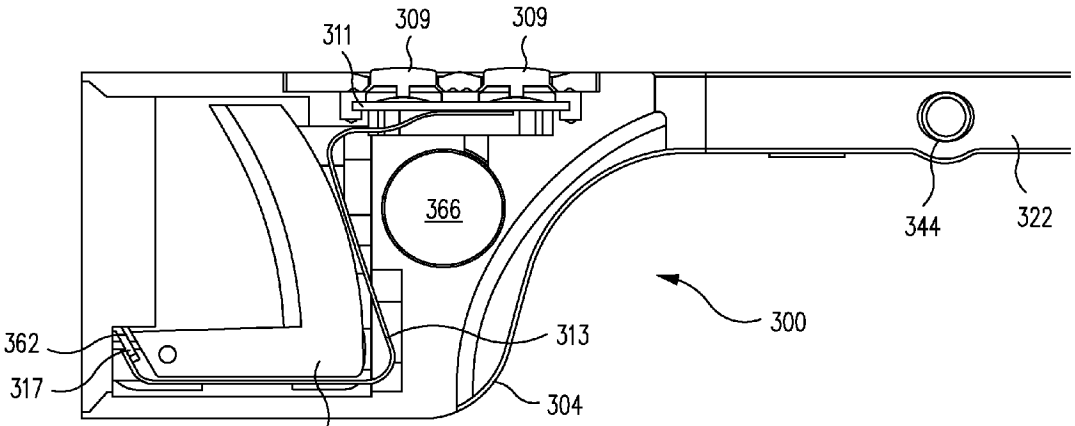
Figure 9:
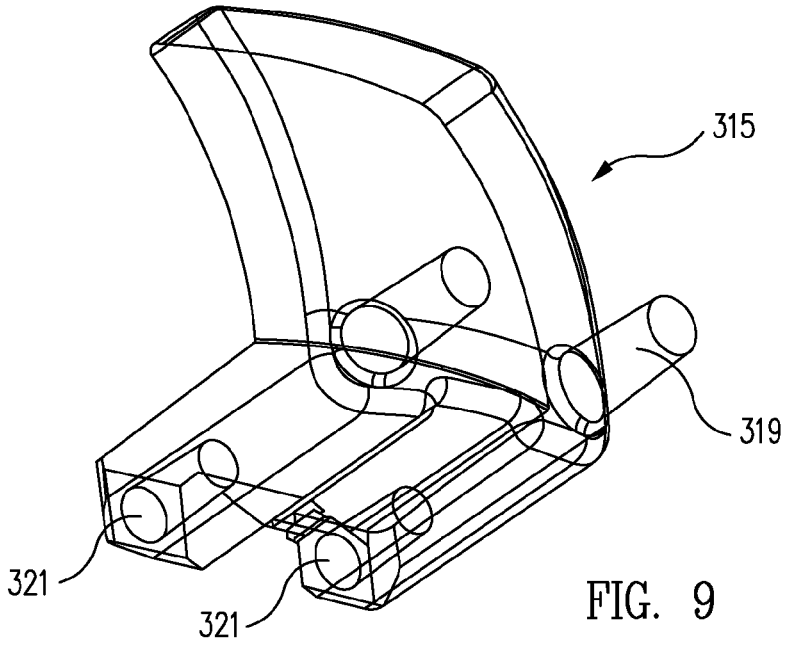
Figure 10:
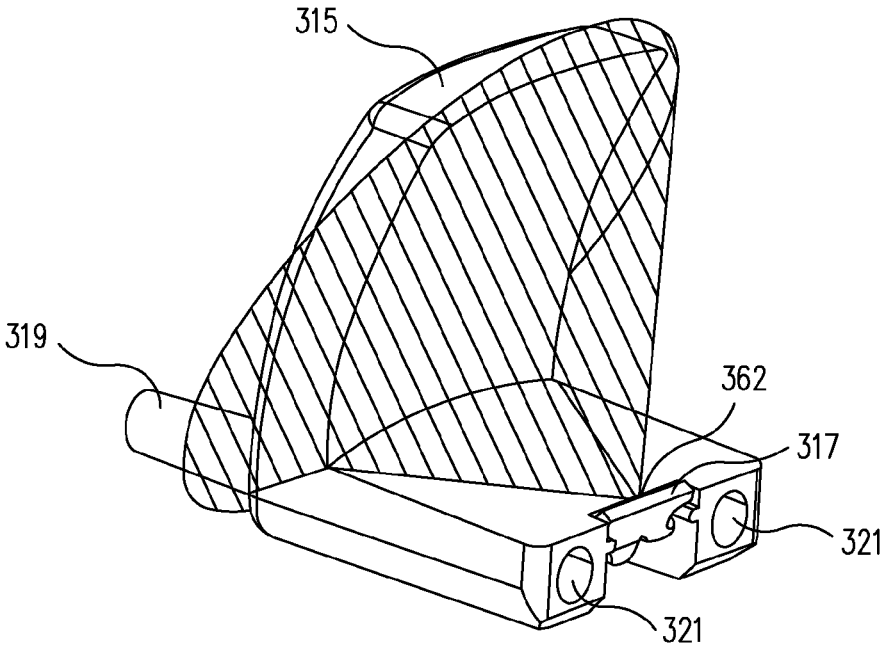
Figure 11:
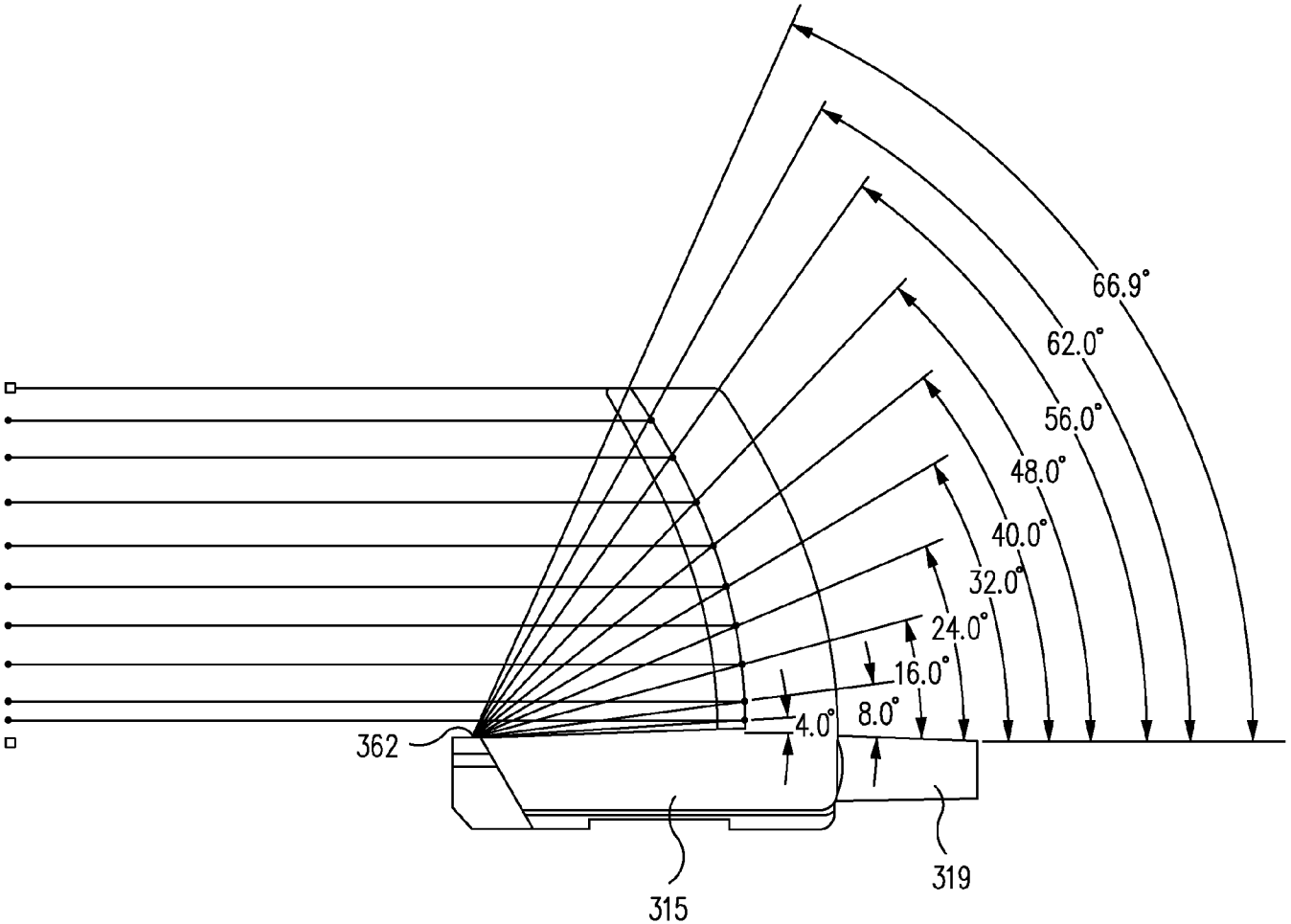
Figure 12:
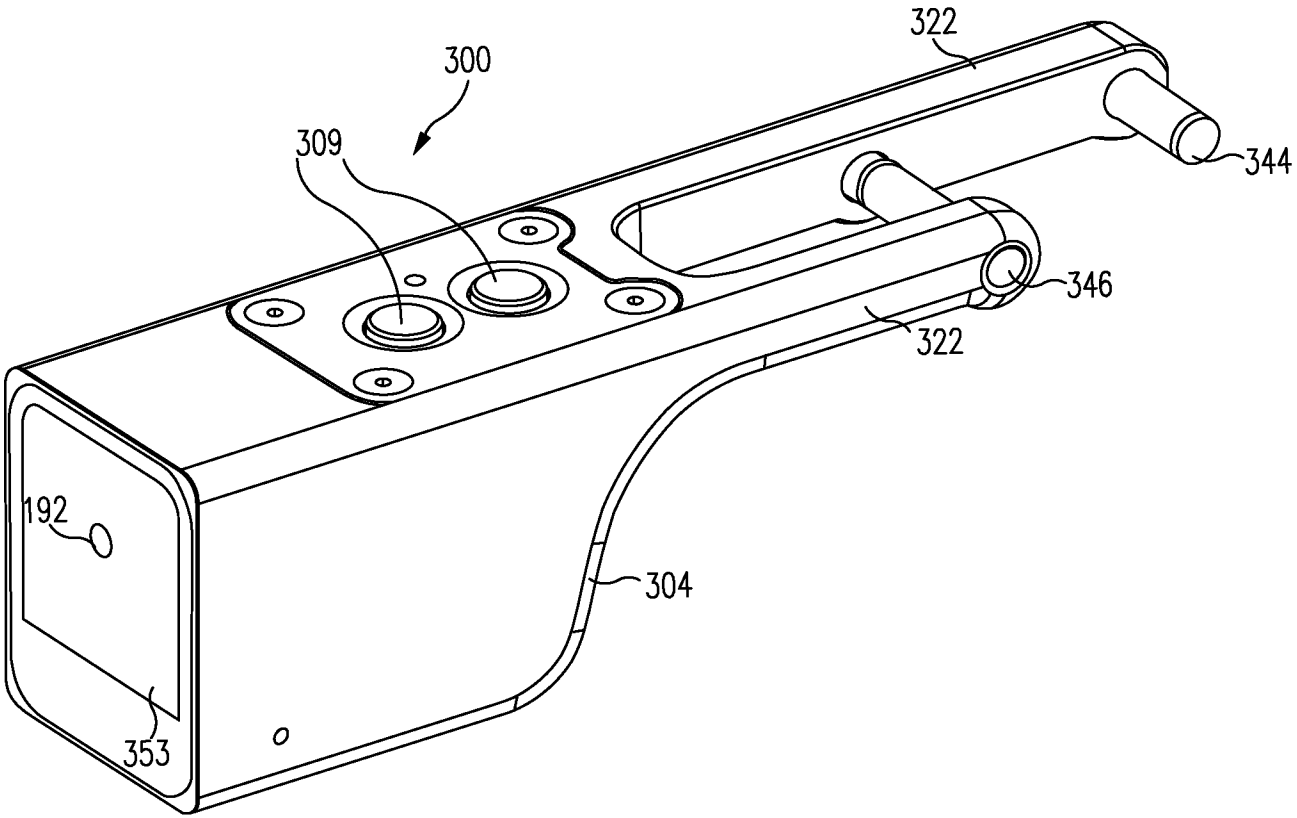
Figure 13:
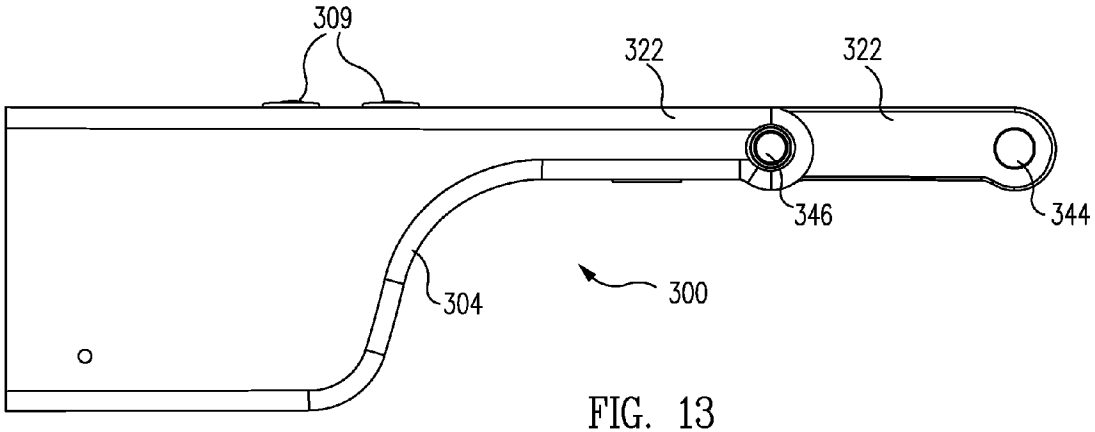
Figure 14:
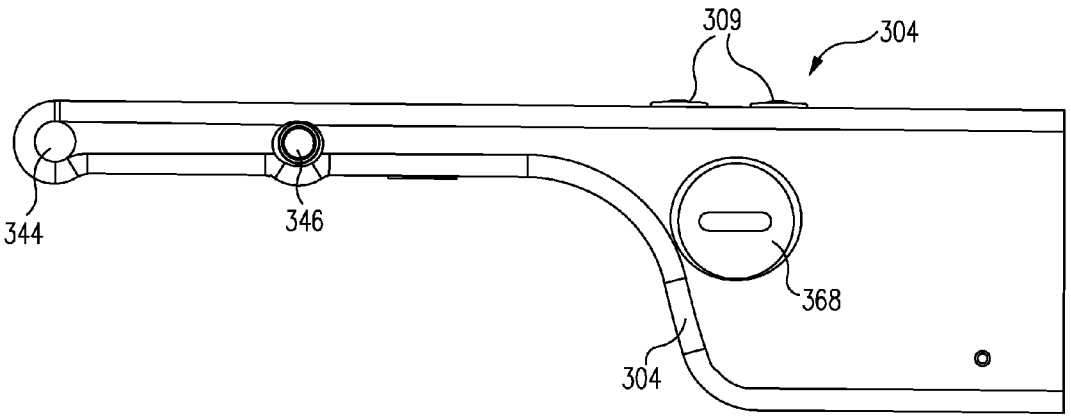
Figure 16:
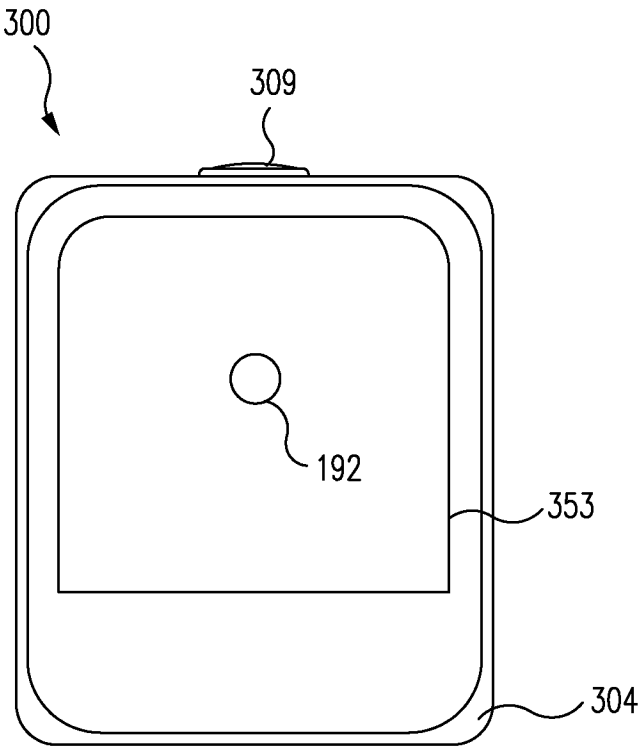
Figure 15:
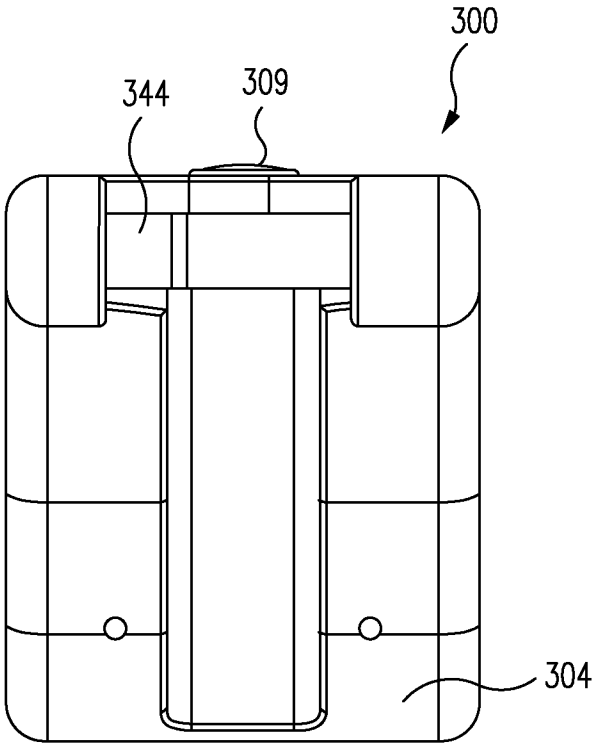
Figure 17:
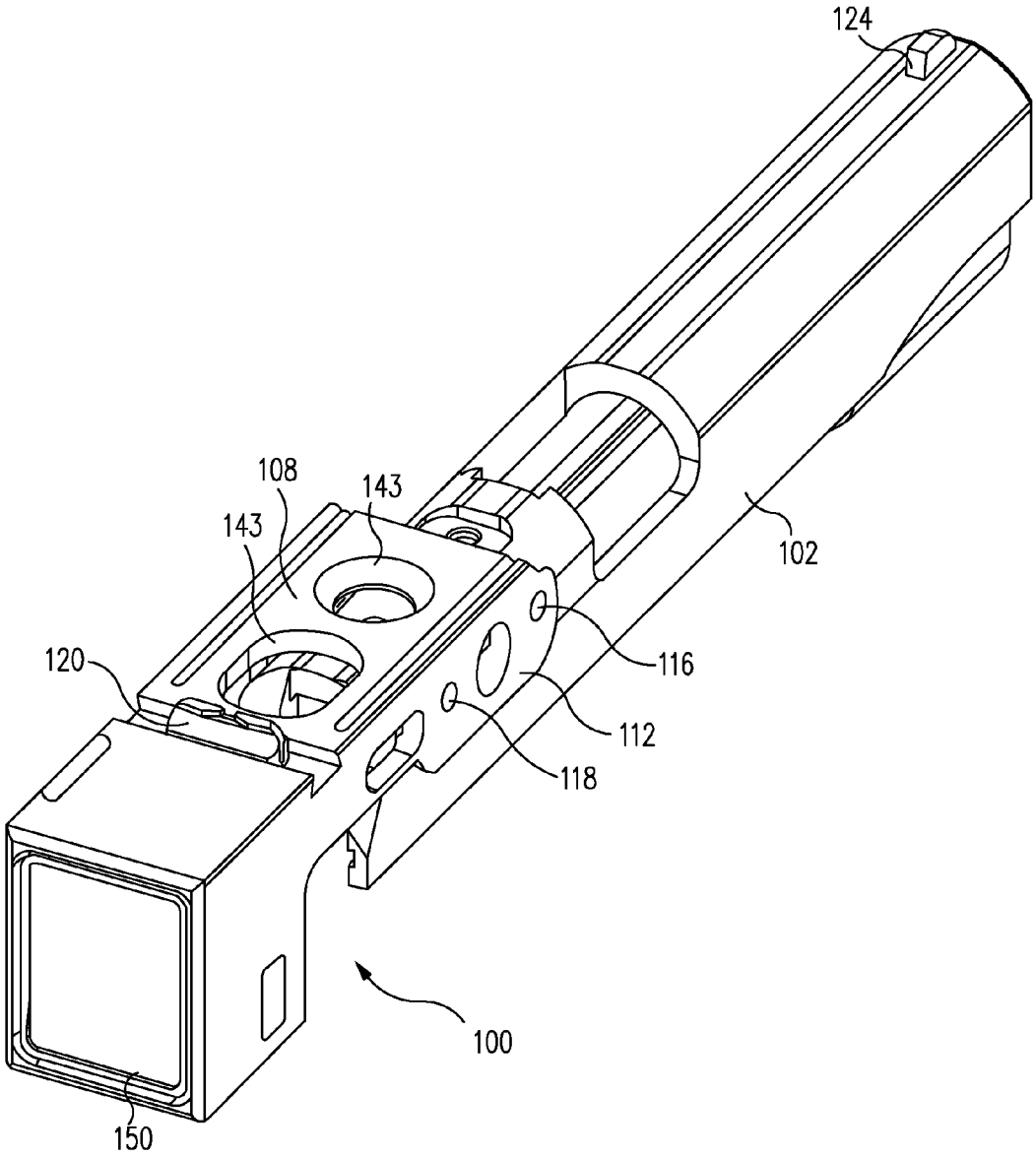
FIGS. 17-22 illustrate various implementations of a gun sight employing a refractive optical implementation in accordance with embodiments of the invention.
Figure 18:
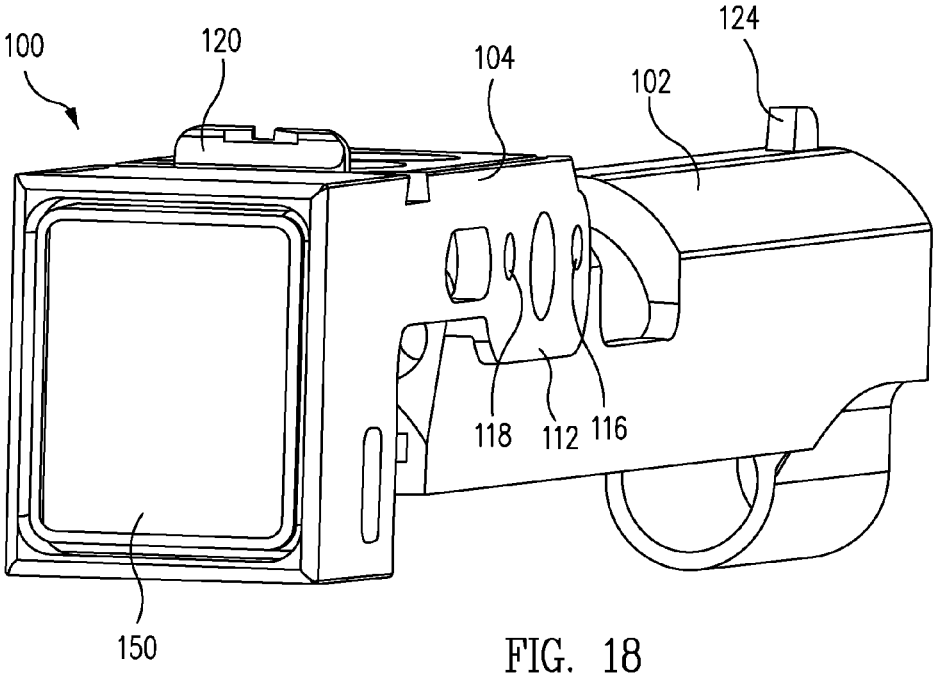
Figure 19:
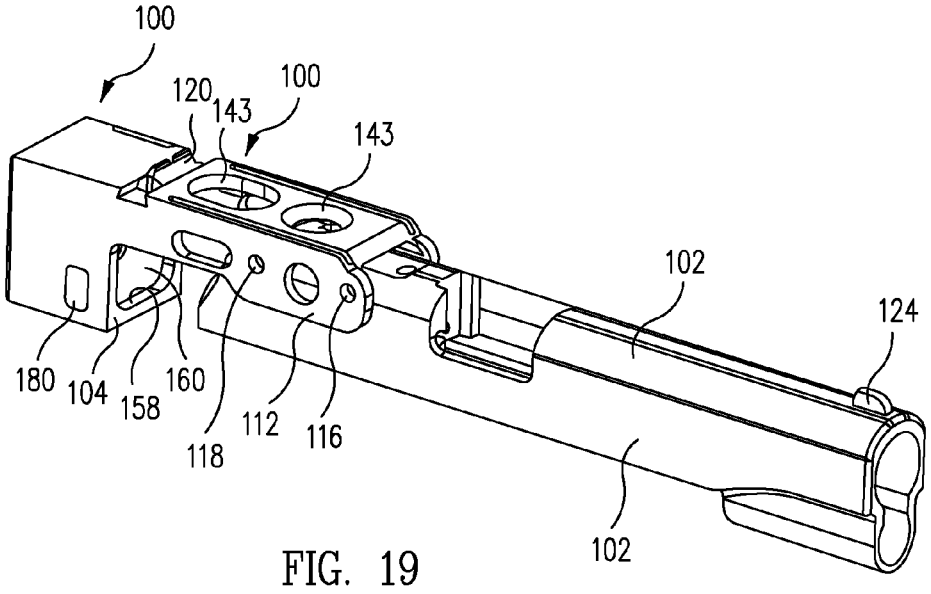
Figure 20:
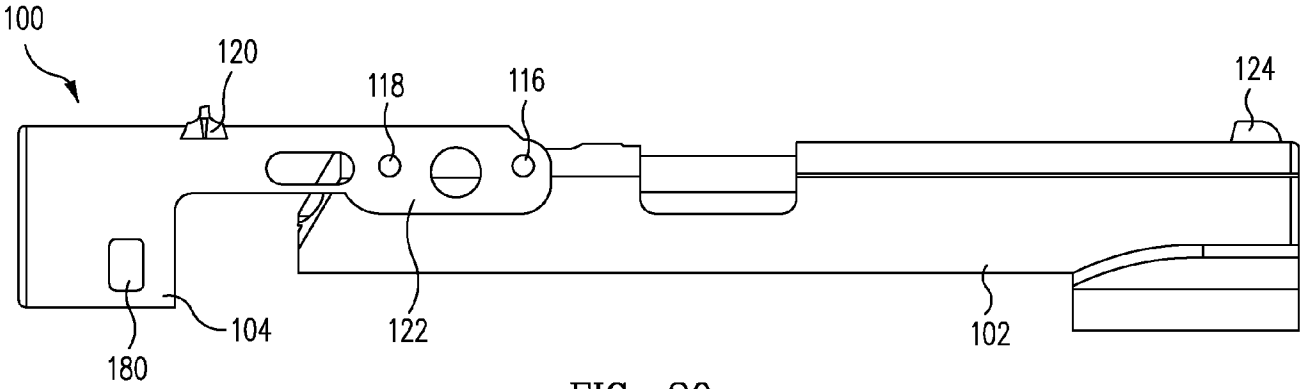
Figure 21:
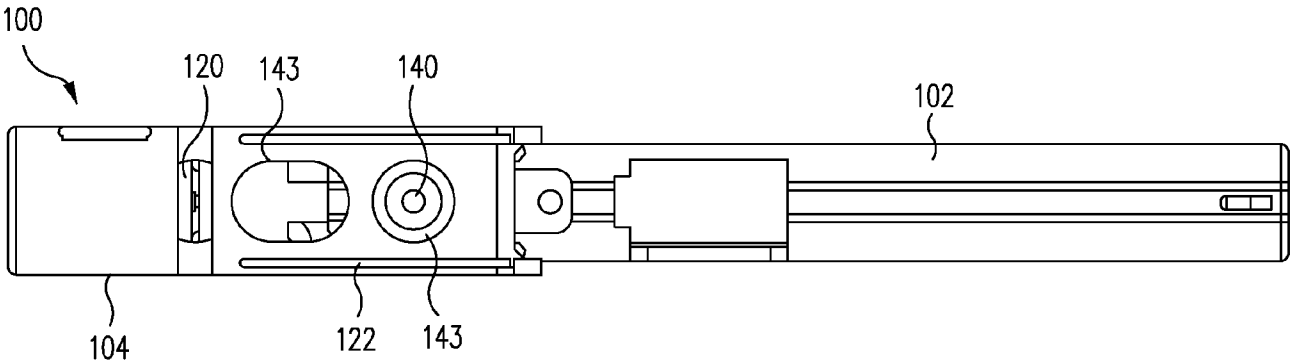

Referring now to FIG. 8, the illuminated dot generator of the sight 300 comprises a rearward facing parabolic mirror or reflector 315, and an LED point light source 362 mounted on a PCB 317 disposed to face toward the reflector 315. As illustrated in FIG. 8, the PCB 317 and light source 362 are arranged such that light from the light source 362 radiates forwardly toward the parabolic reflective surface of the reflector 315 and is thereby reflected as a collimated beam of light rearward through the rectangular aperture 353 of the sight 300. The path taken by the light rays in an embodiment 300 is illustrated diagrammatically in FIG. 11. The result is a collimated plane wave that is seen by the user as an illuminated dot focused at infinity.

The parabolic reflector 315 may be constructed of a variety of materials and may be configured in a wide variety of ways. For example, the reflective surface may be integrated into a molded plastic part, or it may be a separate component that is affixed to a frame or other structure. As illustrated in, e.g., FIGS. 9-11, the reflector 315 may incorporate alignment features, such as forward extending protrusions 319 on the rear of the reflector 315 for aligning the reflector 315 in the housing 304, and, for example, cylindrical bores 321 extending into the front of the reflector 315 for aligning the PCB 317 and light source 362 with the reflective surface of the reflector 315.

FIGS. 17-22 are perspective views of a "refractive" sight 100 in accordance with an embodiment of the invention, shown mounted at a rear end of a slide 102 of an associated automatic pistol. The remainder of the pistol, such as a hammer, grip, trigger, and the like are omitted for clarity. This embodiment includes mechanisms that allow the user to adjust the elevation of the sight 100 in the field.

Figure 22:
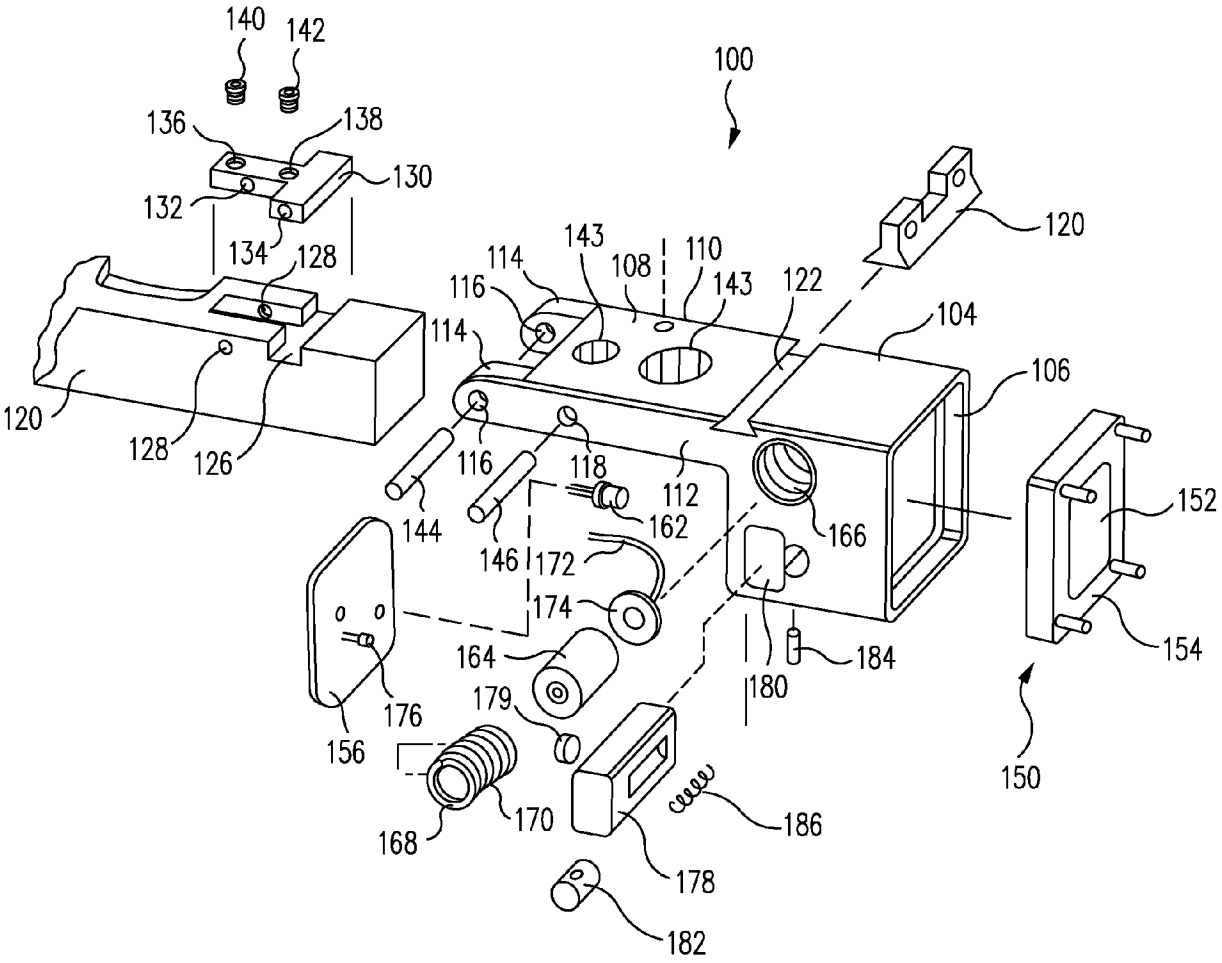

With reference to the exploded view of FIG. 22, the sight 100 comprises a generally rectangular housing 104 having a stepped, rectangular opening 106 at a rear end thereof, an upper surface 108, and a forwardly protruding portion 110 that defines a pair of ears 112 that extend downward so as to straddle a rear end of the pistol slide 102. Each of the ears 112 includes a lug 114 at the front end thereof, and the lugs 114 include a pair of respective front mounting pin apertures 116 that are coaxial with each other. A second pair of rear coaxial mounting pin apertures 118 is disposed in the ears 112 rearwardly of the front mounting pin apertures 116.

In one embodiment, in order to accommodate the mounting of the sight 100, the rear portion of the slide 102 may be modified. First, the rear sight 120 of the pistol is removed from a corresponding transverse notch in the slide 102 and reinstalled in a corresponding transverse slot 122 disposed in the upper surface 108 of the housing 104. This permits the rear sight 120 to be used in cooperation with the front sight 124 located at the front end of the slide 102 to sight the pistol on a target in the conventional manner.

As illustrated in FIG. 22, after the notched rear sight 120 is removed from the slide 102 and relocated as above, a T-shaped recess 126 is formed in the upper surface of the slide 102, with the cross-bar of the T being disposed at the former location of the groove in which the notched rear sight 120 was formerly mounted, and with the vertical leg of the T extending forwardly. Coaxial mounting pin apertures 128 are formed in the slide 102 on opposite sides of the vertical leg of the T-shaped recess. A T-shaped pivot block 130 is then disposed in the T-shaped recess 126. The pivot block 130 is shaped correspondingly to the T-shaped recess 126 in the slide 102, and includes first and second transverse mounting pin apertures 132 and 134 and first and second threaded vertical apertures 136 and 138. First and second elevation adjustment setscrews 140 and 142 are respectively disposed in the vertical apertures 136 and 138.

During assembly of the sight 100 to the rear of the slide 102, the front mounting pin apertures 116 in the ears 112 of the housing 104 are coaxially aligned with the mounting pin apertures 128 in the slide 102 and the first transverse mounting pin aperture 132 in the pivot block 130, and a front mounting pin 144 is then inserted through apertures 116, 128, and 132 with a tight, frictional fit. Similarly, the rear mounting pin apertures 118 in the housing 104 are coaxially aligned with the second transverse mounting pin aperture 134 in the pivot block 130, and a rear mounting pin 146 is then inserted through apertures 118 and 134 with a tight, frictional fit. This arrangement permits the sight 100 to pivot up and down on the forward mounting pin 144 (e.g., relative to the slide 102) for elevation adjustment of the sight 100, and the sight 100 is locked into the desired elevation position by suitable tightening of the first and second elevation adjustment setscrews 140 and 142. Tool access to the setscrews 140 and 142 may be provided by suitably located access openings 143 located in the upper surface 108 of the housing 104.

The design of this sight 100 contemplates that all azimuth adjustment of the sight 100 be effected when it is initially installed on the gun, and hence, provides only for elevation adjustment by the user. During construction and assembly of each sight 100, at the stage at which it is mounted to the slide 102 of the gun, special care is taken to achieve very accurate azimuth alignment of the illuminated dot to the bore of the weapon. However, the mechanical design of the sight 100 does allow the sight, after removal of the rear mounting pin 146, to be rotated upward by 90 degrees, which permits the sight 100 and slide 102 to be removed from the weapon for cleaning and to provide access to the battery compartment of the sight 100 described below.

The optical portion of the sight 100 comprises a lens assembly 150 retained in the stepped, rectangular opening 106 at the rear end of the housing 104. In one embodiment, the lens assembly 150 comprises an aspheric lens 152 having a convex outer surface and a planar inner surface that is retained in a rectangular mounting bezel 154. In one embodiment, the lens 152 is molded of an acrylic plastic that is dyed red and provided with a hard coating to protect the exterior surface thereof.

The lens assembly 150 defines an active rectangular aperture that, in one embodiment, may be about 1.0 in. high by about 0.9 in. wide, with corners having a radius of about 3/16 inch. The aperture is centered behind the slide 102, with its center located approximately 0.25 in. below the axis of the barrel of the gun.

As illustrated in FIG. 22, a PCB 156 (e.g., used for light source control) is disposed opposite to the lens assembly 150 in a front opening 158 (see FIG. 19) at the front of a lower rear interior compartment 160 defined by the housing 104, and point light source 162, such as a light emitting diode or laser diode, is mounted thereon such that it is located substantially coaxially on the optical axis of the lens 152. The light radiating from the light source 162 travels directly through the lens 152 as a plane wave and appears to the user as a red dot (e.g., a small uniform disk of light focused at infinity). In one embodiment, the light source 162 may comprise a laser diode capable of emitting red light at a wavelength of 650 nm, which yields a 1 minute of angle (MOA) red dot when viewed through the aspheric lens 152. Light sources with other wavelengths and/or angles may be used in other embodiments.

In FIG. 22, the light source 162 is powered by a small battery 164, such as a ⅓ N cell lithium or NiCad battery, contained in a cylindrical battery compartment 166 in the housing 104 and held therein by a small, threaded battery door 168 and compression spring 170. Power from the battery 164 is conveyed to the PCB 156 via a service loop of electrical wire 172 that couples between the PCB 156 and an internal battery contact 174.

In use, the brightness of the illuminated dot produced by the light source 162 may be automatically scaled to the ambient light level using a photodiode 176 that senses ambient light through the lens assembly 150 of the sight 100. The brightness level bias, i.e., the ratio of the brightness of the illuminated dot to the brightness of the ambient light may be scaled up or down through two orders of magnitude using a cross pin 178, which is retained in a rectangular transverse bore 180 (e.g., which may be implemented on a left and/or a right side of housing 104 as shown in FIGS. 17-22) in the housing 104 by an adjacent cylindrical plug 182 and friction pin 184, and is loaded by a spring 186 in a neutral position. The cross pin 178 is arranged such that depressing the cross pin 178 toward the right side of the housing 104 reduces (e.g., "scrolls down") the brightness of the light source 162, and depressing it left increases (e.g., "scrolls up") the brightness. In one embodiment, sight 100 may include a magnet 179 which may cooperate with a Hall effect sensor of sight 100 to permit sight 100 to detect a position of cross pin 178 (e.g., through operation of microcontroller 502).

The sight 100 may also be turned on and off by a depression of the cross pin 178, or alternatively, by a separate switch, and may remain on continuously, or alternatively, may remain on for a predetermined period of time, e.g., 24 hours, and then turn off automatically via a timer function incorporated in the PCB 156. In one embodiment, a longer "on" period may be implemented, together with the ability to turn the sight 100 off by a double or triple "click" of the cross pin 178. In one embodiment, a warning of a low battery condition in the sight 100 may be sensed by suitable voltage detection circuitry on the PCB 156 and signaled to the user by a continuous blinking of the illuminated dot. Convenient access to the cross pin 178 permits a user to easily pick up the weapon and instantly turn on the sight 100 as the weapon is brought to bear.

Figure 23:
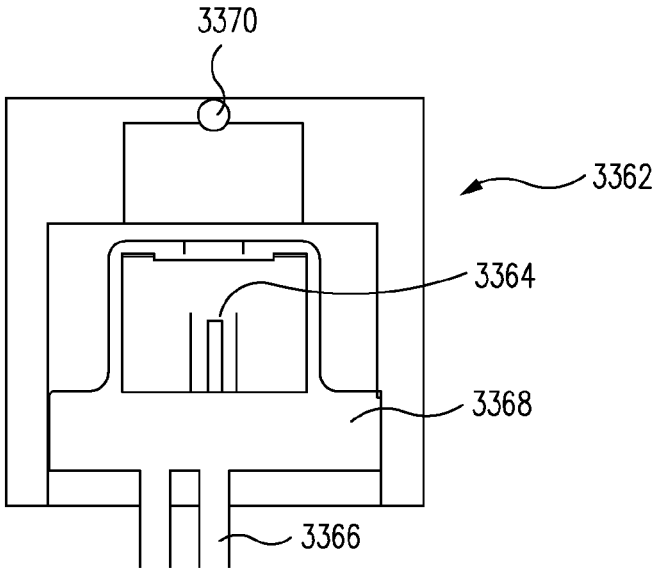
FIG. 23 illustrates a light source diode (LED) in accordance with an embodiment of the invention.
Figure 24:
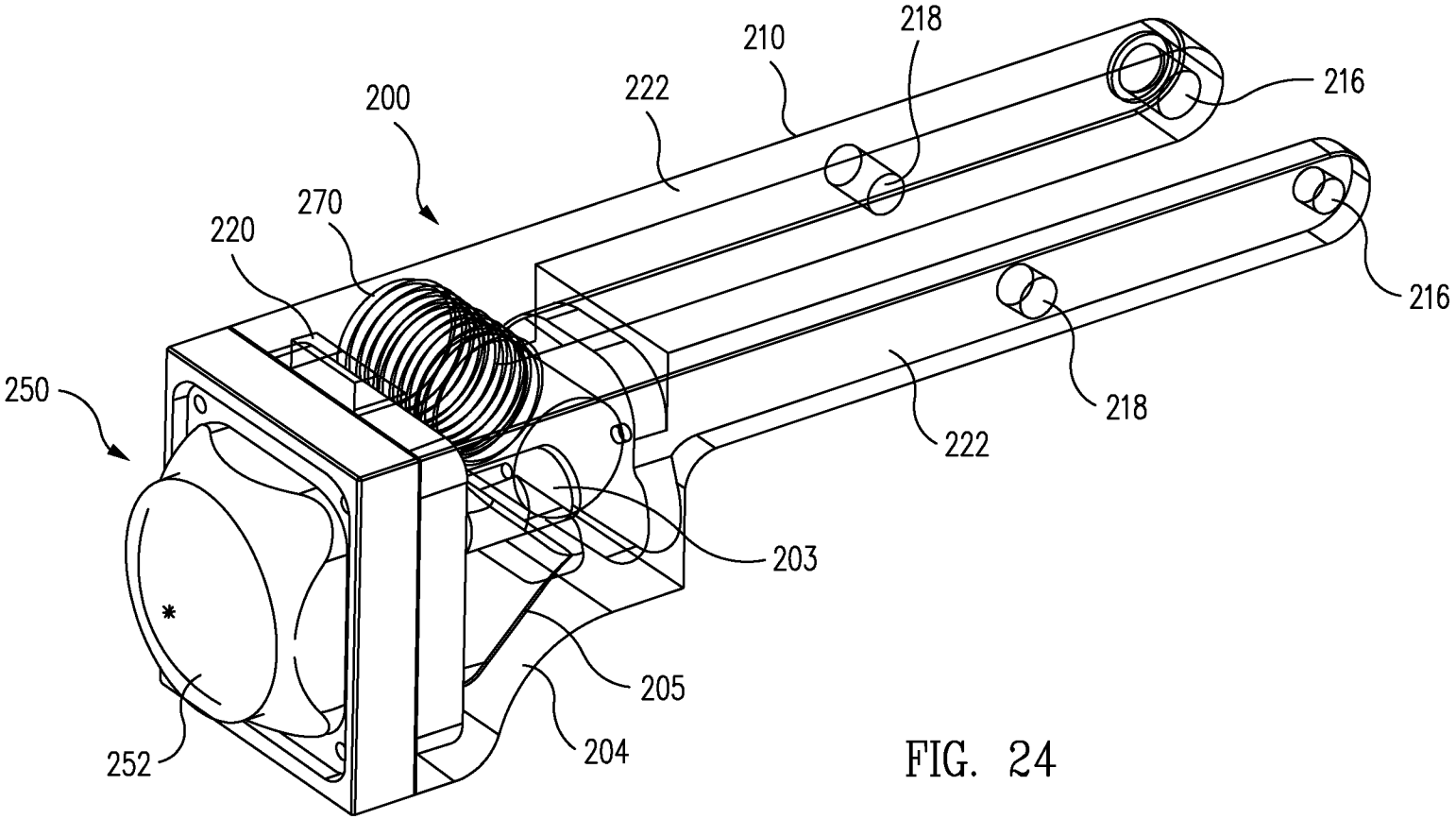
FIGS. 24-32 illustrate various additional implementations of gun sight employing a refractive optical implementation in accordance with embodiments of the invention.
Figure 32:
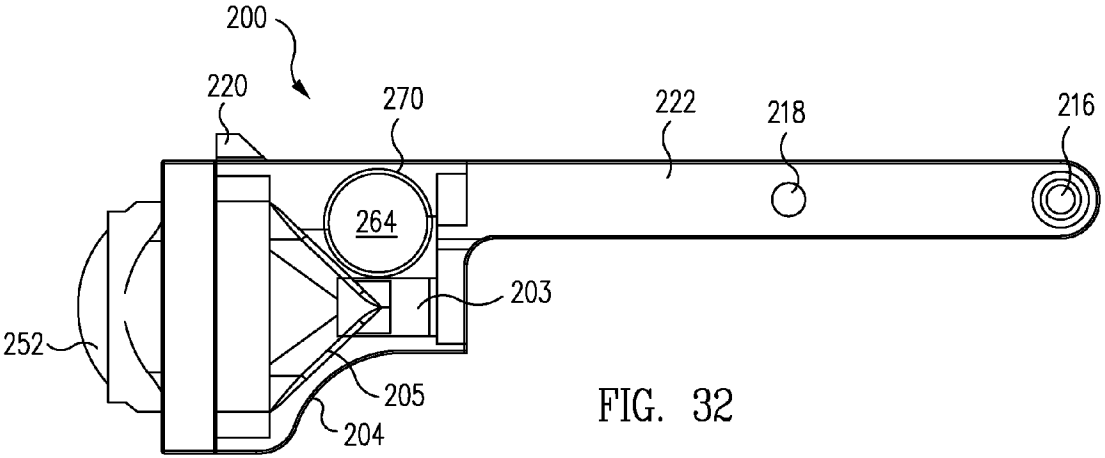
Figure 25:
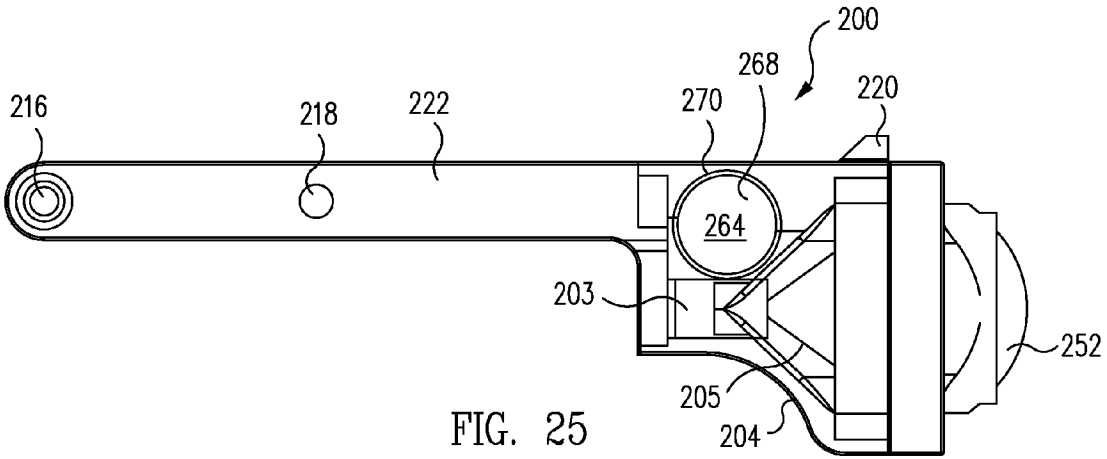
Figure 27:
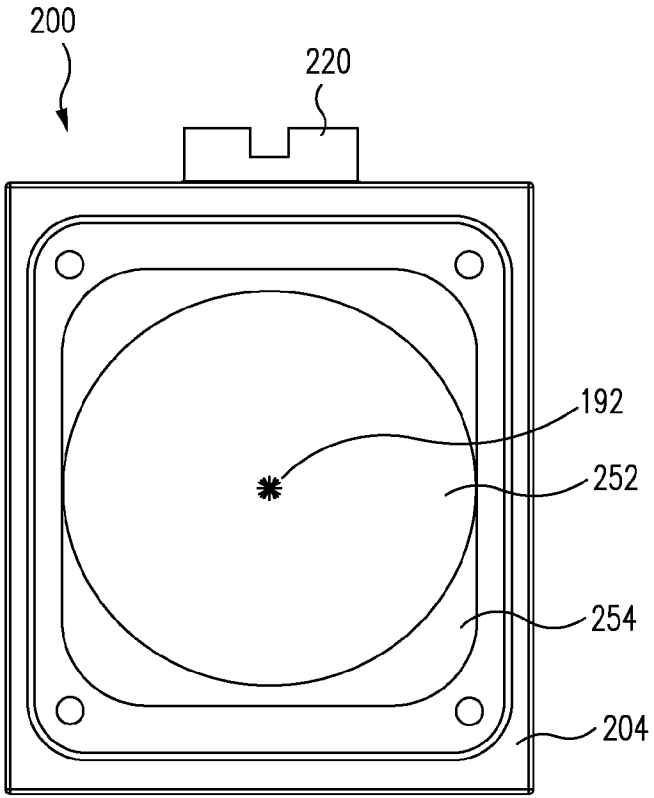

FIG. 23 is a cross-sectional view of an embodiment of a light emitting diode (LED) point light source 3362 in accordance with an embodiment of the invention. The LED light source 3362 may be used in any of the sights described herein. The LED light source 3362 comprises a light emitting diode junction 3364, which may be a laser diode in one embodiment, formed at the upper ends of a conductor 3366 of the device, which is hermetically sealed in a housing 3368. An opening in the upper end of the housing 3368 is closed with a spherical lens 3370, through which light generated by the device is radiated in a hemispherical direction.

Another embodiment of a refractive sight 200 in accordance with an embodiment of the invention is illustrated in FIGS. 24-28, wherein the housing 204 is shown as though transparent to reveal underlying structure, such as the battery compression spring 270. The sight 200 is similar in construction and operation to the sight 100 described above, but with the following exceptions. The forward protruding portion 210 of the housing 204 of the sight 200 may eliminate the transverse upper surface 108 of the sight 100 and instead comprises a pair of parallel, forwardly extending ears 222 that are adapted to straddle an elongated land 207 (see FIG. 28) mounted on the upper surface of the slide 202 of an associated pistol. The housing 204 may be secured to the slide 202 by appropriate pins (e.g., pin 244) extending through apertures 216 and 218. A rear sight 220 may be provided on housing 204 to permit aiming the associated pistol (e.g., in cooperation with a corresponding front sight 124) with conventional open sights if desired.

Figure 26:
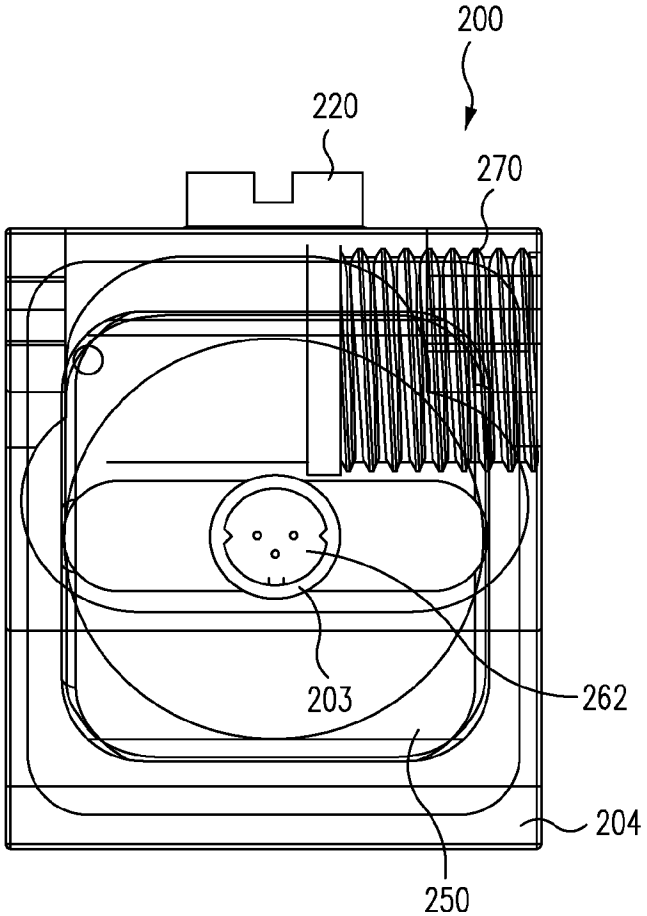
Figure 28:
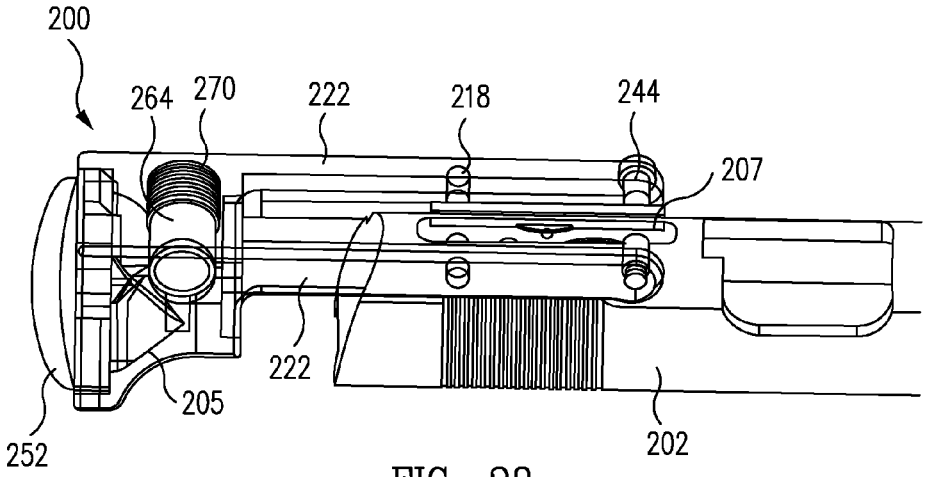
Figure 30:
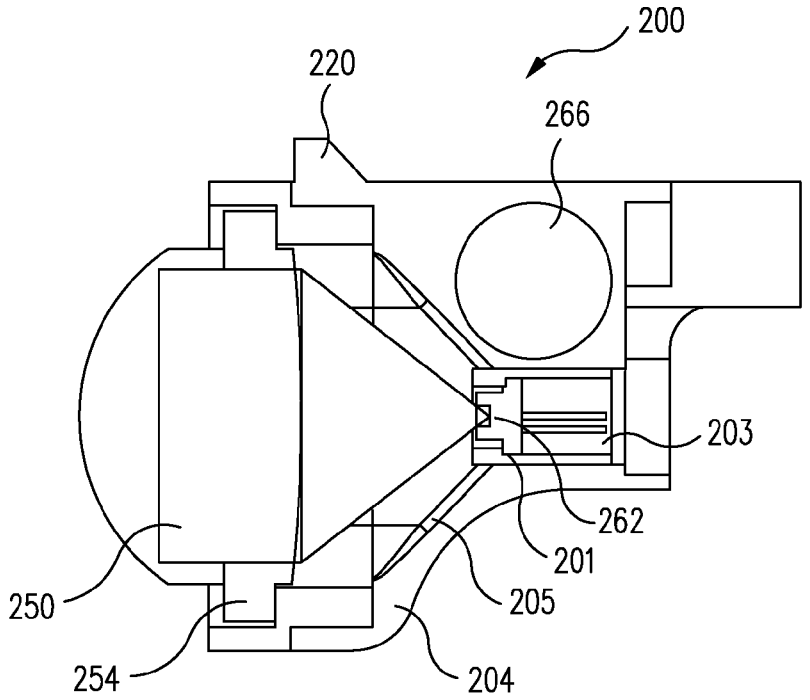
Figure 31:
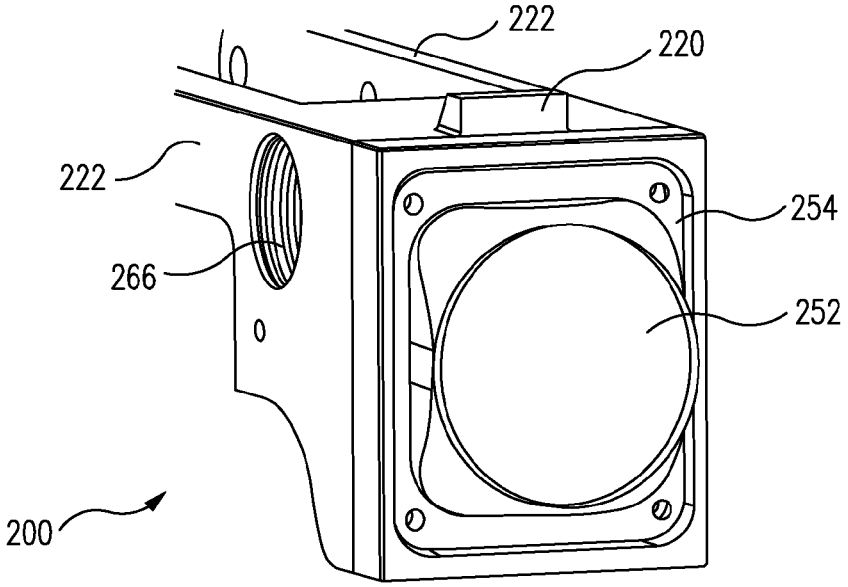

As illustrated in FIGS. 26 and 30, the LED point light source 262 of the sight 200 is disposed on a shoulder 201 of a cylindrical recess 203 that extends forwardly into a conical cavity 205 defined by the housing 204 to radiate rearwardly toward the lens 252 of the lens assembly 250 which is secured to the housing 204 by a perimeter surface 254. This arrangement permits the light source 262 to be more precisely located on the optical axis of the lens 252.

Figure 29:
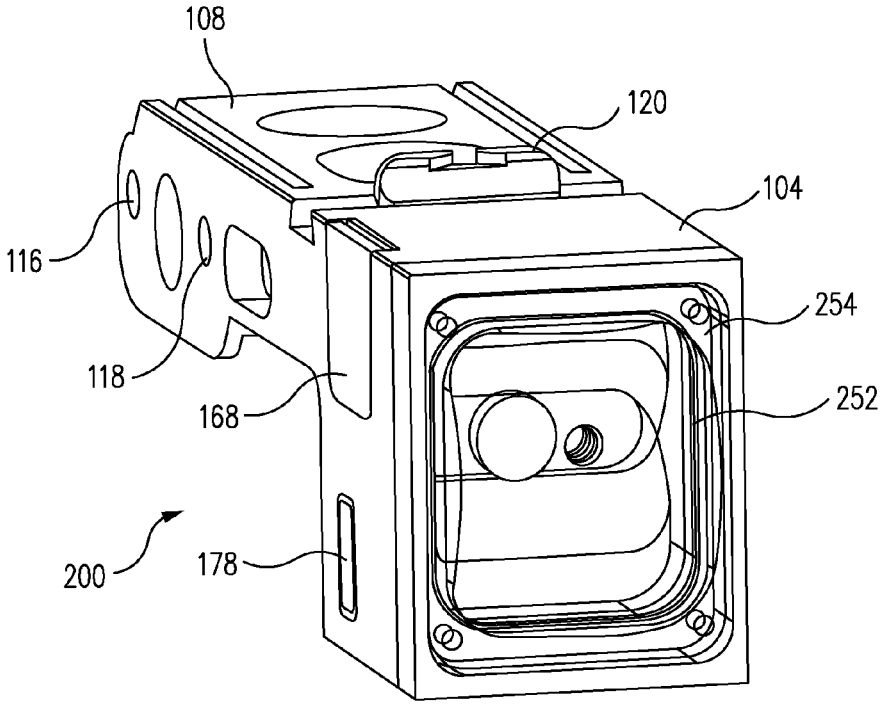

Light source 262 is powered by a small battery 264, such as a ⅓ N cell lithium or NiCad battery, contained in a cylindrical battery compartment 266 in the housing 204 and held therein by a small, threaded battery door 268 and a compression spring 270. As shown in FIG. 29, the particular optical implementation of sight 200 may be implemented in housing 104 of sight 100 if desired in one or more embodiments.

Figure 33:
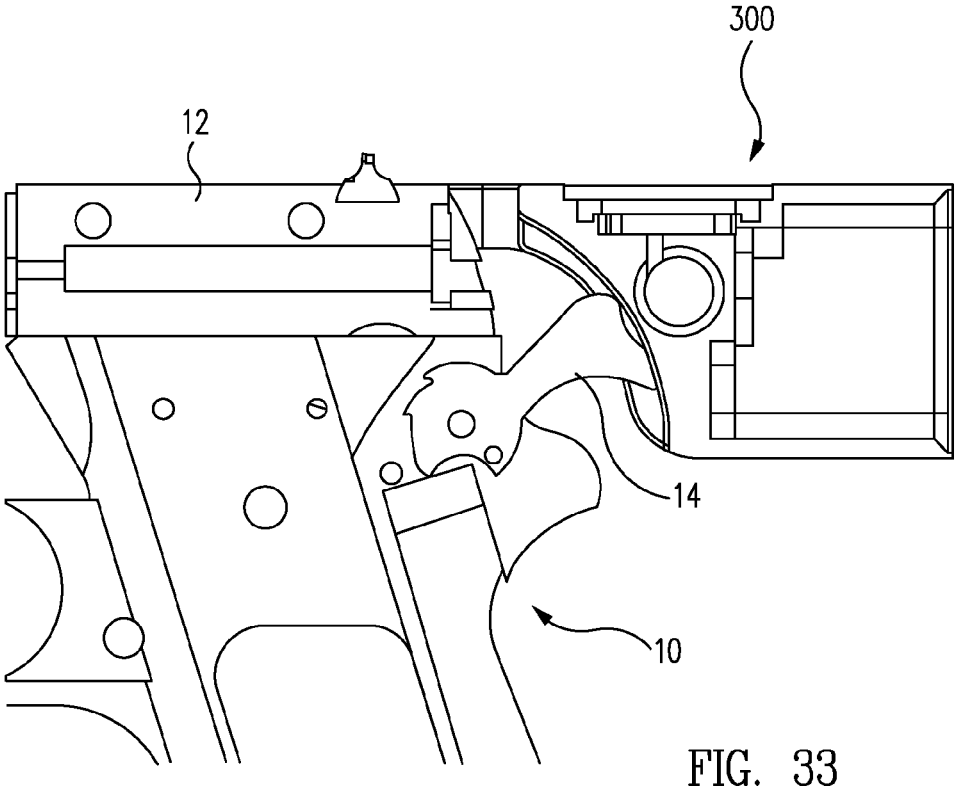
FIG. 33 illustrates an implementation of a gun sight which may be used with a pistol having a hammer in accordance with an embodiment of the invention.

Any of the guns sights described herein may be mounted on the slide 12 of an associated automatic pistol 10, e.g., a M1911 Colt/Browning automatic pistol. For example, as shown in FIG. 33, such pistols may incorporate an exposed hammer 14 located at the rear of the slide 12. A sight may mount at the rear of the slide 12 of the gun 10 so as to clear the hammer 14 as it moves in an arc from a fully cocked position, as illustrated in FIG. 33, to a fully forward position adjacent the rear end of the slide 12. The hammer 14 prevents mounting the sight directly to the rear face of the slide 12.

Figure 34:
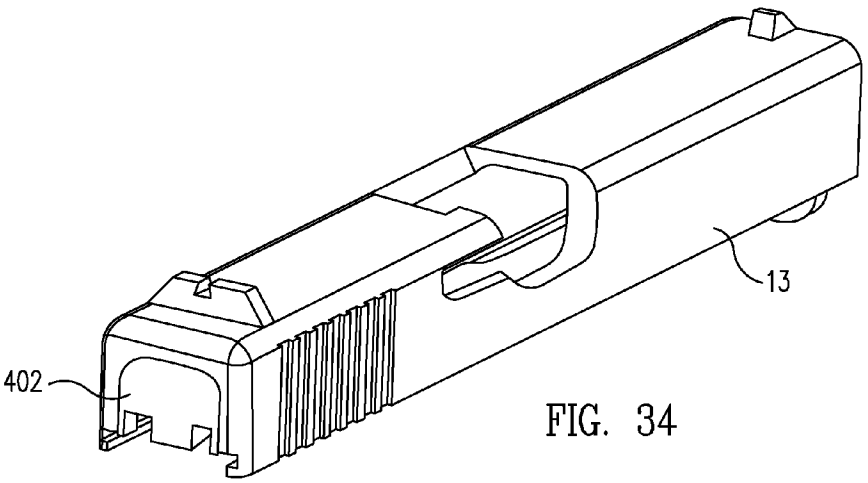
FIGS. 34-37 illustrate various implementations of gun sight which may be used with a hammerless or striker fired pistol in accordance with embodiments of the invention.

As will be appreciated, many firearms including many automatic and semi-automatic pistols do not have an external hammer 14, and instead, incorporate an internal mechanism for striking the firing pin of the weapon. These may be referred to as "hammerless" or "striker fired." As illustrated in FIGS. 34-37, any of the sights described herein may be adapted for use with such hammerless or striker fired pistols, and may be mounted directly to the rear face of the slide 13 in such cases. FIG. 34 illustrates the slide 13 of a hammerless automatic pistol. A removable flat plate at the rear of the slide 13 retains the firing pin. This plate may be replaced with an adapter plate 402 that facilitates attachment of the sight, such as a dovetail adapter plate. Various other structures may be used to attach the sight to a hammerless pistol in the desired location on axis with the barrel of the firearm such that it is aligned substantially co-axially with the longitudinal axis B (see FIG. 35) of the barrel of the weapon.

Figure 35:
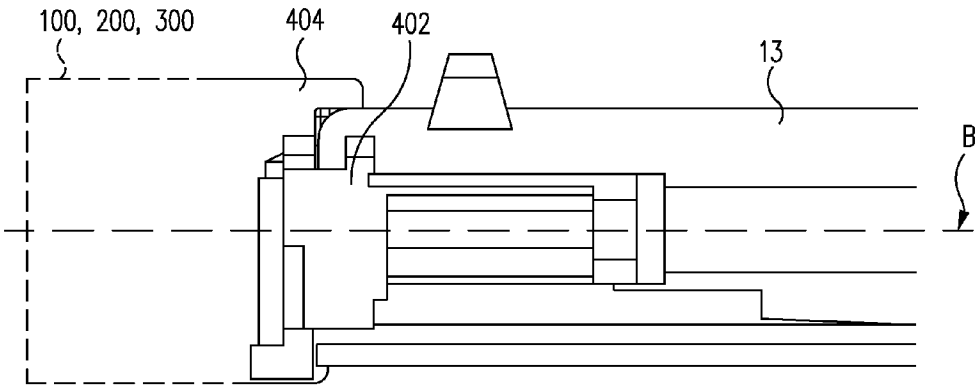
Figure 36:
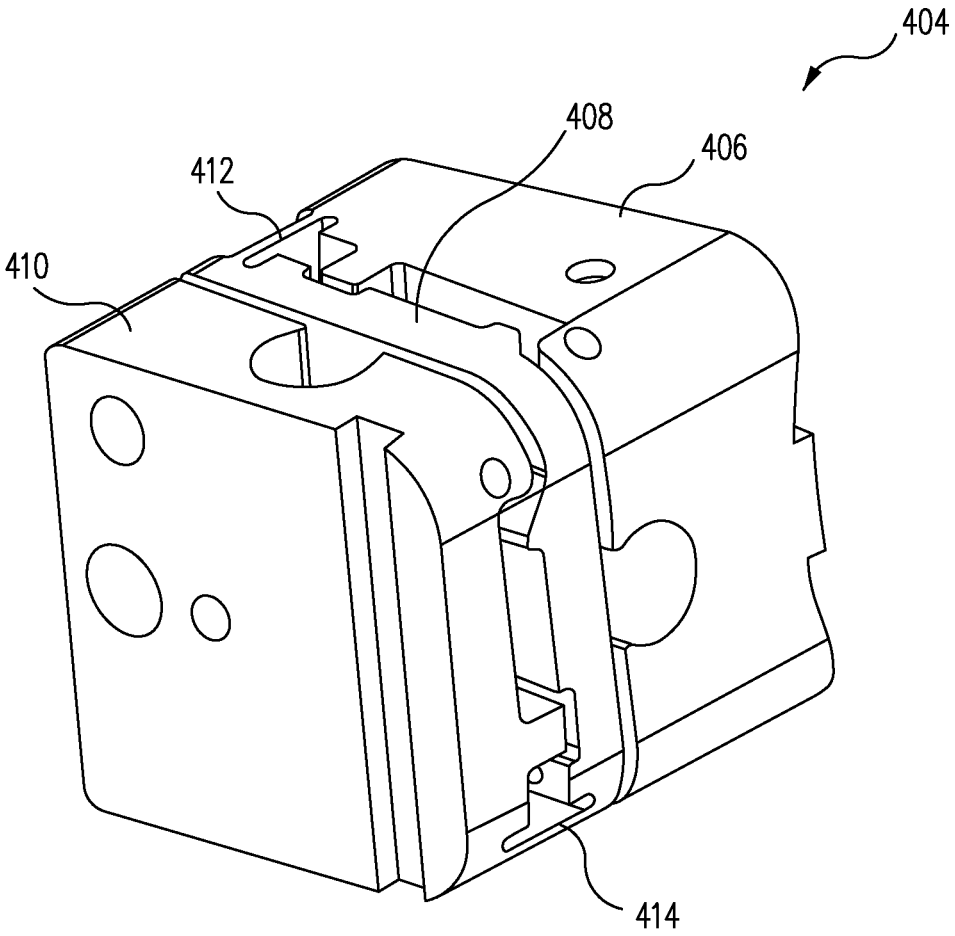

Various types of mechanisms may be used to provide for field adjustment where desirable. As illustrated in FIG. 35, in one embodiment a flexure 404 may be mounted to a back surface of the adapter plate 402, and the sight may be mounted to a back surface of the flexure 404. As illustrated in FIG. 36, the flexure 404 may comprise a block of a resilient material in one embodiment, e.g., a heat-treated steel alloy, that is machined or otherwise formed to incorporate the three leaves 406, 408, and 410 that are hinged relative to each other at respective edges disposed at approximately 90 degrees to each other.

Figure 37:
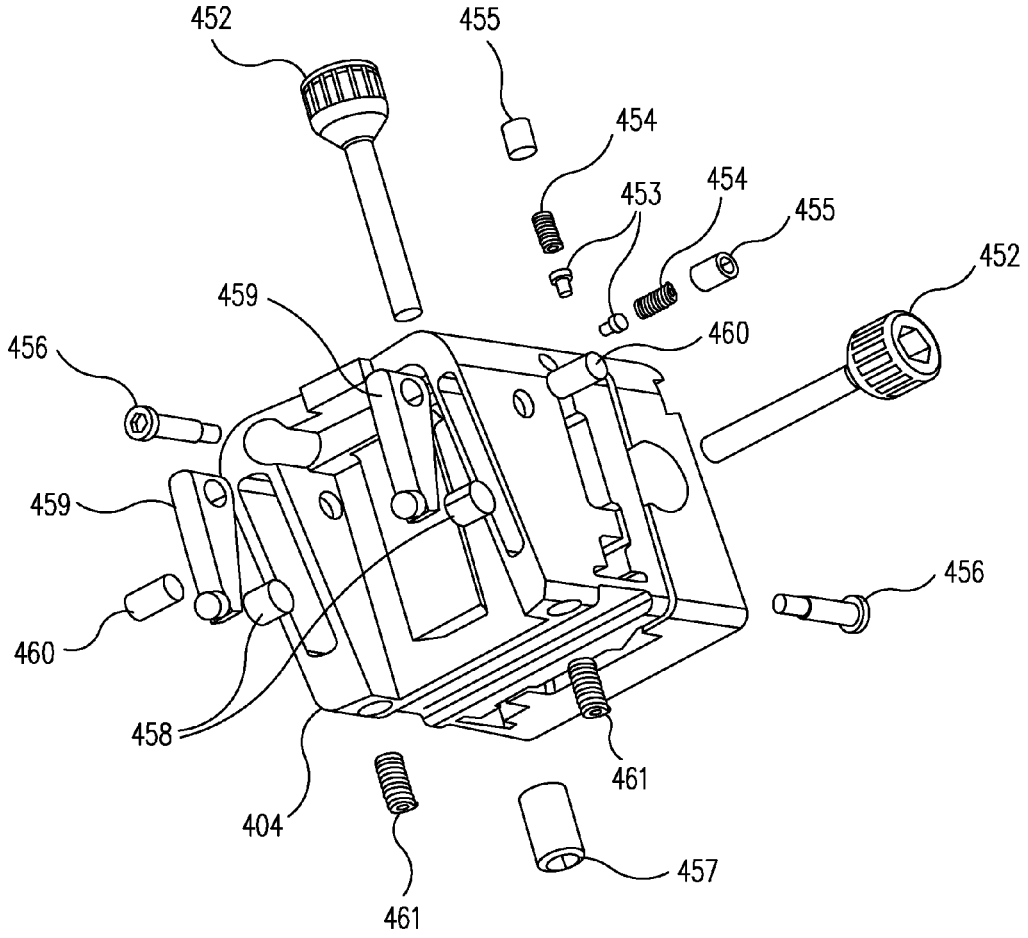

Thus, one leaf 406 is affixed to the back of the adapter plate 402, an intermediate leaf 408 is hinged horizontally at a solid hinge 412 relative to the first leaf 406 so as to provide azimuth adjustment, and a third leaf 410 is arranged to hinge vertically at a second solid hinge 414 relative to the intermediate leaf 408 so as to provide elevation adjustment. As illustrated in FIGS. 36 and 37, the flexure 404 may be assembled with adjustment screws 452, index plungers 453, pressure springs 454, set screws 455, over travel stops 456, adjustment locking nuts 457, securing wedges 458, securing clamps 459, dowel pins 460, and securing screws 461. Advantageously, adjustment screws 452 may permit the sight to be mounted to the rear surface of the third leaf 410 of the flexure 404 and then adjusted for both azimuth and elevation. It will be readily understood that a wide variety of other mechanisms may be used to provide for field adjustment of the sight. For example, systems using interchangeable prisms, cam mechanisms, spherical bearings, or T-blocks may be used to provide varying degrees of adjustability on the different axes.

With all sighting devices, including open reflex sights and OEGs, that use an illuminated dot that is viewed through an aperture, if the weapon is significantly out of alignment with the target or if the user's eye is too far out of alignment with the aperture the illuminated dot may not be visible to the user. This is a particular problem in very low light conditions where the user cannot see the firearm as it is brought into firing position, and thus lacks visual cues to bring the weapon into alignment.

It will be readily understood that the larger the aperture 353 the easier it will be for the user to align the sight with the user's dominant eye such that the collimated beam of light projected through the aperture can be seen by the user. Positioning the sight behind the slide of a pistol or the frame of a revolver allows for the largest possible aperture that will not interfere with balance and profile of the weapon. For example, an aperture that extends substantially the width of the slide of the pistol and vertically from the top of the slide down to the top of the user's hand maximizes the size of the aperture without interfering with use of the iron sights on the top of the slide and without a bulky projection from the top or side of the firearm.

In an exemplary embodiment of the invention, an indicator may be included in the gun sight to provide a visual cue to help the user obtain a general alignment of the firearm with the target. If the firearm is positioned such that the user cannot see the illuminated dot, an indicator dot in a different color than the illuminated dot may be provided. This indicator dot may be visible, for example, at an edge of the aperture of the gun sight, such that it indicates the direction the firearm needs to be moved to bring the user's eye into correct alignment to acquire the illuminated dot. For example, if the firearm is too low for the user to see the illuminated dot, the indicator dot may appear at the top edge of the aperture, indicating that the firearm needs to be raised higher to bring the sight into correct alignment with the user's eye.

It has long been understood that accurate and effective use of firearms, particularly in high-stress situations such as combat or tactical response, requires extensive training so that the user's develops sufficient muscle memory that their actions become unconscious. Unfortunately, firearms training is extremely expensive in large part because of the cost of ammunition and limited availability of training facilities such as shooting ranges where live ammunition or training blanks may be used. "Dry firing" is the firing of a firearm without either live ammunition or a training blank in the chamber. Dry fire training eliminates the cost of ammunition or blanks, can be conducted virtually anywhere, and allows trainees to conduct an unlimited number of repetitions of the movements involved in bringing their weapon to bear on a target in every conceivable scenario. Thus, there is a need for a gun sight that can be used as a "dry firing" training tool either on its own or as part of a complete firearms or tactical training system.

In one exemplary embodiment, a gun sight of any type may be equipped with a detector, such as an accelerometer (e.g., accelerometer 510), an audio detector or any other suitable device, that can detect the operation of the weapon's firing mechanism such as the fall of the hammer 14. If the detector is activated, when the user pulls the gun's trigger the detector will detect the operation of the firing mechanism, and cause some feedback (e.g., a visible, audible, tactile, or other type of indication) to be output to the user at the instant the weapon would fire if a round was chambered. For example, in one embodiment, a sensor such as accelerometer 510 may provide one or more signals to microcontroller 502 in response to operation of the firing mechanism. In response to the one or more signals, microcontroller 502 may cause appropriate components of the gun sight to provide the feedback.

The feedback provided to the user could take many forms. In one exemplary embodiment, the illuminated dot 192 of the gun sight may increase in brightness for an instant to indicate to the user that a shot has been fired. When the illuminated dot 192 flashes, the user's brain registers the location of the dot 192 relative to the aim point 190 at the instant the trigger is pulled. This allows the user to see where the gun was aimed at the instant the weapon would have fired. In another exemplary embodiment, the illuminated dot 192 briefly changes color at the instant the weapon was fired. Persons of ordinary skill in the art will understand that a wide variety of audio, visual, or tactile indicators may be used to indicate to the user the instant that the weapon would have fired if ammunition was being used. In one exemplary embodiment, data regarding the location, orientation, movement, and aim point relative to a target can be collected by sensors located on the weapon or in the target field at the instant of firing. This data can then be analyzed to determine the accuracy of the dry fire shots.

Such a system allows users to train effectively by dramatically increasing the number of times they bring their weapon to bear on a target, while providing immediate feedback to the user regarding their accuracy. Regular use of this dry firing technique may greatly improve the user's marksmanship without having to expend ammunition or to train at a secure practice range. This dry fire training technique also allows users to train under more realistic conditions because it allows the user to target any object that may be a threat. For combat and law enforcement training, the ability to conduct firearms training in which the user is targeting a live human being is particularly important to realistically simulate conditions that may be encountered in the field and train users to overcome their natural resistance to targeting a human being.

As those of skill in the art will appreciate, the gun sights described herein provide a number of distinct advantages, relative to the various gun sights of the prior art. Unlike prior art OEGs and open reflex sights, the conventional open sights on the firearm are not obscured and the balance of the weapon is not altered significantly. The inventive gun sights provide for fast target acquisition in combat situations while allowing the user to maintain a wide field of view, avoid tunnel vision, and maintain situational awareness. Because of their positioning and low sight profile, the gun sights disclosed herein may be used with regular pistol holsters and may be used for concealed carry.

Additional embodiments are also provided. For example, in some embodiments, a gun sight may be positioned behind the barrel of a gun and configured to provide a reticle in a user-viewable interface superimposed over a target field. In additional embodiments, a gun sight may be implemented with an optical element having surfaces configured to refract light at peripheral portions of a user-viewable interface to aid the user in aligning the user's eye with a reticle provided by the gun sight.

In additional embodiments, a gun sight may be implemented with alignment members having tapered surfaces configured to rotate relative to each other to adjust the alignment of the gun sight relative to a longitudinal axis of a barrel of a gun.

In additional embodiments, a gun sight may be implemented with an alignment system using one or more springs and more or more user operable screws to adjust the alignment of the gun sight relative to a longitudinal axis of a barrel of a gun.

In additional embodiments, a gun sight may be implemented with various attachment mechanisms, such as various mounting members that may be attached to retaining members secured to guns. For example, a wedge attachment mechanism may be used to releasably attach the gun sight behind a barrel of a gun. As another example, a rotary attachment mechanism may be used to releasably attach the gun sight behind a barrel of a gun. Other attachment mechanisms are also provided.

These and other embodiments are further described herein. Moreover, any of such embodiments may be combined with each other and/or with other embodiments previously described herein as desired to implement gun sights with any of the various features described herein.

Figure 40A:
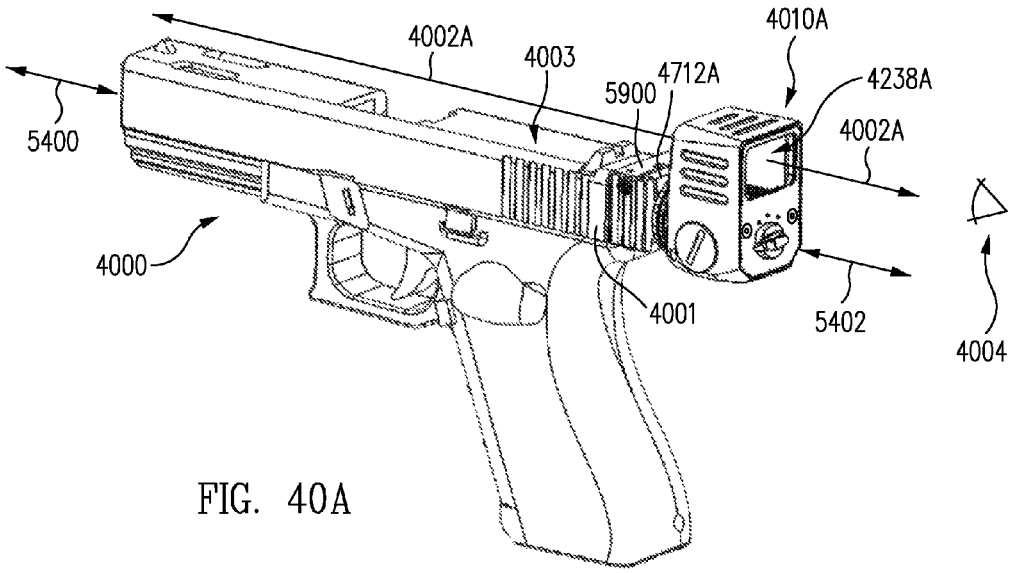
FIGS. 40A-B illustrate various mountings of a gun sight on a gun in accordance with embodiments of the invention.
Figure 40B:
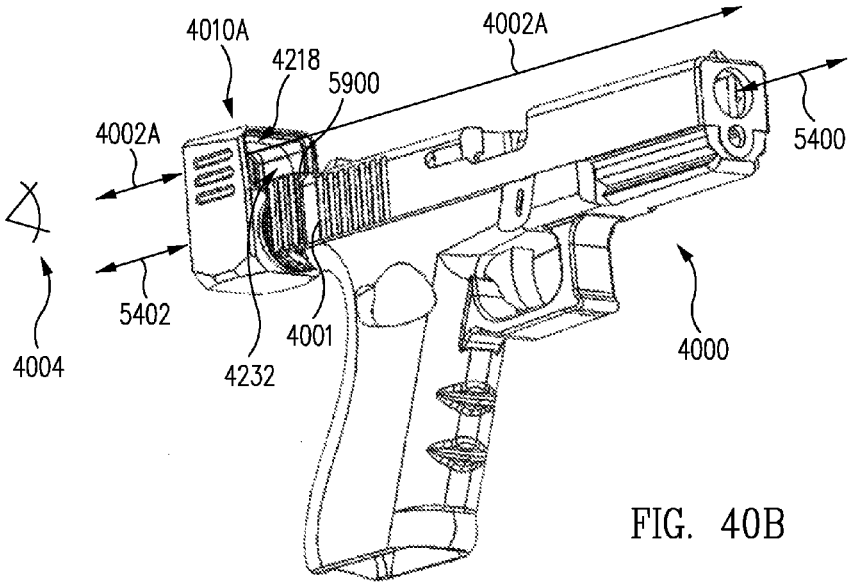

FIGS. 40A-B illustrate various mountings of a gun sight 4010A on a gun 4000 in accordance with embodiments of the invention. Gun sight 4010A is positioned behind the barrel of gun 4000 and mounted substantially along an axis 5402. The orientation of gun sight mounting axis 5402 may be adjusted relative to a longitudinal axis 5400 of a barrel of gun 4000 in response to the rotation of one or more alignment members 4214 and 4216. In FIGS. 40A-B (and also in FIGS. 43A-B further described herein), gun 4000 is illustrated as a Glock pistol, however other types of handguns, firearms, and/or other weapons may be used.

Gun sight 4010A is implemented as a reflex sight providing a user-viewable interface at a rear window 4238A where a user (e.g., a user's eye 4004) may view a target field and a reticle (e.g., such as an illuminated dot 192 appearing as a luminous disk and/or any other type of reticle described herein or otherwise as appropriate) superimposed thereon. In some embodiments, the user-viewable interface may be provided by optical element 4232 and/or other components without window 4238A. Light from a target field may enter a front window 4218, pass through an optical element 4232, and pass through rear window 4238A for viewing by the user. A light source 4231 (e.g., any type of light source, such as those described herein, see FIG. 42B) may project light through optical element 4232 (see FIG. 47) to provide the reticle as a collimated beam at rear window 4238A for viewing by the user along an axis 4002A. Thus, the reticle may be used to aim gun 4000 relative to a target field.

Figure 41A:
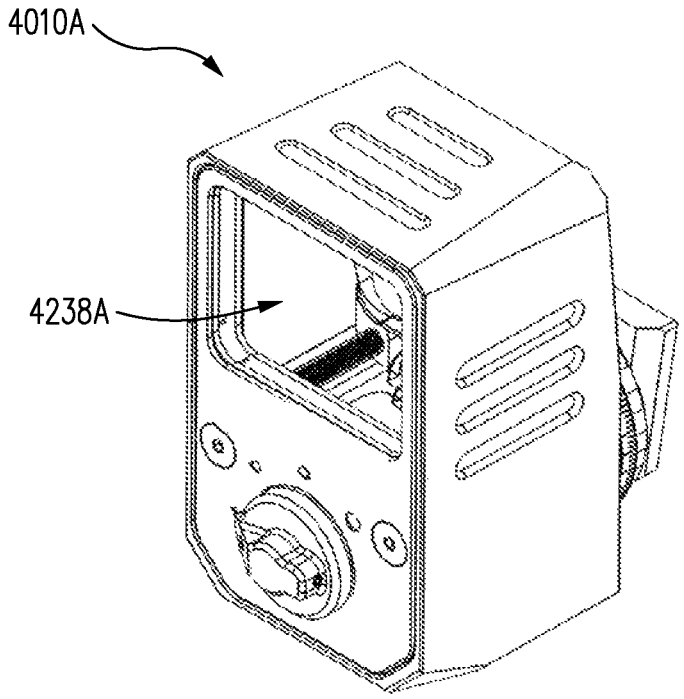
FIGS. 41A-B illustrate isometric views of a gun sight in accordance with embodiments of the invention.
Figure 41B:
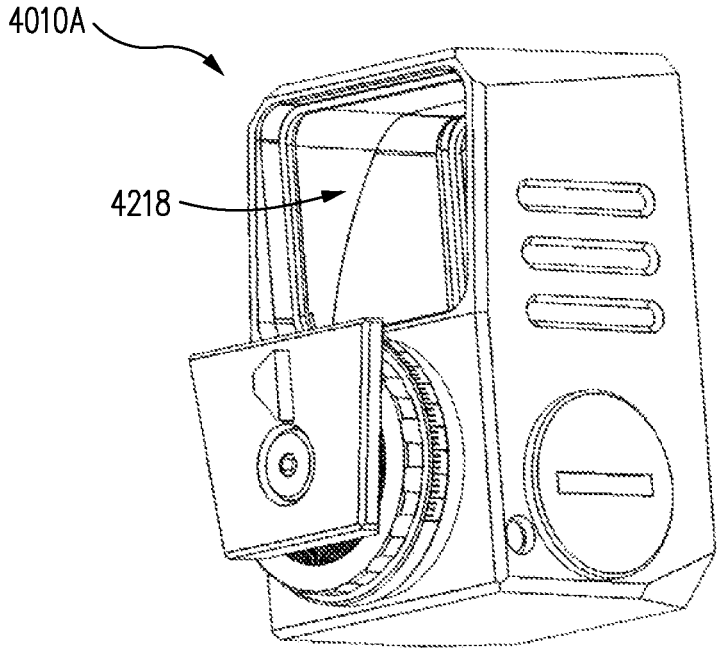
Figure 42A:
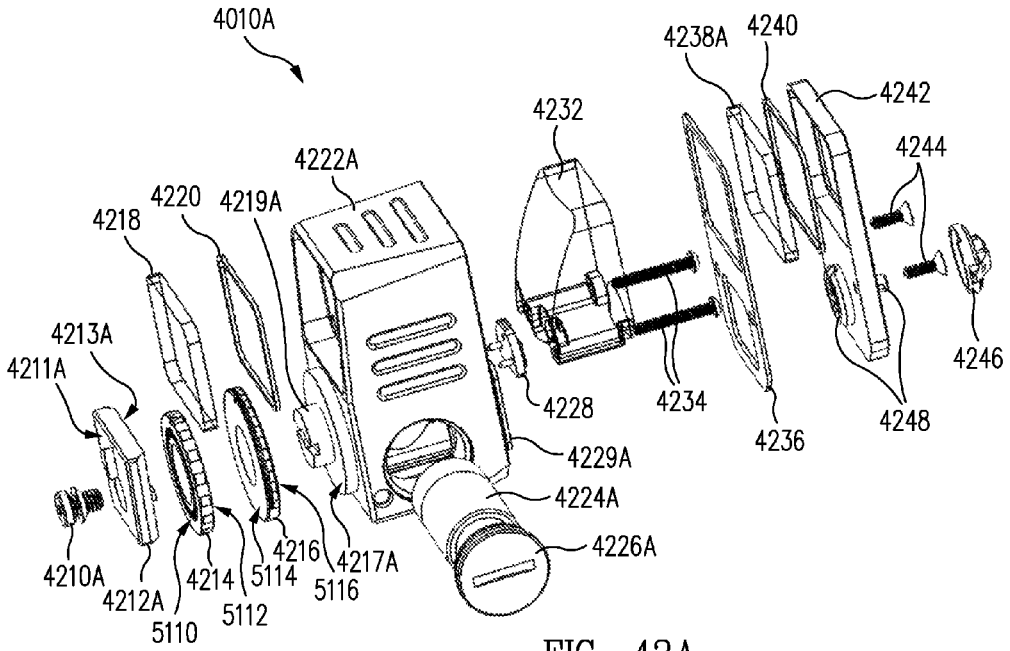
FIGS. 42A-B illustrate exploded views of a gun sight in accordance with embodiments of the invention.
Figure 42B:
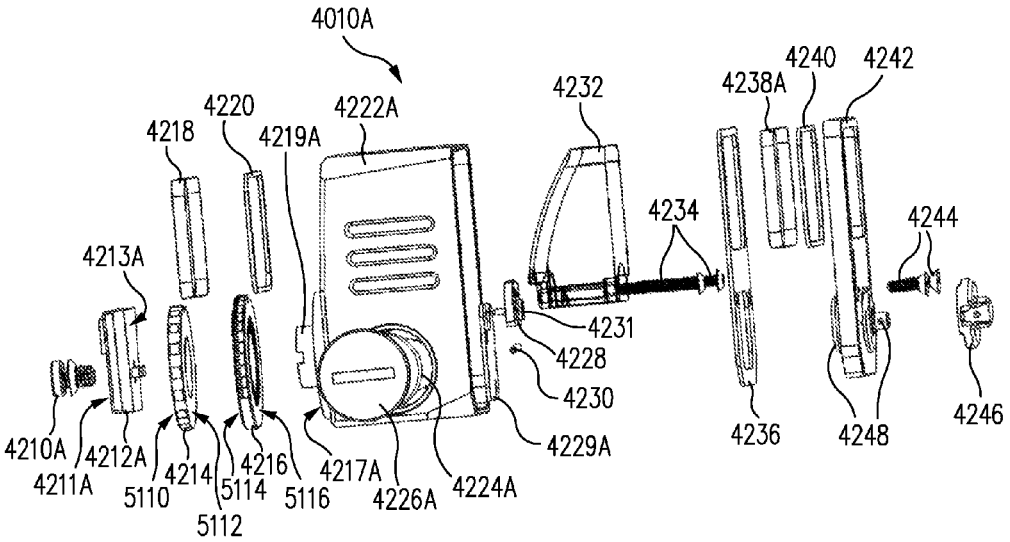

FIGS. 41A-B illustrate isometric views of gun sight 4010A in accordance with embodiments of the invention, and FIGS. 42A-B illustrate exploded views of gun sight 4010A in accordance with embodiments of the invention. Gun sight 4010A includes a housing 4222A configured to receive various components. Optical element 4232 is secured within housing 4222A by screws 4234. A circuit board 4228 is affixed to a circuit board 4229A and includes light source 4231 to project light for the reticle into optical element 4232. A battery 4224A provides power to circuitry of gun sight 4010A and is secured within housing 4222A by a cover 4226A. Front window 4218 and a spacer 4220 are positioned in an aperture in a front portion of housing 4222A.

A rear cover 4242 is secured to housing 4222A on top of a gasket 4236 by screws 4244. A user-operable knob 4246, loaded by a spring 4230, actuates a switch 4248 (e.g., an implementation of a user control) to selectively operate light source 4231 and/or other features of gun sight 4010A. For example, in some embodiments, switch 4248 may be rotated to adjust the intensity of light provided by light source 4231 (e.g., having two or more light intensity levels) and/or control the operation of any of the various other features described herein. Rear window 4238A and a spacer 4240 are positioned in an aperture in rear cover 4242.

A wedge mounting member 4212A, having front and rear surfaces 4211A and 4213A, is used to releasably attach gun sight 4010A to a wedge retaining member 5900 mounted behind the barrel of gun 4000. For example, in some embodiments, wedge retaining member 5900 may be mounted to a slide 4001 of gun 4000. Wedge mounting member 4212A is secured to housing 4222A by a screw 4210A.

Alignment members 4214 and 4216 are installed around a cylindrical protrusion 4219A of housing 4222A, and positioned between a front surface 4217A of housing 4222A and rear surface 4213A of wedge mounting member 4212A. One or more substantially flat surfaces 5110, 5112, 5114, and/or 5116 of alignment members 4214/4216 may be tapered (e.g., inclined) to permit gun sight 4222A to be selectively adjusted relative to gun 4000 by rotation of one or both of alignment members 4214/4216 as further described herein. In particular, rotation of alignment members 4214/4216 may change the orientation of axis 5402 relative to longitudinal axis 5400 of the barrel of gun 4000 in order to accurately sight gun sight 4010A on gun 4000.

Figure 43A:
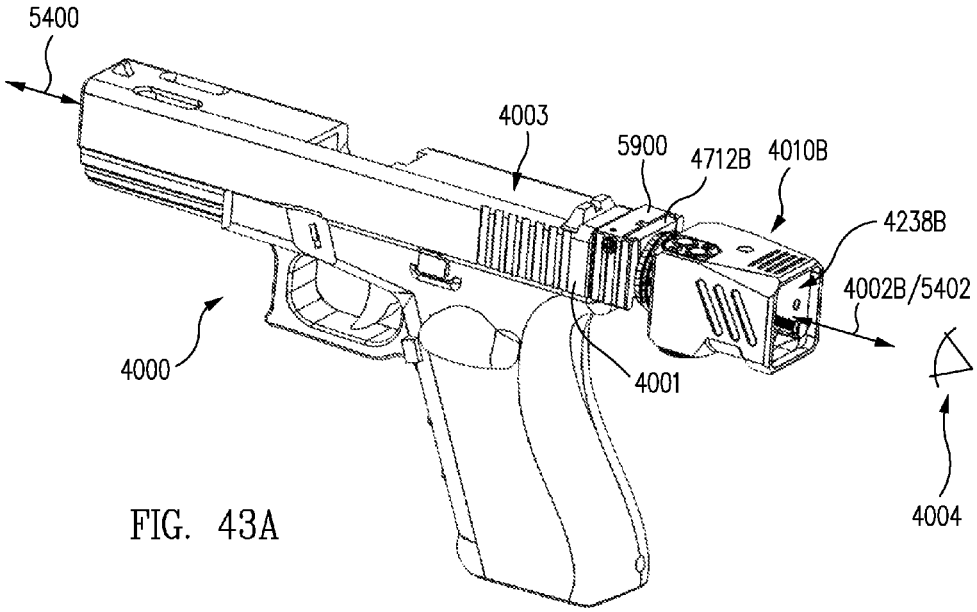
FIGS. 43A-B illustrate various mountings of a gun sight on a gun in accordance with embodiments of the invention.
Figure 43B:
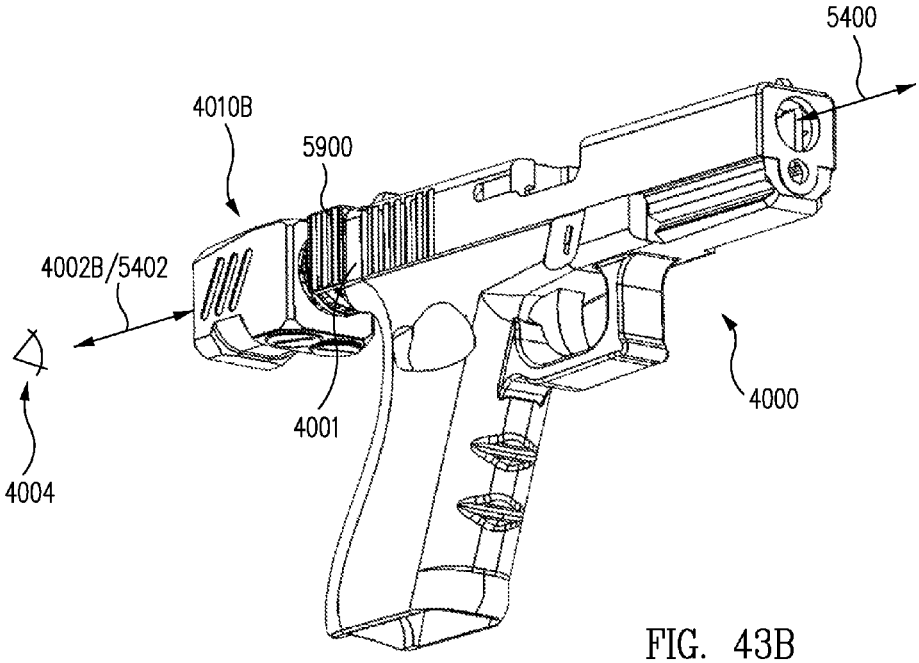

FIGS. 43A-B illustrate various mountings of a gun sight 4010B on gun 4000 in accordance with embodiments of the invention. Similar to gun sight 4010A, gun sight 4010B is positioned behind the barrel of gun 4000 and mounted substantially along axis 5402 that may be adjusted relative to longitudinal axis 5400 of the barrel of gun 4000 in response to the rotation of one or more alignment members 4214 and 4216. In FIGS. 43A-B, axes 5400 and 5402 are aligned with each other.

Figure 45A:
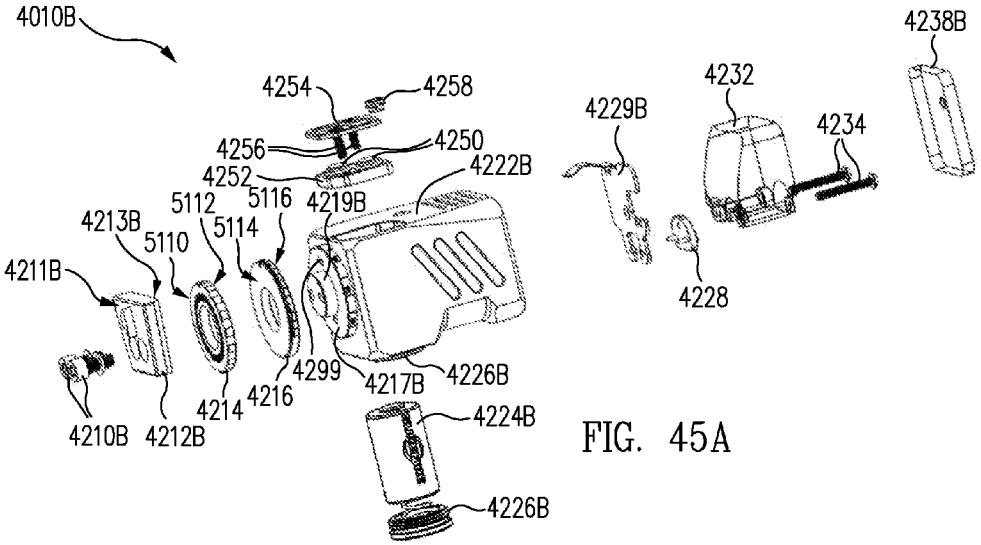
FIGS. 45A-B illustrate exploded views of a gun sight in accordance with embodiments of the invention.
Figure 45B:
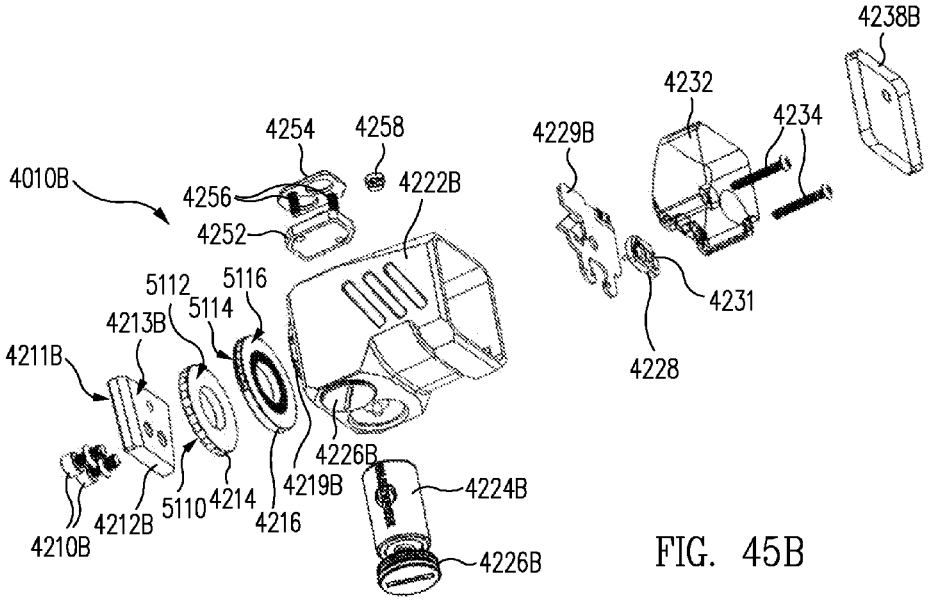

Gun sight 4010B includes light source 4231 (e.g., any type of light source, such as those described herein, see FIG. 45B) that projects light through optical element 4232 (see FIG. 47) to provide a reticle as a collimated beam at a rear window 4238B for viewing by the user along an axis 4002B, which is aligned with axes 5400 and 5402 in FIGS. 43A-B. Gun sight 4010B is implemented as an occluded sight. As similarly described for OEG 100 with regard to FIGS. 1-2, the user's first eye (not shown) may view the target field. The user's second eye 4004 may view a reticle (e.g., any type of reticle described herein or otherwise as appropriate) provided by gun sight 4010B while the target field is substantially occluded (e.g., blocked) by gun sight 4010B and/or gun 4000, when viewed from the perspective of the user's second eye 4004.

The two different images seen by the user's first eye and second eye 4004 are then superimposed by the user's brain, such that when gun sight 4010B is properly positioned relative to the target field, the user "sees" the reticle superimposed onto the target field. Thus, the reticle may be used to aim gun 4000 relative to the target field.

Figure 44A:
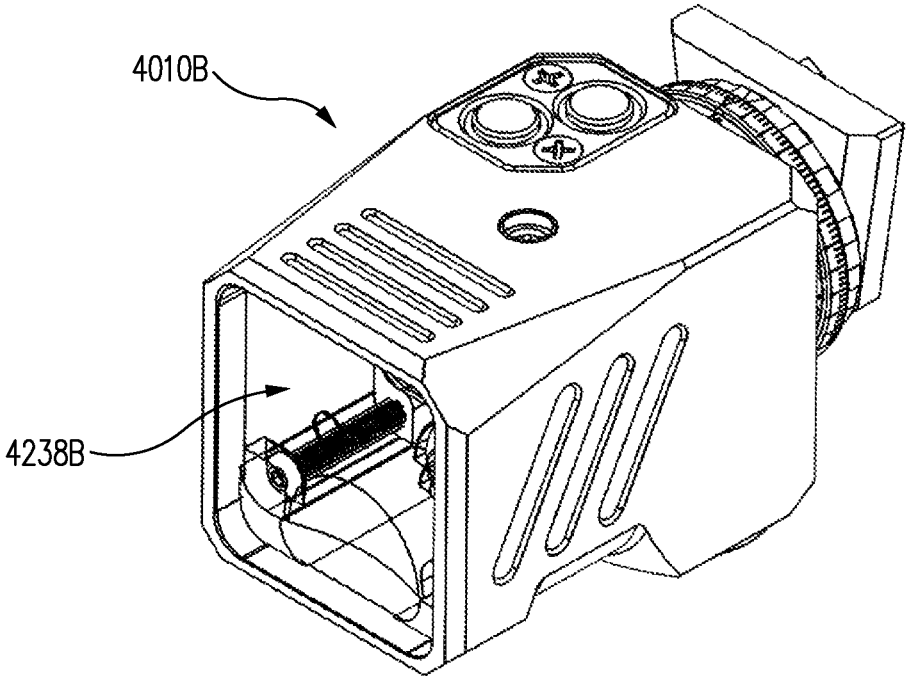
FIGS. 44A-B illustrate isometric views of a gun sight in accordance with embodiments of the invention.
Figure 44B:
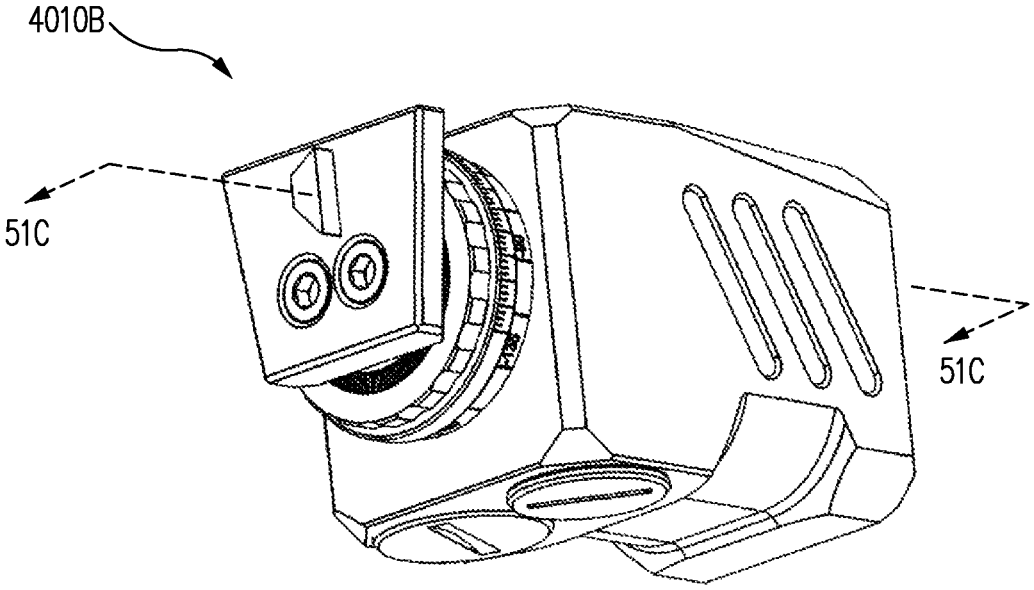

FIGS. 44A-B illustrate isometric views of gun sight 4010B in accordance with embodiments of the invention, and FIGS. 45A-B illustrate exploded views of gun sight 4010B in accordance with embodiments of the invention. As shown, gun sight 4010B includes a housing 4222B configured to receive various components. Optical element 4232 is secured within housing 4222B by screws 4234. Circuit board 4228 is affixed to a circuit board 4229B and includes light source 4231 to project light for the reticle into optical element 4232. Batteries 4224B (e.g., one illustrated and one already installed in housing 4222B) provide power to circuitry of gun sight 4010B and are secured within housing 4222B by covers 4226B. In some embodiments, multiple batteries 4224B may be replaced by a single battery.

User-operable switches 4250 (e.g., implementations of user controls such as switch contacts 518A-B and/or others) are provided on a circuit board 4252 to selectively operate light source 4231 and/or other features of gun sight 4010B. For example, in some embodiments, switches 4250 may be operated to adjust the intensity of light provided by light source 4231 (e.g., having two or more light intensity levels) and/or control the operation of any of the various other features described herein. A switch cover 4254 is secured to circuit board 4252 by screws 4256. In some embodiments, switches 4250 and related components may be used in place of knobs 4246/4246C and related components in gun sights 4010A/C, and vice versa. A window 4258 is also provided on a top surface of housing 4222B. Rear window 4238B is positioned in an aperture in housing 4222B.

A wedge mounting member 4212B is implemented in a similar manner as wedge mounting member 4212A and operates to releasably attach gun sight 4010B to wedge retaining member 5900 behind the barrel of gun 4000 (e.g., wedge retaining member 5900 may be mounted to slide 4001 of gun 4000). Wedge mounting member 4212B includes apertures for two screws 4210B to secure it to housing 4222B. As shown, wedge mounting member 4212B includes front and rear surfaces 4211B and 4213B.

Similar to gun sight 4010A, alignment members 4214 and 4216 are installed around a cylindrical protrusion 4219B of housing 4222B, and positioned between a front surface 4217B of housing 4222B and rear surface 4213B of wedge mounting member 4212A. Similar to gun sight 4010A, one or more surfaces 5110, 5112, 5114, and/or 5116 of alignment members 4214/4216 may be tapered to permit gun sight 4222B to be selectively adjusted relative to gun 4000 by rotation of one or both of alignment members 4214/4216 as further described herein. In particular, rotation of alignment members 4214/4216 may change the orientation of axis 5402 relative to longitudinal axis 5400 of the barrel of gun 4000 in order to accurately sight gun sight 4010B on gun 4000. Front surface 4217B includes a recess 4299 configured to receive a pin 5162 and a spring 5166 (see FIG. 51C) as further described herein.

FIGS. 46A-H illustrate various views of optical element 4232 in accordance with embodiments of the invention. In some embodiments, optical element 4232 may be manufactured from an appropriate light transmissive material, such as plastic, acrylic, glass, and/or other materials that may pass light emitted from light source 4231 (e.g., when implemented in a reflex sight such as gun sight 4010A or an occluded sight such as gun sights 4010B-C) and/or light received from a target field (e.g., when implemented in a reflex sight such as gun sight 4010A).

Optical element 4232 includes non-uniform external surfaces 4602 (e.g., substantially peripheral external surfaces in some embodiments) at several peripheral portions (e.g., peripheral areas) next to a substantially uniform external surface 4604 (e.g., a substantially central external surface in some embodiments. Non-uniform surfaces 4602 may surround one or more sides of surface 4604 in some embodiments). Non-uniform surfaces 4602 may be implemented as surfaces that refract light passing therethrough in a manner different from light passing through surface 4604. In some embodiments, surfaces 4602 may be machined (e.g., and/or otherwise formed to provide roughened surfaces (e.g., including a plurality of peaks and valleys, chamfers, and/or appropriate non-uniformities in some embodiments) such that light passing therethrough is refracted such that it is not substantially parallel to other light passing through surface 4604. As a result, light passing through surfaces 4602 may be redirected in comparison with light passing through surface 4604. For example, the refraction of light passing through surfaces 4602 may cause such light to be viewable by the user over a wider field of view (e.g., over a wider angle) in comparison with light passing through surface 4604. In some embodiments, such refracted light may be directed outward (e.g., away from) light passing through surface 4604.

The presence of surfaces 4602 on optical element 4232 permit the user to rapidly and conveniently reposition of his eye 4004 relative to gun sight 4010A-C and/or reposition gun sight 4010A-C based on the appearance of refracted light that provide one or more guides to aid the user in such repositioning. As a result, the user may locate the reticle in a rapid, reliable manner to aim gun 4000.

Optical element 4232 includes a surface 4610 which, in some embodiments, may be implemented with a reflective layer (e.g., coating) to reflect light in one or more wavebands corresponding to light received from light source 4231. Optical element 4232 includes a surface 4606 which, in some embodiments, may be implemented with a reflective layer (e.g., coating) to reflect light in one or more wavebands corresponding to light received from light source 4231. In some embodiments, the coating on surface 4606 may be selected to substantially pass light in one or more wavebands corresponding to light received from a target field and substantially reflect light received from light source 4231 (e.g., when implemented in a reflex sight such as gun sight 4010A).

Figure 46A:
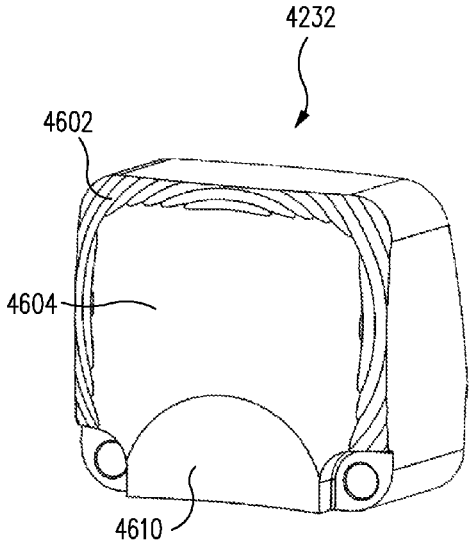
FIGS. 46A-H illustrate various views of an optical element of a gun sight in accordance with embodiments of the invention.
Figure 46B:
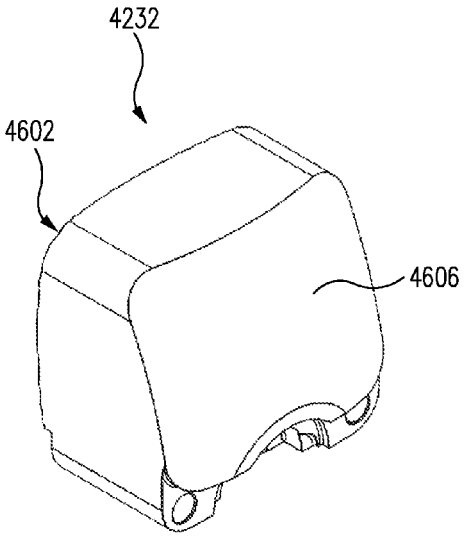
Figure 46C:
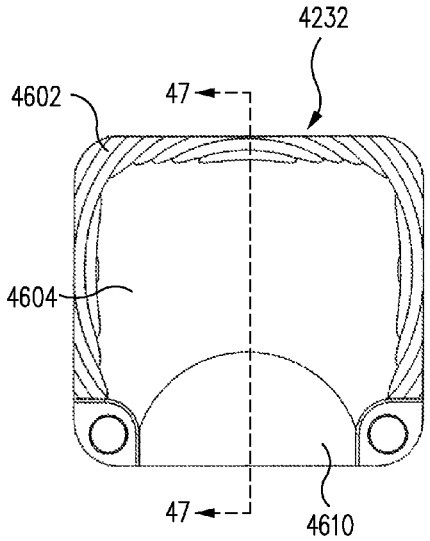
Figure 46D:
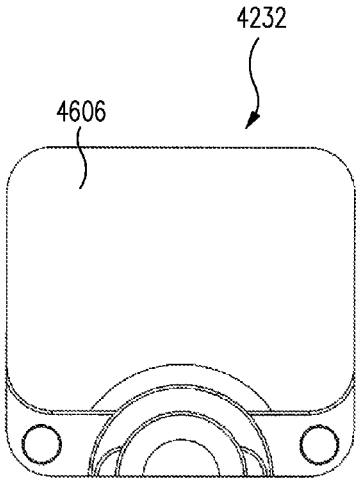
Figure 46E:
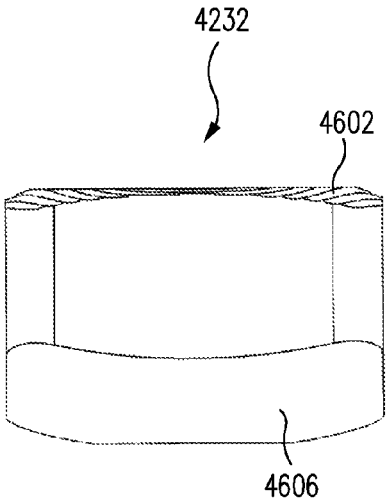
Figure 46F:
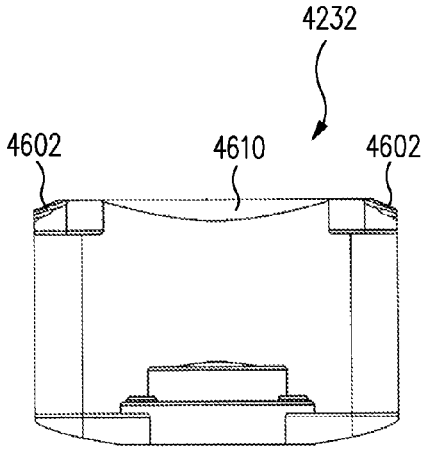
Figure 46G:
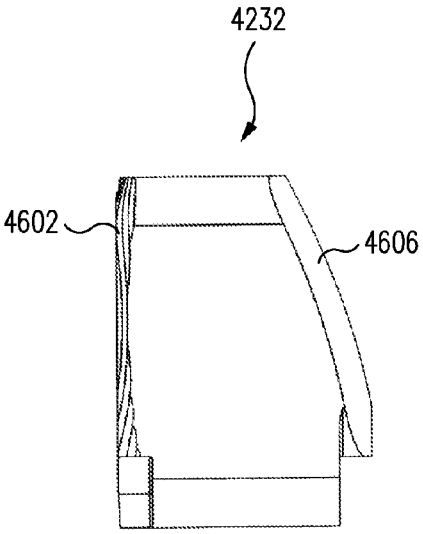
Figure 46H:
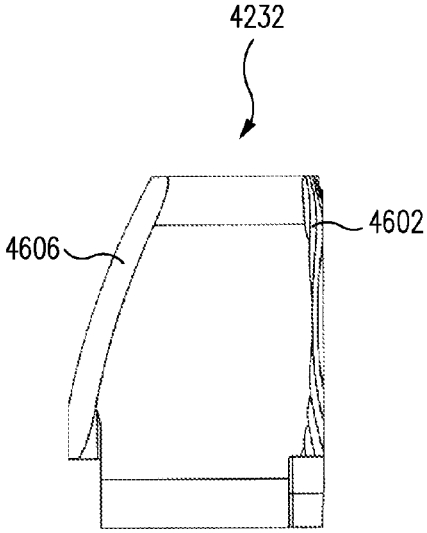
Figure 47:
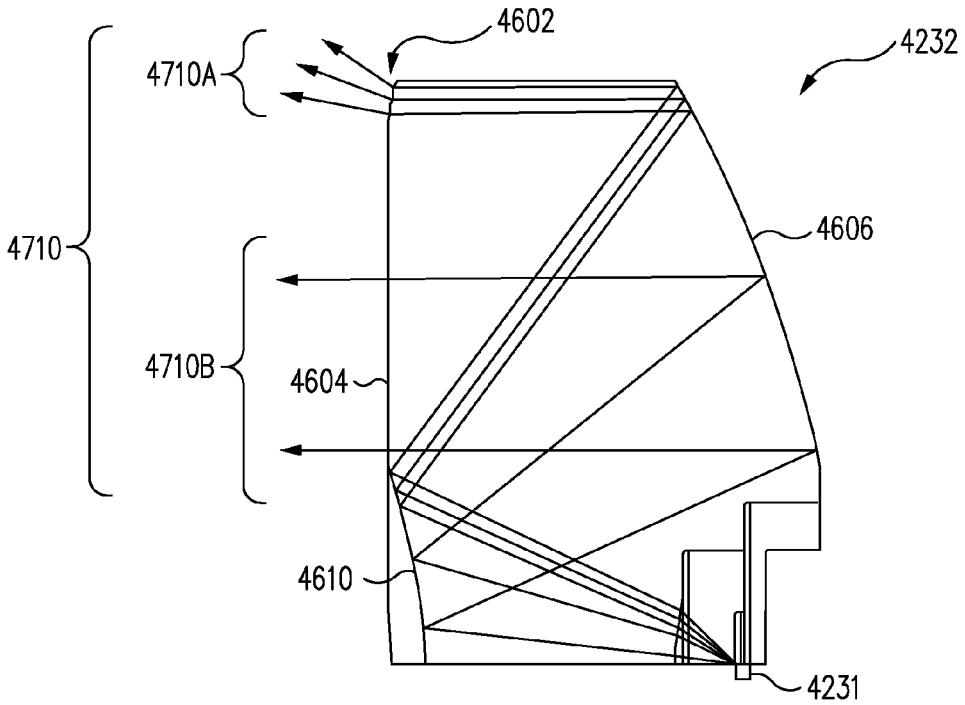
FIG. 47 illustrates a cross-sectional view through the optical element of FIG. 46C as seen along the lines of the section 47-47 taken therein in accordance with an embodiment of the invention.

FIG. 47 illustrates a cross-sectional view through optical element 4232 of FIG. 46C as seen along the lines of the section 47-47 taken therein in accordance with an embodiment of the invention. Light source 4231 emits light 4710 (e.g., illustrated as light rays) into optical element 4232 toward surface 4610. The reflective coating on surface 4610 causes light 4710 to reflect toward surface 4606. The reflective coating on surface 4606 causes light 4710 to reflect toward surfaces 4602 and 4604.

Light 4710B directed toward surface 4604 is substantially normal to surface 4604 and therefore passes substantially straight through surface 4604 toward the user to provide a reticle for viewing by the user substantially along axis 4002A-C. In contrast, light 4710A directed toward surface 4602 encounters the various non-uniformities in surface 4602. These non-uniformities cause light 4710A to pass from optical element 4232 at various oblique angles, depending on the shapes of individual non-uniformities. As a result, light 4710A will exhibit various indexes of refraction depending on the particular shapes of individual non-uniformities defining the interface between surface 4602 of optical element 4232 and the environment. These indexes of refraction cause light 4710A to be redirected in a manner that is not parallel to light 4710B as shown in FIG. 47.

Figure 48:
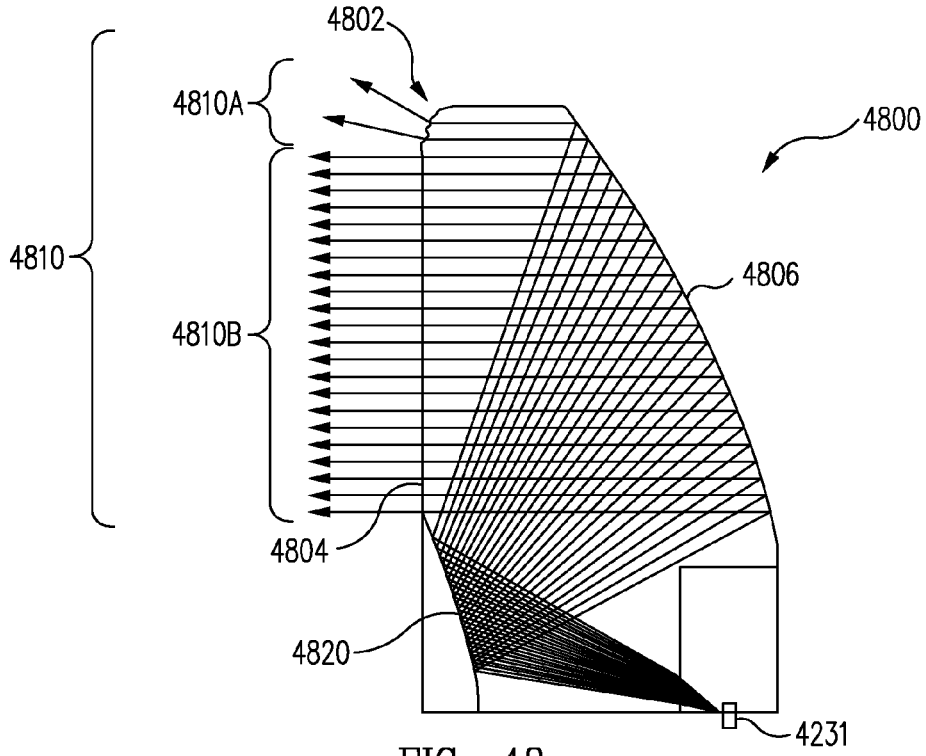
FIG. 48 illustrates a cross-sectional view through another optical element in accordance with an embodiment of the invention.

FIG. 48 illustrates a cross-sectional view through another optical element 4800 in accordance with an embodiment of the invention. Optical element 4800 may be implemented in a similar manner as optical element 4232, but with a different shape and corresponding different dimensions and focal length.

Similar to optical element 4232, light source 4231 emits light 4810 (e.g., illustrated as light rays) into optical element 4800 toward surface 4820. A reflective coating on surface 4820 causes light 4810 to reflect toward surface 4806. A reflective coating on surface 4806 causes light 4810 to reflect toward surfaces 4802 (e.g., one or more substantially peripheral external surfaces in some embodiments) and surface 4804 (e.g., a substantially central external surface in some embodiments. Light 4810A is redirected by surface 4802 (e.g., implemented with non-uniformities in the manner described for surface 4602 of optical element 4232).

Other embodiments and implementations of surfaces 4602/4802 are also contemplated. For example, although surfaces 4602/4802 are illustrated in FIGS. 47-48 as being recessed in relation to surfaces 4604/4804 (e.g., positioned further away from the user than surface 4604/4804), surfaces 4602/4802 may extend forward of surface 4604/4804 in other embodiments (e.g., positioned closer to the user than surface 4604/4804).

Figure 49A:
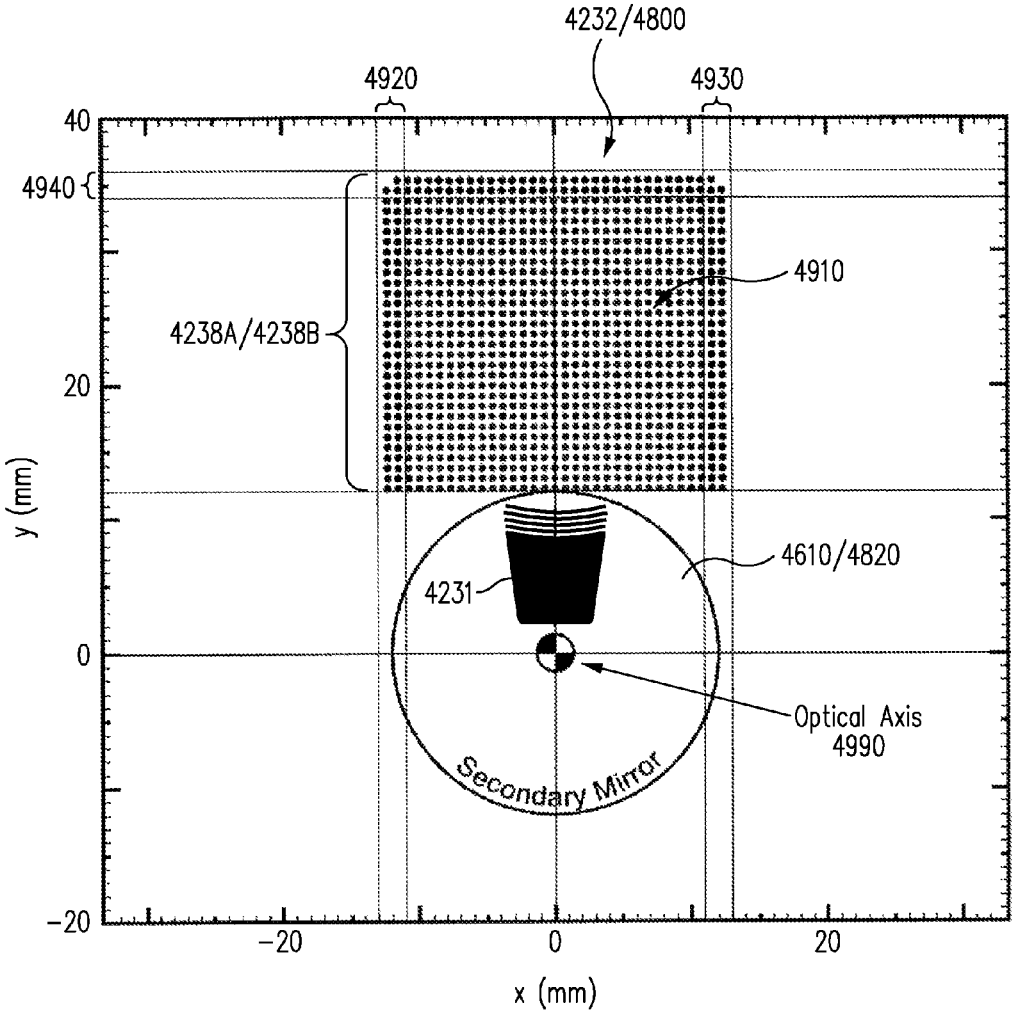
FIG. 49A illustrates a user's view of a window of a gun sight in accordance with an embodiment of the invention.

FIG. 49A illustrates a user's view of window 4238A-C of gun sights 4010A-C from a perspective near axis 4002A-C in accordance with an embodiment of the invention. FIG. 49A further illustrates light source 4231, surface 4610/4820, and an optical axis 4990.

Rear window 4238A-C includes a main area 4910 (e.g., a substantially central area) and peripheral areas 4920, 4930, and 4940. Main area 4910 substantially corresponds to a portion of rear window 4238A-C aligned behind surfaces 4604/4804 of optical element 4232/4800. In some embodiments, main area 4910 is approximately 22 mm by approximately 22 mm. Peripheral areas 4920, 4930, and 4940 substantially correspond to portions of rear window 4238A-C aligned behind non-uniform surfaces 4602/4802 of optical element 4232/4800. In some embodiments, each of peripheral areas 4920, 4930, and 4940 is approximately 2 mm wide.

As discussed, light 4710B/4710B directed toward surfaces 4604/4804 is substantially normal to surfaces 4604/4804 and therefore passes substantially straight through surfaces 4604/4804 toward the user to provide a focused reticle for viewing by the user. This reticle appears in main area 4910 of rear window 4238A-C.

As also discussed, light 4710A/4810B directed toward surfaces 4602/4802 encounters the various non-uniformities in surfaces 4602/4802 and is redirected such that it is not parallel to light 4710B/4810B. In particular, this refracted light 4710A/4810A may appear in one or more peripheral areas 4920, 4930, and/or 4940 of rear window 4238A-C, depending on the orientation of the user's eye 4004 in relation to gun sight 4010A-C.

Figure 49B:
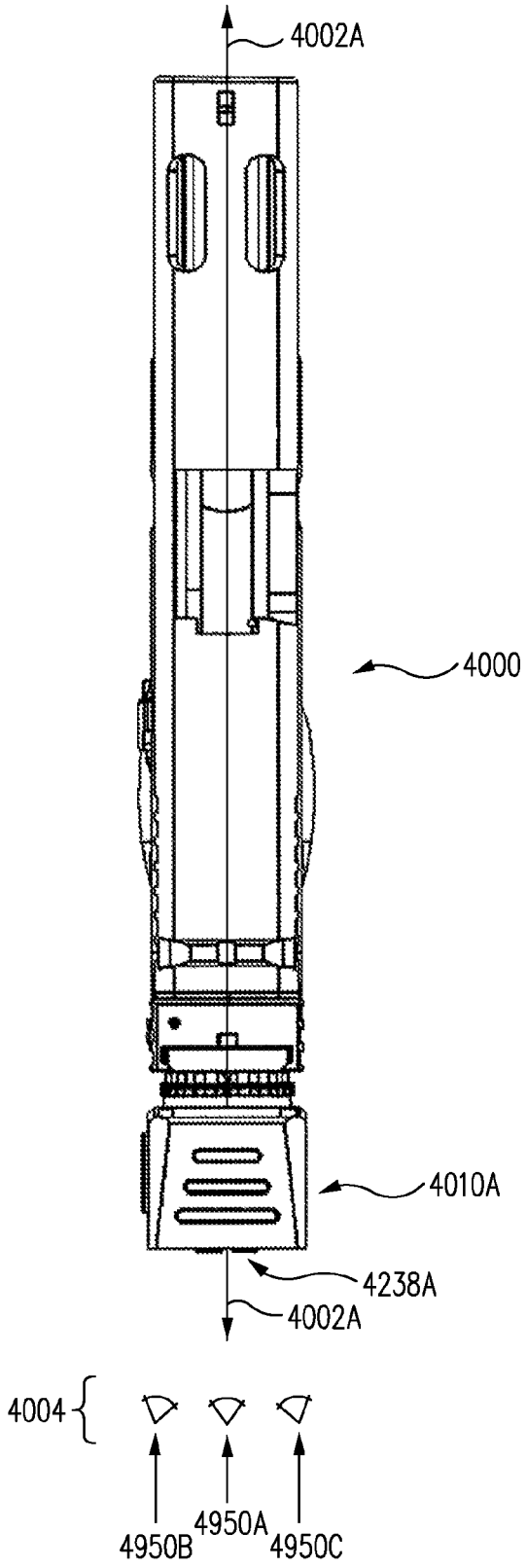
FIGS. 49B-C illustrate various positions of a user's eye in relation to a gun sight in accordance with embodiments of the invention.
Figure 49C:
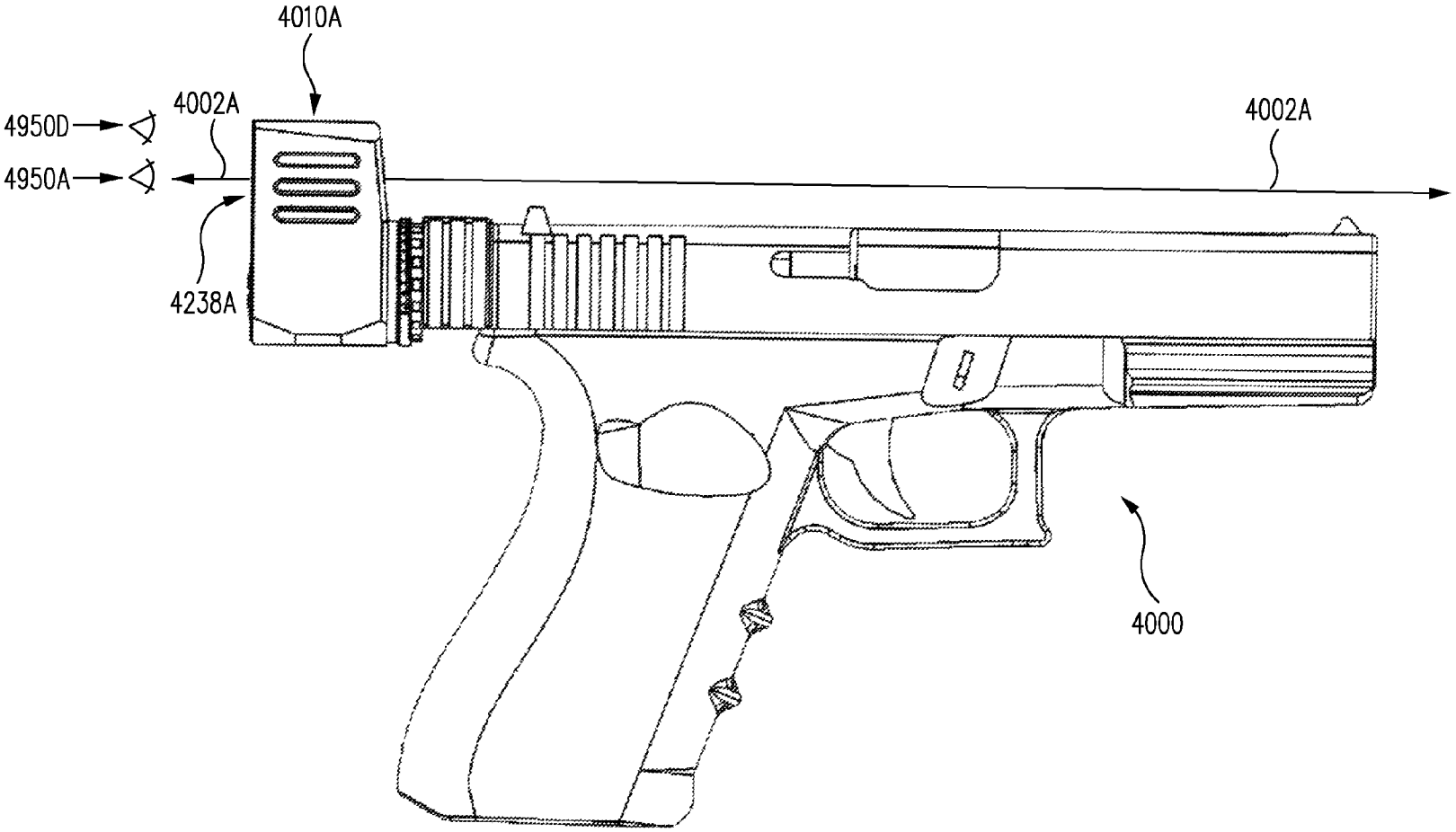

Advantageously, light 4710A/4810A may be used to aid the user in aligning the user's eye 4004 relative to the reticle appearing in main area 4910. For example, FIGS. 49B-C illustrate various positions of the user's eye 4004 in relation to gun sight 4010A in accordance with embodiments of the invention. Although the aiding features of light 4710A/4810A will be described primarily with regard to gun sight 4010A, such features may be applied in the same or similar manner to gun sights 4010B-C and/or other gun sights in various embodiments.

In FIG. 49B, the user's eye 4004 is illustrated in several positions 4950A-C relative to axis 4002A. For each of positions 4950A-C, the user's eye 4004 is substantially aligned vertically with a center of main area 4910 of rear window 4238A, but in different horizontal positions in relation to rear window 4238A.

In position 4950A, the user's eye 4004 is substantially aligned horizontally with axis 4002A. As a result, while at position 4950A, the user's eye 4004 will view the reticle provided by light 4710B/4810B in main area 4910.

In position 4950B, the user's eye 4004 is positioned to the left of axis 4002A. As a result, while at position 4950B, the user's eye 4004 will have difficulty viewing the reticle provided by light 4710B/4810B in main area 4910. For example, in some embodiments, the reticle may appear only slightly or may not appear at all in the field of view of the user's eye 4004 while at position 4950B (e.g., due to the relatively narrow viewing angle provided for the reticle, such as in a range of approximately 1 MOA to approximately 9 MOA, a range of approximately 1 MOA to approximately 10.5 MOA, or other appropriate ranges in some embodiments), and therefore may not be usable for aiming gun 4000 while the user's eye 4004 is at position 4950B.

However, while the user's eye 4004 is at position 4950B, light 4710A/4810A may appear as a refracted light guide in peripheral area 4920. In this regard, peripheral area 4920 of rear window 4238A/4238B may appear illuminated to the user (e.g., due to the redirected light 4710A/4810A), while other peripheral areas 4930 and 4940, and main area 4910 remain substantially non-illuminated (e.g., such areas may merely show a target field in the case of a reflex sight such as gun sight 4010A or may appear dark in the case of an occluded sight such as gun sight 4010B). Thus, the illuminated peripheral area 4920 will signal to the user that the user should reposition his eye 4004 horizontally to the right (e.g., from position 4950B to position 4950A) and/or reposition gun sight 4010A horizontally to the left (e.g., to be aligned with the user's eye 4004 at position 4950B) in order to be aligned with the reticle to properly aim gun 4000.

In position 4950C, the user's eye 4004 is positioned to the right of axis 4002A. As a result, while at position 4950C, the user's eye 4004 will have similar difficulty viewing the reticle provided by light 4710B/4810B in main area 4910. While the user's eye 4004 is at position 4950C, light 4710A/4810A may appear as a refracted light guide in peripheral area 4930. Thus, the illuminated peripheral area 4930 will signal to the user that the user should reposition his eye 4004 horizontally to the left (e.g., from position 4950C to position 4950A) and/or reposition gun sight 4010A horizontally to the right (e.g., to be aligned with the user's eye 4004 at position 4950C) in order to be aligned with the reticle to properly aim gun 4000.

In FIG. 49C, the user's eye 4004 is illustrated in several positions 4950A and 4950D relative to axis 4002A. For each of positions 4950A and 4950D, the user's eye 4004 is substantially aligned horizontally with a center of main area 4910 of rear window 4238A, but in different vertical positions in relation to rear window 4238A.

In position 4950A, the user's eye 4004 is substantially aligned vertically with axis 4002A (e.g., as previously discussed with regard to FIG. 49B). As a result, while at position 4950A, the user's eye 4004 will view the reticle provided by light 4710B/4810B in main area 4910.

In position 4950D, the user's eye 4004 is positioned above axis 4002A. As a result, while at position 4950D, the user's eye 4004 will have similar difficulty viewing the reticle provided by light 4710B/4810B in main area 4910. While the user's eye 4004 is at position 4950D, light 4710A/4810A may appear as a refracted light guide in peripheral area 4940. Thus, the illuminated peripheral area 4940 will signal to the user that the user should reposition his eye 4004 downward (e.g., from position 4950D to position 4950A) and/or reposition gun sight 4010A upward (e.g., to be aligned with the user's eye 4004 at position 4950D) in order to be aligned with the reticle to properly aim gun 4000.

In some embodiments, the refracted light guides provided in peripheral areas 4920, 4930, and/or 4940 may remain continuously visible to the user as eye 4004 and/or gun sight 4010A is repositioned from a misaligned position (e.g., where the reticle is not visible to the user) to an aligned position (e.g., where the reticle is visible to the user). In some embodiments, the refracted light guides provided in peripheral areas 4920, 4930, and/or 4940 may remain visible to the user while eye 4004 is aligned with gun sight 4010A (e.g., while the reticle is also visible to the user). Such implementations may permit the user to continuously rely on the refracted light guides as the user's eye 4004 and or gun sight 4010A is repositioned.

Multiple peripheral areas may be used to signal to the user that the user should move his eye 4004 in multiple directions. For example, if the user perceives both of peripheral areas 4920 and 4940 to be illuminated (e.g., which provide two refracted light guides), this will indicate to the user to reposition his eye 4004 both downward and to the right and/or reposition gun sight 4010A both upward and to the left in order to be aligned with the reticle. Similarly, if the user perceives both of peripheral areas 4930 and 4940 to be illuminated, this will indicate to the user to move his eye 4004 both downward and to the left and/or reposition gun sight 4010A both upward and to the right in order to be aligned with the reticle.

Thus, by providing surfaces 4602/4802 on optical element 4232/4800, the user may be able to rapidly and conveniently reposition his eye 4004 relative to gun sight 4010A-C and/or reposition gun sight 4010A-C based on the appearance of various refracted light guides in peripheral areas 4920, 4930, and/or 4940. As a result, the user may locate the reticle in a rapid, reliable manner to aim gun 4000. Although refracted light guides have been described as being created by non-uniform surfaces 4602/4802, other techniques for creating such light guides may be used where appropriate.

Figure 50:
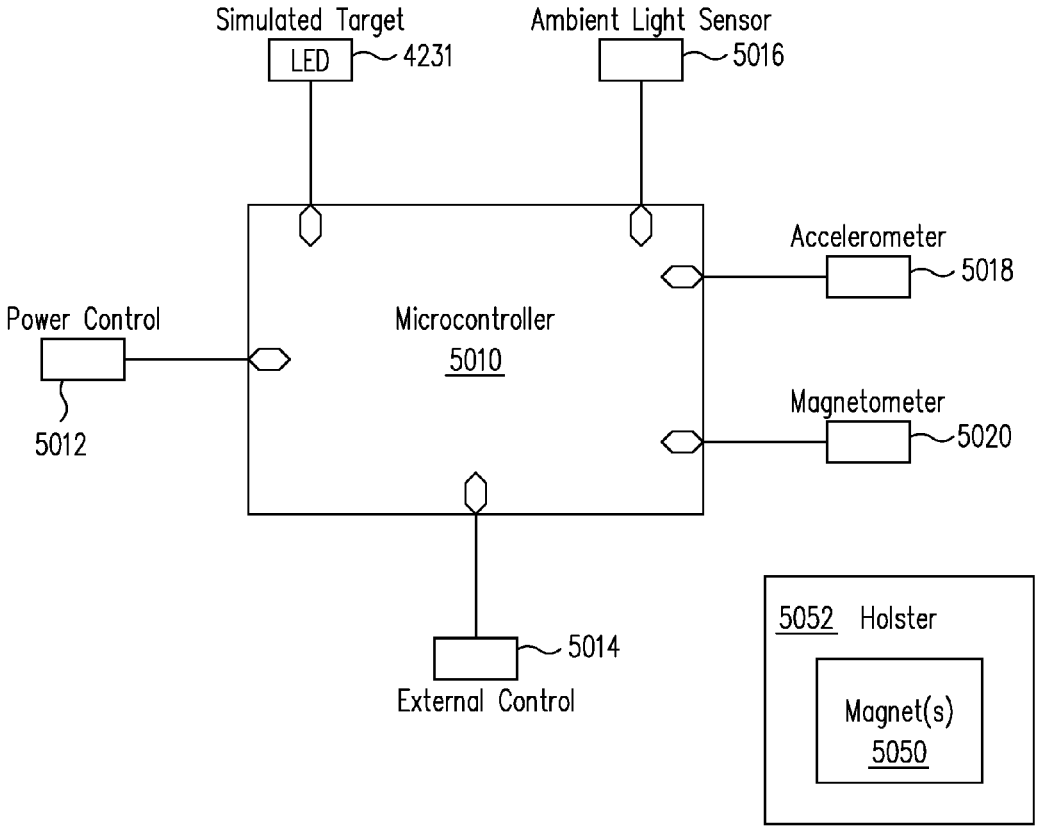
FIG. 50 illustrates a block diagram of various components of a gun sight and a holster in accordance with an embodiment of the invention.

FIG. 50 illustrates a block diagram of various components of gun sight 4010A-C and a holster 5052 in accordance with an embodiment of the invention. Although the components of FIG. 50 will be described primarily with regard to gun sights 4010A-C, such components may be used with any of the various gun sights disclosed herein and may be implemented by any of the various circuit boards and/or circuitry disclosed herein.

Light source 4231 may be used to emit light to provide a reticle and refracted light guides as described herein. In some embodiments, light source 4231 may be implemented in the manner of any light sources described herein.

A microcontroller 5010 may be used to provide any appropriate processing operations of the various gun sights disclosed herein. In some embodiments, microcontroller 5010 may be implemented in the manner of microcontroller 502 described herein.

Power control 5012 corresponds to one or more circuits, user controls, and/or other components used to selectively turn on or turn off one or more components of gun sight 4010A-C. In some embodiments, power control 5012 may be implemented in the manner of battery connection and protection circuit 524 described herein.

External control 5014 corresponds to one or more user controls to adjust the operation of microcontroller 5010. In some embodiments, external control 5014 may be implemented in the manner of any user controls described herein.

Ambient light sensor 5016 may be used to detect light in a surrounding environment. In some embodiments, ambient light sensor 5016 may be implemented in the manner of ambient light sensor 522 described herein.

Accelerometer 5018 may be used to implement any of the various accelerometer features described herein. In some embodiments, accelerometer 5018 may be implemented in the manner of accelerometer 510 described herein.

Magnetometer 5020 may be used to provide one or more appropriate signals to microcontroller 5010 to adjust the operation of gun sight 4010A-C when brought in proximity to a magnet. For example, in some embodiments, gun 4000 may be held by holster 5052 configured with one or more magnets 5050. When gun 4000 is held by the holster, magnetometer 5020 may be positioned in proximity to magnets 5050. The magnetic fields (e.g., magnetic flux) associated with such magnets 5050 may cause magnetometer to signal microcontroller 5010 that one or more electrical components of gun sight 4010A-C should be turned off while gun 4000 is holstered. When gun 4000 is drawn from holster 5052, magnetometer 5020 will no longer be in proximity to magnets 5050. As a result, magnetometer 5020 may signal microcontroller 5010 that one or more electrical components gun sight 4010A-C should be turned on while gun 4000 is unholstered. As a result, gun sight 4010A-C may be operated with significant power savings, and without requiring the user to selectively turn gun sight 4010A-C on and off when unholstering and holstering gun 4000.

Figure 51A:
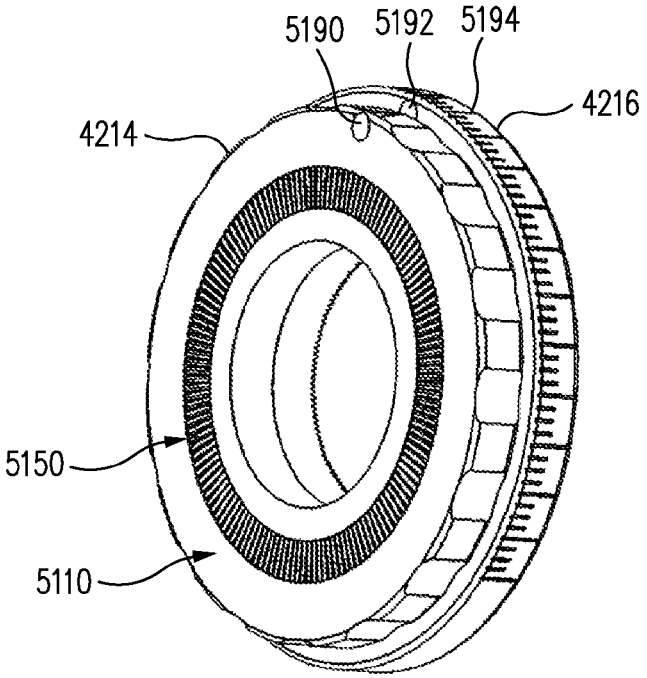
FIGS. 51A-B illustrate alignment members for a gun sight in accordance with embodiments of the invention.
Figure 51B:
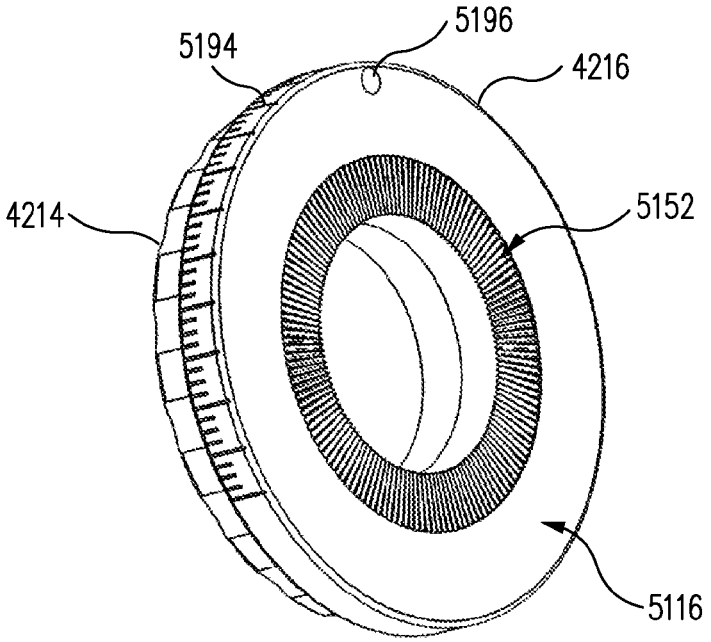

FIGS. 51A-B illustrate alignment members 4214 and 4216 in accordance with embodiments of the invention. In some embodiments, alignment members 4214 and 4216 may be implemented as disks. Alignment members 4214/4216 may include markings (e.g., indicia and/or other indicators) 5190, 5192, 5194, and 5196 to aid the user in identifying the relative positions of alignment members 4214/4216 to each other, gun 4000, and/or gun sight 4010A/4010B.

As shown, alignment member 4214 may include a plurality of recesses 5150 (e.g., indentations and/or other appropriate structures) in surface 5110, and alignment member 4216 may include a plurality of recesses 5152 in surface 5116. Recesses 5150/5152 may be used to secure alignment members 4214/4216 after they have been rotated to adjust the alignment of gun sight 4010A/4010B.

Figure 51C:
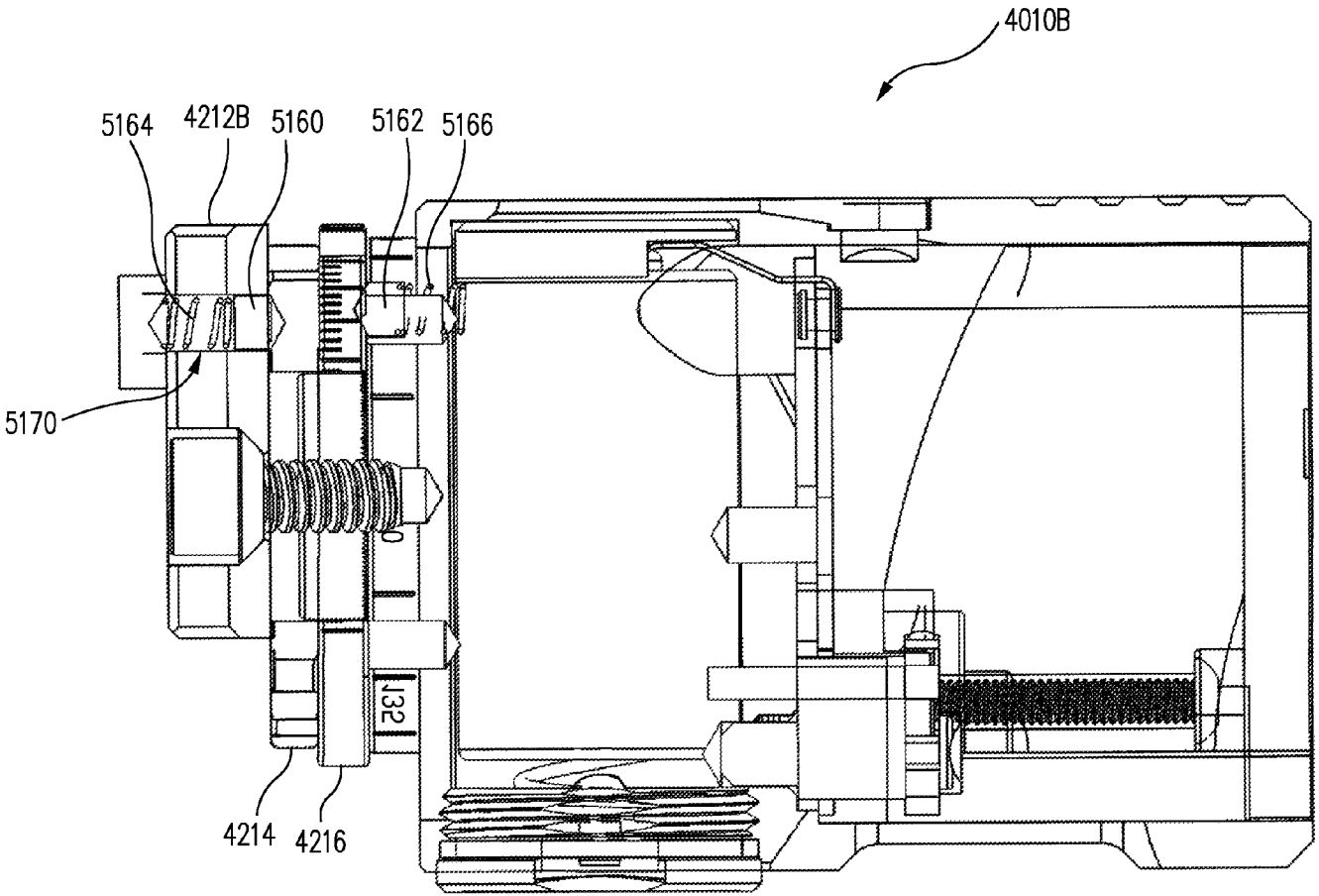
FIG. 51C illustrates a cross-sectional view through the gun sight of FIG. 44B as seen along the lines of the section 51C-51C taken therein in accordance with an embodiment of the invention.
Figure 59A:
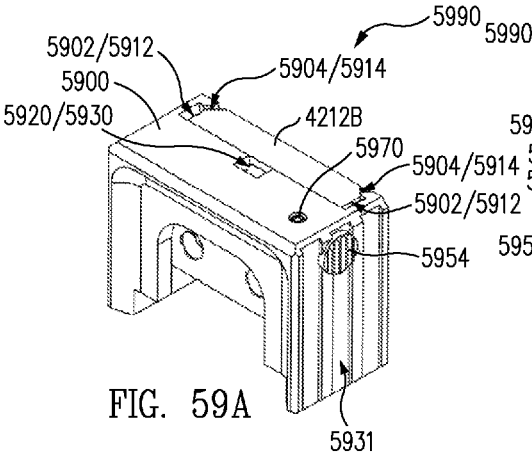
FIGS. 59A-64B illustrate various aspects of a wedge attachment mechanism for a gun sight in accordance with embodiments of the invention.
Figure 59B:
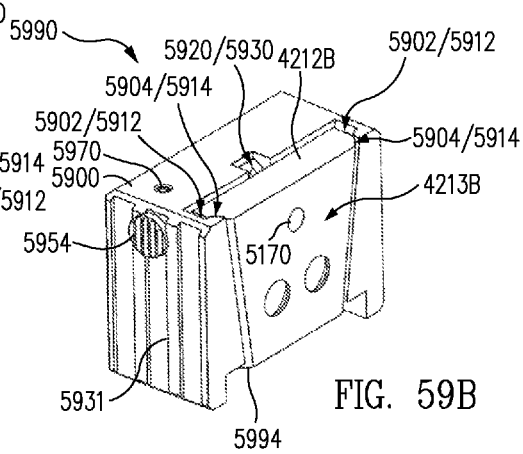

For example, FIG. 51C illustrates a cross-sectional view through gun sight 4010B of FIG. 44B as seen along the lines of the section 51C-51C taken therein in accordance with an embodiment of the invention. Pin 5160 and spring 5164 are provided in a recess 5170 (see FIGS. 59B and 60A) of wedge mounting member 4212B. Pin 5162 and spring 5166 are provided in recess 4299 (see FIG. 45A) of front surface 4217B of housing 4222B.

Pins 5160 and 5162 are loaded by springs 5164 and 5166, respectively, which push pins 5160/5162 into recesses 5150/5152, respectively. Thus, when gun sight 4010B is aligned, pins 5160 and 5162 engage recesses 5150 and 5152 of alignment members 4214 and 4216, respectively, to prevent gun sight 4010B from becoming misaligned.

In some embodiments, alignment members 4214 and 4216 may be rotated independently of each other to adjust an alignment of gun sight 4010B relative to gun 4000.

If the user desires to adjust the alignment of gun sight 4010E using alignment member 4214, the user may push alignment members 4214/4216 toward spring 5166 which causes pin 5160 to disengage from recesses 5150 of alignment member 4214. As a result, alignment member 4214 may be rotated relative to alignment member 4216 while alignment member 4216 remains fixed by the engagement of pin 5162 with recesses 5152. After alignment, the user may release alignment members 4214/4216 which causes pin 5160 to reengage with recesses 5150.

Similarly, if the user desires to adjust the alignment of gun sight 4010B using alignment member 4216, the user may push alignment members 4214/4216 toward spring 5164 which causes pin 5162 to disengage from recesses 5152 of alignment member 4216. As a result, alignment member 4216 may be rotated relative to alignment member 4214 while alignment member 4214 remains fixed by the engagement of pin 5160 with recesses 5150. After alignment, the user may release alignment members 4214/4216 which causes pin 5162 to reengage with recesses 5152. Although the above discussion has been provided in relation to gun sight 4010B, the same or similar features may be implemented for gun sight 4010A.

Figure 51D:
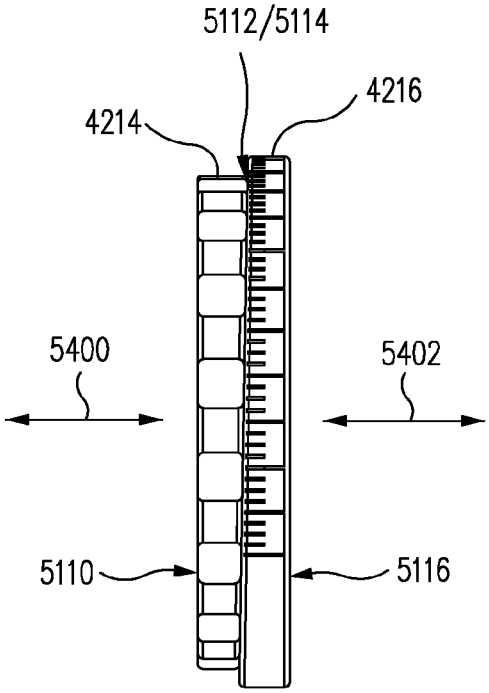
Figure 52:
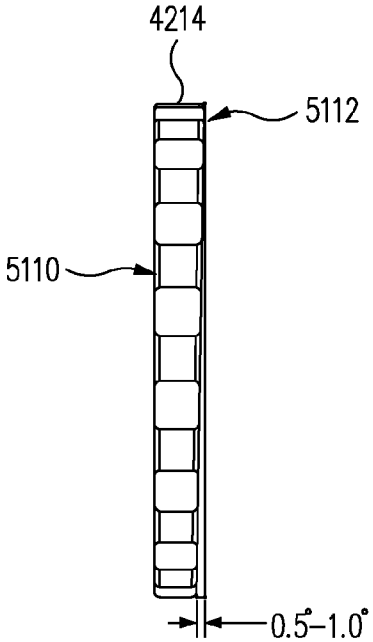
Figure 53:
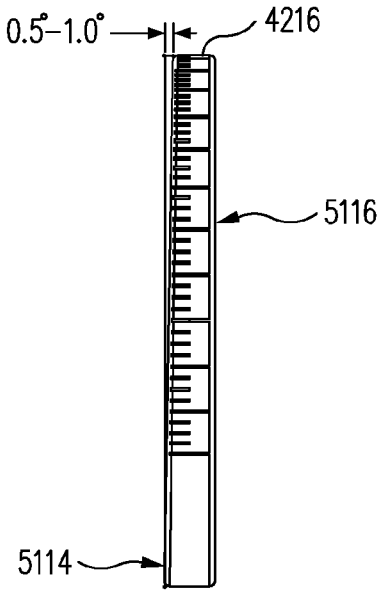

FIGS. 51D-53 further illustrate alignment members 4214 and 4216 in accordance with embodiments of the invention. As shown in FIGS. 52-53, surfaces 5110 and 5112 may be implemented as non-parallel to each other. In this regard, surface 5112 of alignment member 4214 may be tapered slightly in relation to surface 5110. In some embodiments, surface 5112 may be inclined in a range of approximately 0.5 degrees to approximately 1.0 degrees relative to an axis of rotation (e.g., axis 5400). Similarly, surface 5114 of alignment member 4216 may be tapered slightly in relation to surface 5116. In some embodiments, surface 5114 may exhibit a taper in a range of approximately 0.5 degrees to approximately 1.0 degrees relative to an axis of rotation (e.g., axis 5402). In some embodiments, alignment members 4214 and 4216 may be implemented in an arrangement similar to a Risley prism but applied in the different context of mechanical alignment of gun sight 4010A/4010B.

When gun sight 4010A/4010B is installed on gun 4000, surface 5110 faces toward gun 4000, is substantially concentric with longitudinal axis 5400 (e.g., alignment member 4214 rotates about axis 5400), and is adapted to interface with and rotate relative to a fixed surface associated with gun 4000 (e.g., rear surface 4213A/B of wedge mounting member 4212A/B, a rear surface of slide 4001, and/or others). Surfaces 5112 and 5114 interface with each other and are adapted to rotate relative to each other. Surface 5116 faces toward gun sight 4010A/4010B, is substantially concentric with axis 5402 of gun sight 4010A/4010B (e.g., alignment member 4216 rotates about axis 5402), and is adapted to interface with and rotate relative to gun sight 4010A/4010B (e.g., front surface 4217A/B). The orientation of axis 5402 changes in relation to axis 5400 as alignment members 4214 and 4216 are rotated due to the inclination of surfaces 5112 and 5114 relative to axes 5400 and 5402, respectively.

In FIG. 51D, alignment members 4214 and 4216 are positioned in contact with and parallel to each other with surfaces 5112 and 5114 exhibiting substantially complementary tapers. As a result, surfaces 5110 and 5116 are also substantially parallel to each other. In this orientation, axis 5402 of gun sight 4010A/4010B is aligned with longitudinal axis 5400 of the barrel of gun 4000.

When alignment members 4214 and 4216 are rotated relative to each other, surfaces 5112 and 5114 remain in contact remain in contact with and substantially parallel to each other, but the tapers of surfaces 5112 and 5114 are no longer complementary to each other. The contact of these non-complementary surfaces 5112 and 5114 against each other causes alignment members 4214 and 4216 to tip relative to each other, causing surfaces 5110 and 5116 to exhibit a non-parallel orientations relative to each other. As a result, the orientation of axis 5402 will change in relation to longitudinal axis 5400 of the barrel of gun 4000 (e.g., the position of gun sight 4010A/4010B will change relative to gun 4000). As the position of gun sight 4010A/4010B changes, the axis 4002A/4002B along which a reticle is provided will also change. Thus, by rotating alignment members 4214/4216 relative to each other, the alignment of the reticle (e.g., along axis 4002A/4002B) can be adjusted in order to sight gun 4000 as desired. Moreover, after the reticle alignment has been determined, the selected position of gun sight 4010A/4010B can be maintained by the engagement of pins 5160/5162 with recesses 5150/5152 as discussed.

Figure 54A:
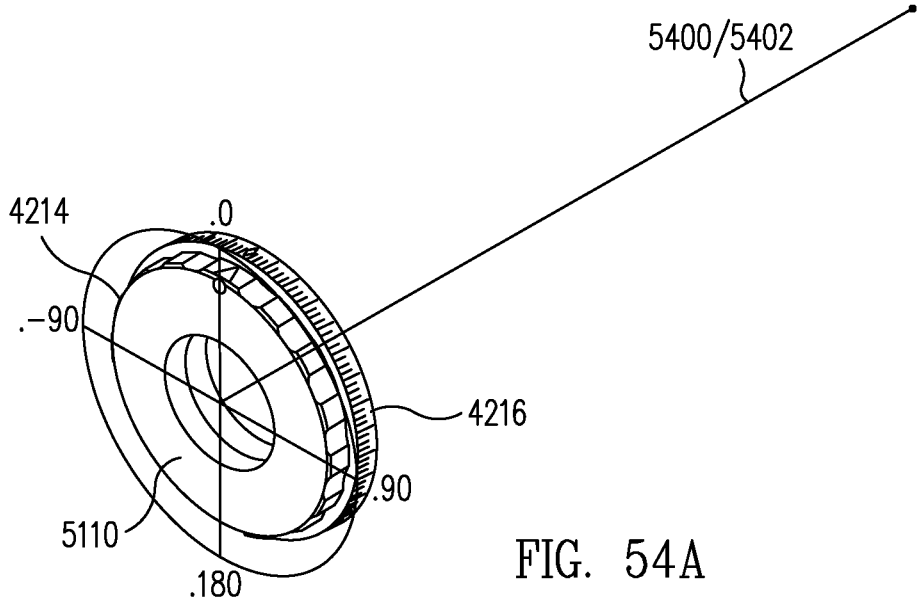
FIGS. 54A-58B illustrate various adjustments of alignment members for a gun sight in accordance with embodiments of the invention.
Figure 54B:
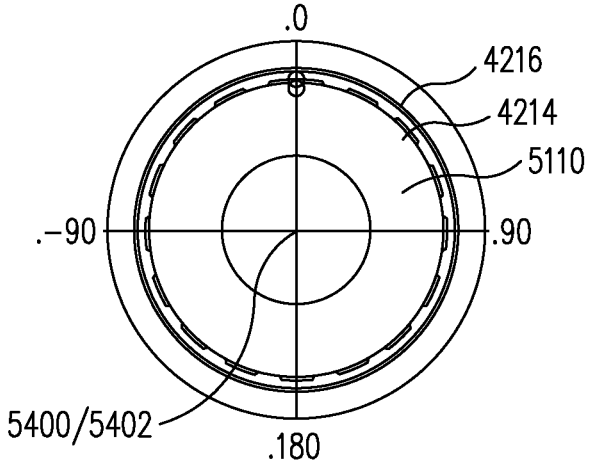

FIGS. 54A-58B illustrate alignment members 4214 and 4216 in different positions resulting in different orientations of gun sight 4010A/4010B relative to gun 4000 in accordance with embodiments of the invention. In FIGS. 54A-B, alignment members 4214 and 4216 are positioned in the manner shown in FIG. 51D. As discussed, in this position, surfaces 5110 and 5116 are substantially parallel to each other. As a result, axes 5400 and 5402 are parallel and concentric with each other (e.g., as viewed from the barrel of gun 4000 back toward gun sight 4010A/4010B) in FIG. 54B.

Figure 55A:
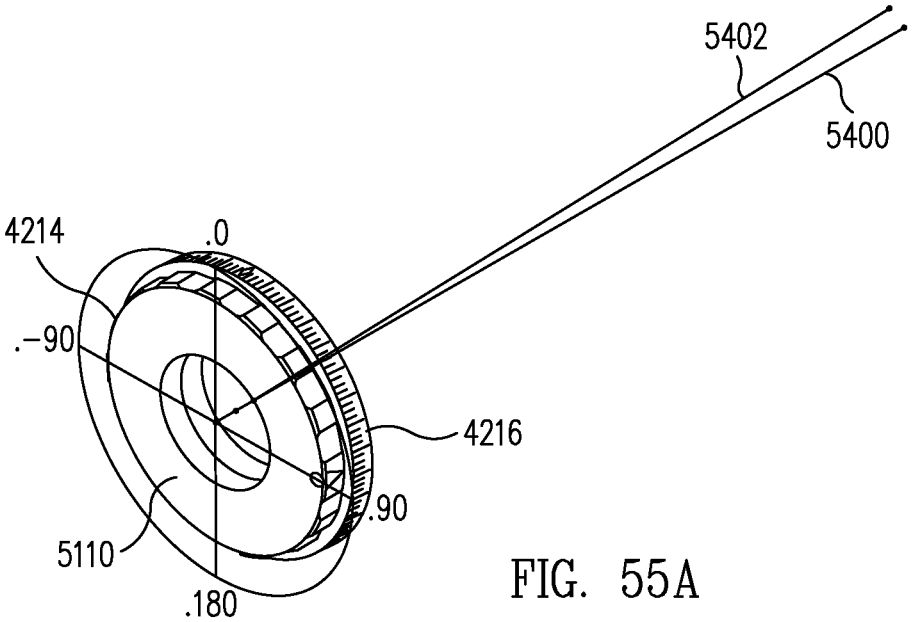
Figure 55B:
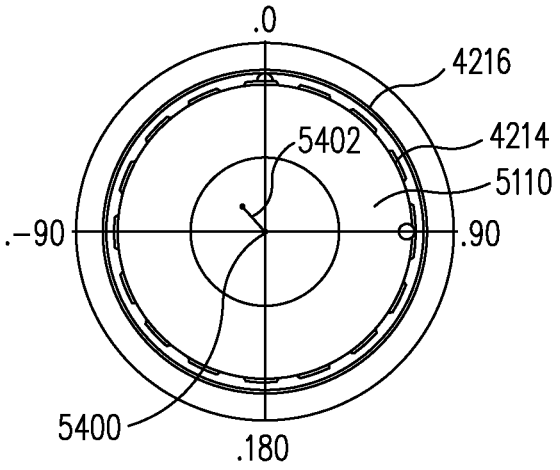

In FIGS. 55A-B, alignment member 4214 is rotated 90 degrees relative to alignment member 4214. This causes axis 5402 to be directed upward and to the left as viewed from axis 5400 in FIG. 55B.

Figure 56A:
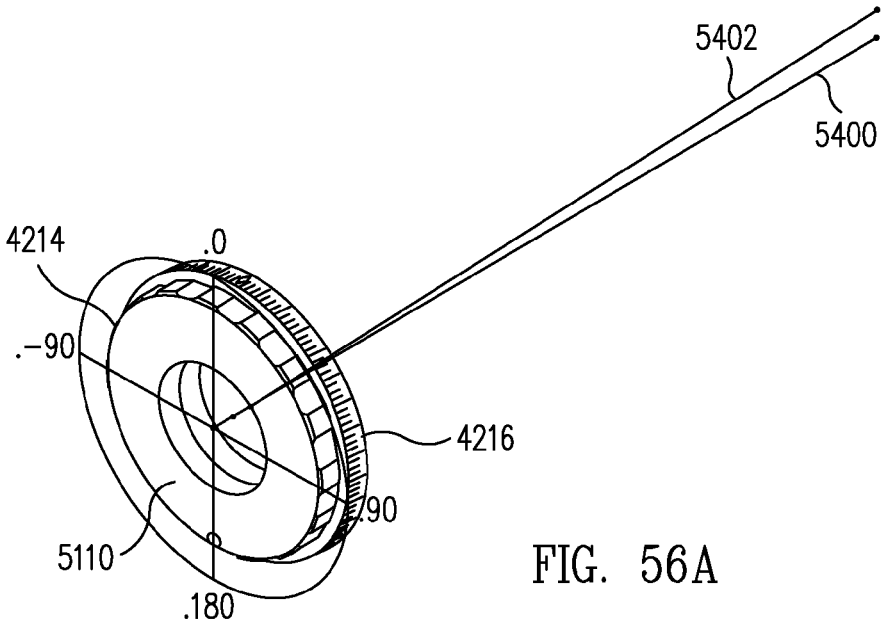
Figure 56B:
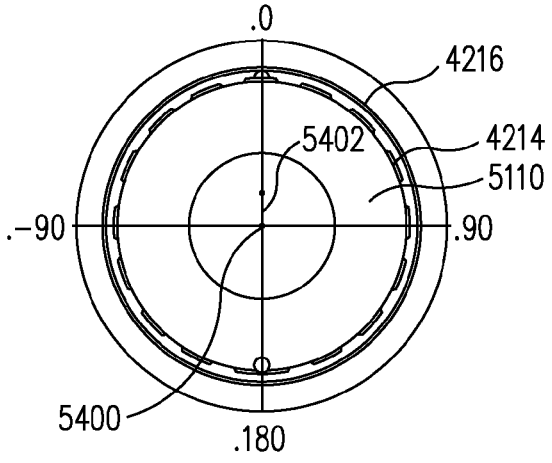

In FIGS. 56A-B, alignment member 4214 is rotated 180 degrees relative to alignment member 4214. This causes axis 5402 to be directed upward as viewed from axis 5400 in FIG. 56B.

Figure 57A:
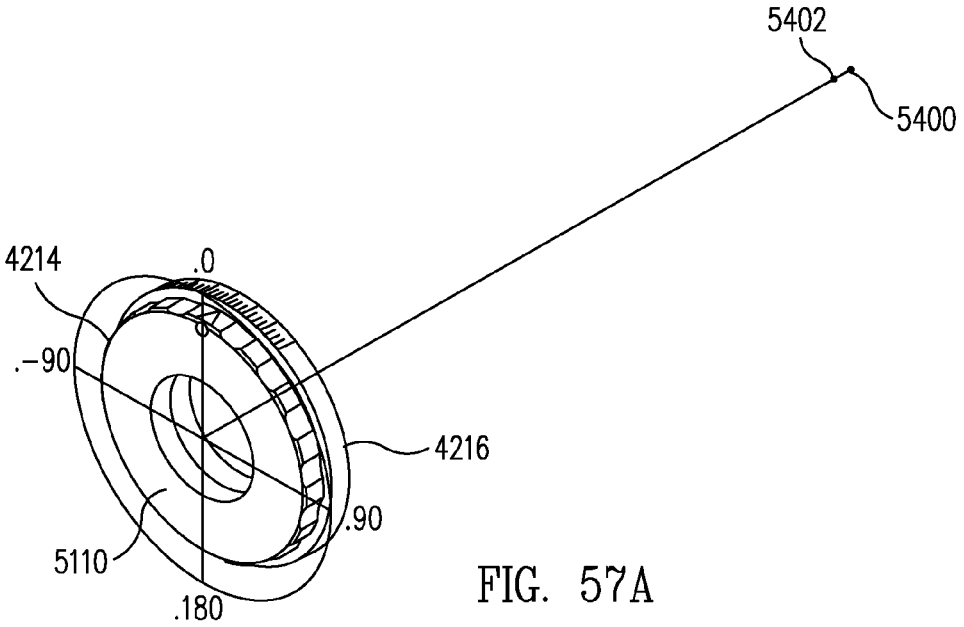
Figure 57B:
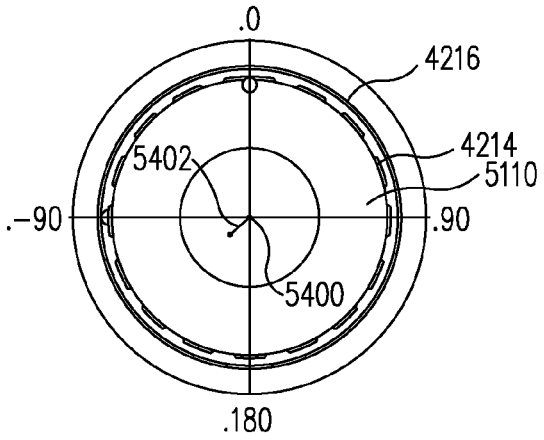

In FIGS. 57A-B, alignment member 4216 is rotated 90 degrees relative to alignment member 4214 (e.g., in the opposite direction as alignment member 4214 was rotated in FIGS. 55A-B). This causes axis 5402 to be directed downward and to the left as viewed from axis 5400 in FIG. 57B.

Figure 58A:
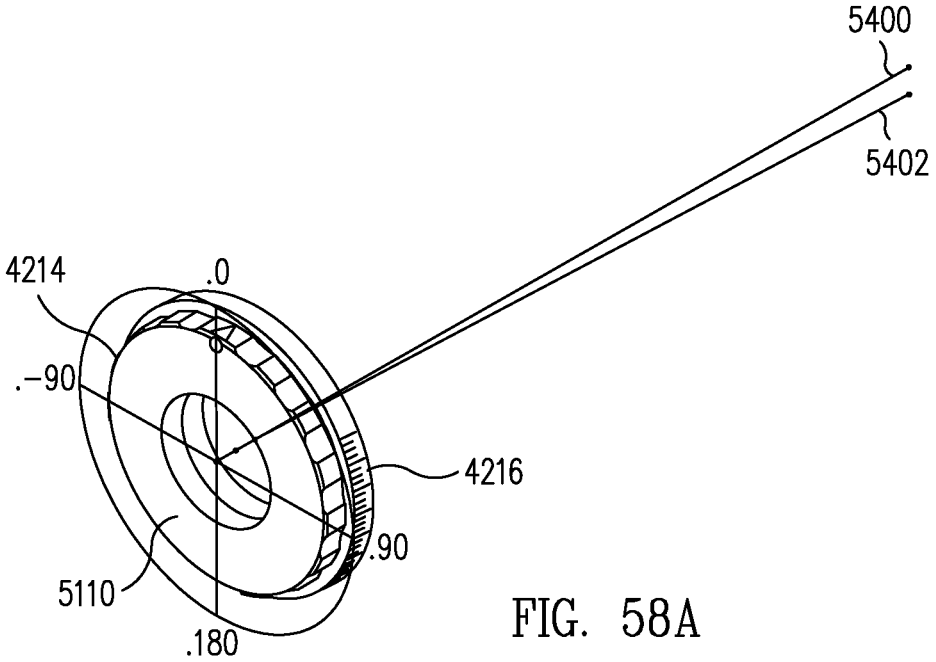
Figure 58B:
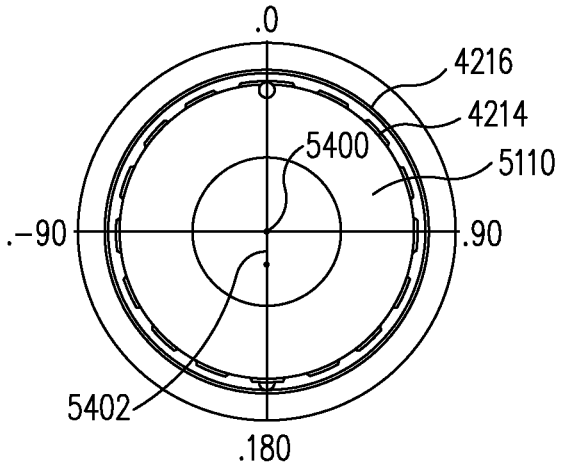

In FIGS. 58A-B, alignment member 4216 is rotated 180 degrees relative to alignment member 4214. This causes axis 5402 to be directed downward as viewed from axis 5400 in FIG. 58B. Other orientations of alignment member 4214 and 4216 may be used to adjust axis 5402 in other directions as may be desired (e.g., in any direction 360 degrees around axis 5400 as viewed from the barrel of gun 4000).

Thus, by selectively rotating alignment members 4214/4216 relative to each other, gun sight 4010A/4010B may be adjusted for azimuth and elevation. The orientation of axes 4002A-B along which reticles are projected to the user are substantially parallel to mounting axis 5402 and are thus also adjusted as the alignment of gun sights 4010A-B change. As a result, the position of the reticle viewed by the user relative to gun 4000 may be adjusted to sight gun 4000 as desired.

Although surfaces 5110, 5112, 5114, and 5116 have been described as substantially flat surfaces. Other embodiments are also contemplated. For example, in some embodiments, one or more of such surfaces may exhibit a substantially rounded and/or a substantially spherical contour.

Gun sight may 4010A/4010B may be implemented with various attachment mechanisms, such as various mounting members that may be attached to retaining members secured to gun 4000. For example, FIGS. 59A-64B illustrate various aspects of a wedge attachment mechanism 5990 for gun sight 4010A/4010B in accordance with embodiments of the invention. Wedge attachment mechanism 5990 includes a mounting member implemented as a wedge mounting member 4212B (e.g., a substantially wedge-shaped mounting member), and also includes a retaining member implemented as a wedge retaining member 5900. Although wedge attachment mechanism 5990 will be described primarily with regard to wedge mounting member 4212B and gun sight 4010B, the principles described herein may be applied to wedge mounting member 4212A, gun sight 4010A, and/or other appropriate components in other embodiments.

As discussed, wedge mounting member 4212B is used to releasably attach gun sight 4010B to wedge retaining member 5900 mounted behind the barrel of gun 4000. In some embodiments, wedge retaining member 5900 may be mounted to slide 4001 of gun 4000.

Wedge mounting member 4212B includes front surface 4211B, rear surface 4213B, tapered external surfaces 5902, tapered external surfaces 5904, an engagement member 5920, and recess 5170. Wedge retaining member 5900 includes tapered interior surfaces 5912, tapered interior surfaces 5914, a channel 5930, a shaft 5952, and a pin 5970.

Figure 60A:
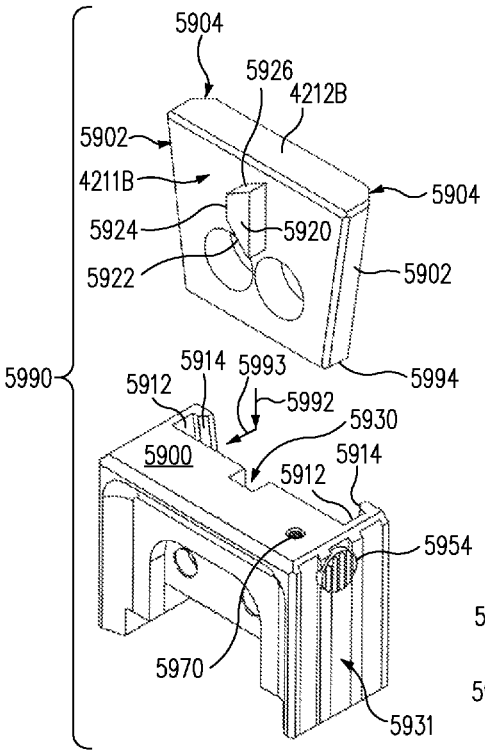
Figure 60B:
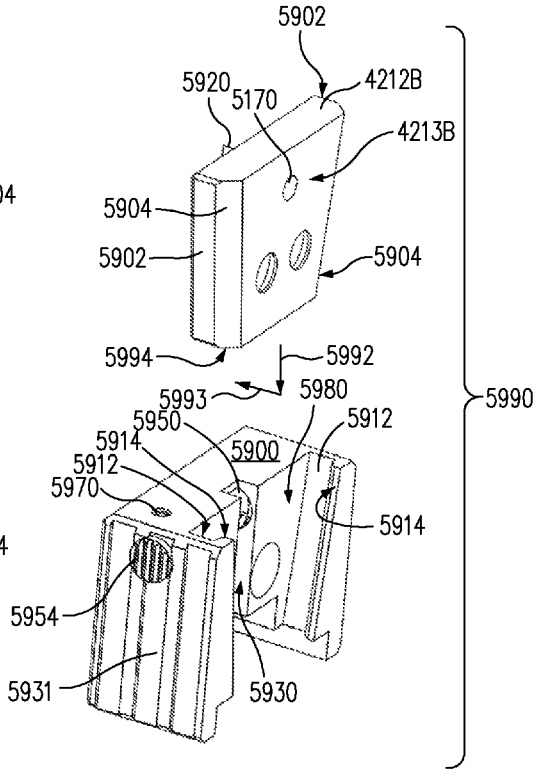
Figure 61A:
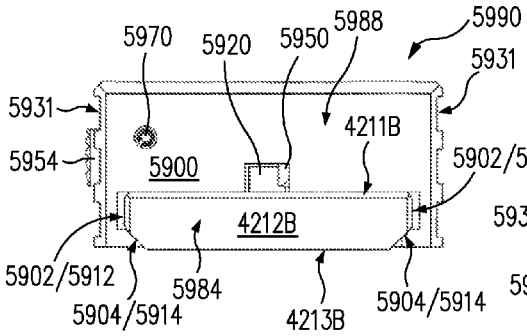
Figure 61B:
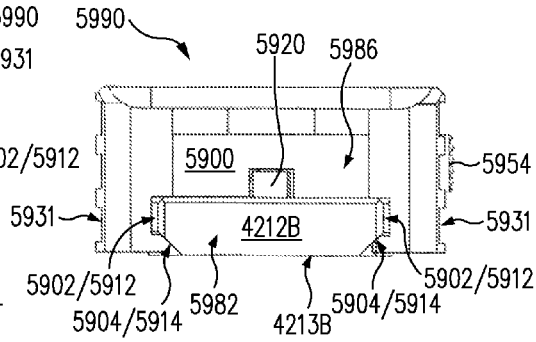
Figure 62A:
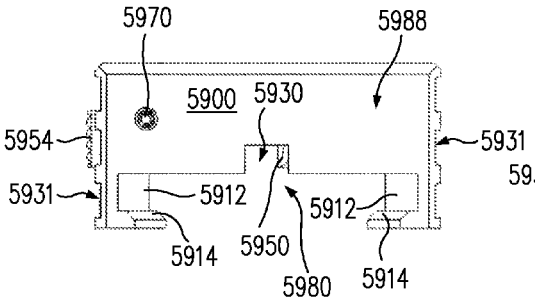
Figure 62B:
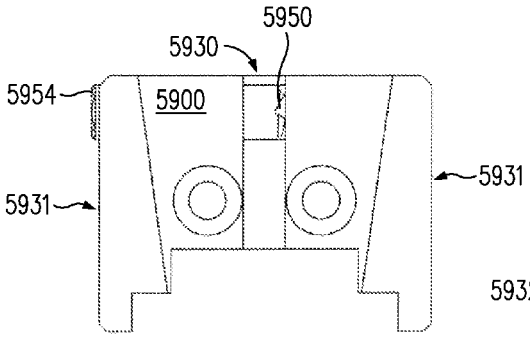

As shown in FIGS. 60A-B, wedge mounting member 4212B may be moved (e.g., lowered, slid) generally in the direction of an arrow 5992 for insertion into a cavity 5980 bounded at least in part by surfaces 5912 and 5914 of wedge retaining member 5900. As wedge mounting member 4212B is inserted into wedge retaining member 5900, surfaces 5912 of wedge retaining member 5900 are proximate to surfaces 5902 of wedge mounting member 4212B. For example, surfaces 5912 and 5902 may be used to guide wedge mounting member 4212B as it is inserted into wedge retaining member 5900.

As shown in FIGS. 61A-63B, surfaces 5904 and 5914 are provided at substantially complementary compound angles. For example, surfaces 5910 are provided at compound angles relative to a plane defined by a top surface of gun 4000 (e.g., a top surface 4003 of slide 4001 and/or other appropriate surface); planes defined by a top surface 5984 and a bottom surface 5982 of wedge mounting member 4212B; and/or planes 5932. In this regard, planes 5932 are parallel to side surfaces 5931 of wedge retaining member 5900. Surfaces 5914 are provided at compound angles relative to planes defined by: a top surface of gun 4000 (e.g., top surface 4003 of slide 4001 and/or other appropriate surface); a top surface 5988; a bottom surface 5986; and/or side surfaces 5931 of wedge retaining member 5900.

As wedge mounting member 4212B is inserted into wedge retaining member 5900, bottom edges 5994 and surfaces 5904 of wedge mounting member 4212B contact surfaces 5914 of wedge retaining member 5900. As wedge mounting member 4212B is further inserted into wedge retaining member 5900, the compound angle configuration of surfaces 5904 and 5914 causes wedge mounting member 4212B to also move in the direction of and arrow 5993 (see FIGS. 60A-B) as surfaces 5904 and 5914 push against each other. This compound angle configuration permits wedge mounting member 4212B to be driven into tighter engagement with wedge retaining member 5900 than if surfaces 5904 and 5914 were not configured with compound angles.

Also, as wedge mounting member 4212B is inserted into wedge retaining member 5900, engagement member 5920 is inserted into channel 5930 to engage with a tooth 5950 (e.g., a lock member) of a shaft 5952. Engagement member 5920 includes a lower surface 5922, a side surface 5924, and an upper surface 5926.

Figure 64A:
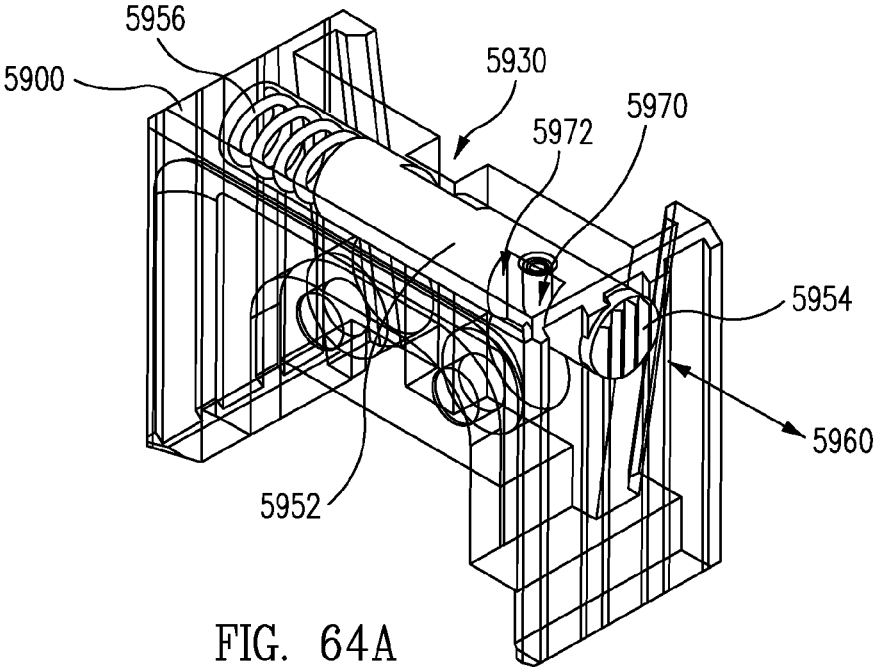
FIGS. 64C-D illustrate various aspects of another wedge attachment mechanism for a gun sight in accordance with embodiments of the invention.
Figure 64B:
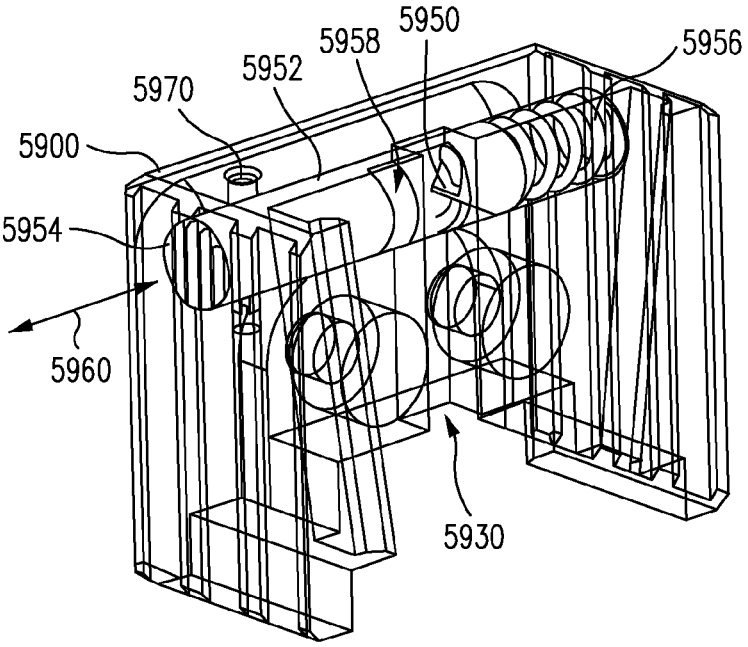

As shown in FIGS. 64A-B, shaft 5952 is loaded (e.g., biased) by a spring 5956 and includes tooth 5950, a user-operable surface 5954, a recess 5972, and a recess 5958. The overall movement of shaft 5952 is limited by pin 5970 contacting inside surfaces of recess 5972. Recess 5958 permits engagement member 5920 to pass through shaft 5952.

Figure 63A:
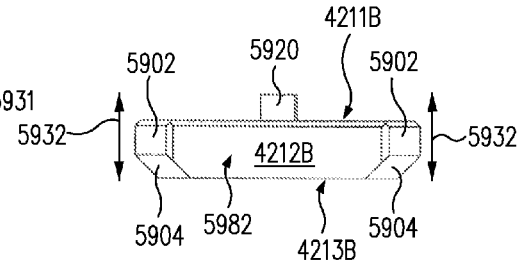
Figure 63B:
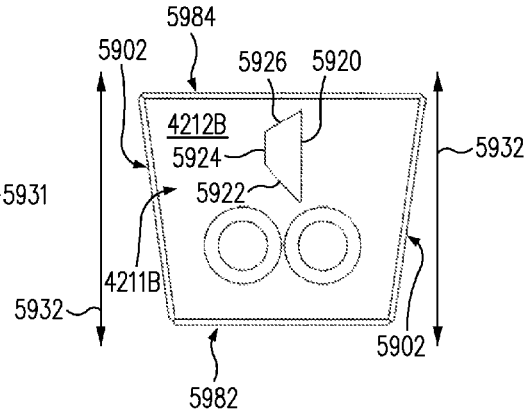

In some embodiments, engagement member 5920 may be implemented with a substantially trapezoidal shape as shown in FIGS. 60A and 63B. As engagement member 5920 enters channel 5930, lower surface 5922 contacts tooth 5950. Spring 5956 operates to bias (e.g., push) tooth 5950 against engagement member 5920. The angle of surface 5922 pushes against tooth 5950 to retract shaft 5952 back against spring 5956 along an axis 5960 to slide tooth 5950 and shaft 5952 from a locked position to an unlocked position. As engagement member 5920 is further inserted into channel 5930, shaft 5952 remains retracted against spring 5956 (e.g., in an unlocked position) by side surface 5924. As engagement member 5920 is inserted even further into channel 5930, the angle of upper surface 5926 permits tooth 5950 to pass over and engage with upper surface 5926 (e.g., in a locked position). As tooth 5950 moves with shaft 5952, spring 5956 expands to hold tooth 55950 against upper surface 5926, thus locking wedge mounting member 4212B into wedge retaining member 5900 and engagement member 5920 in channel 5930. The user may unlock wedge mounting member 4212B from wedge retaining member 5900 (e.g., and also unlock engagement member 5920 from channel 5930) by providing a user input (e.g., pushing against user-operable surface 5954) which disengages tooth 5950 from upper surface 5926, compresses spring 5956, and permits engagement member 5920 to slide out of channel 5930.

Thus, wedge mounting member 4212B may be selectively engaged and disengaged with wedge retaining member 5900 in a convenient manner through the operation of engagement member 5920, shaft 5952, and spring 5956. Moreover, the compound angles of surfaces 5904 and 5914 permit wedge mounting member 4212B to be tightly held by wedge retaining member 5900 while so engaged. Such a configuration permits gun sight 4010A/4010B to be accurately sighted while being rigidly attached to gun 4000. In addition, adjustment members 4214/4216 are mounted behind wedge mounting member 4212B (e.g., near gun sight 4010A/4010B, see FIG. 51C). As a result, gun sight 4010A/4010B may be selectively attached to and removed from gun 4000 (e.g., through the installation and removal of wedge mounting member 4212B with wedge retaining member 5900 which is attached to the rear of gun 4000) in a secure, rigid manner without requiring the user to resight gun 4000 (e.g., readjust the alignment of gun sight 4010A/4010B) each time gun sight 4010A/4010B is attached and removed.

Figure 64C:
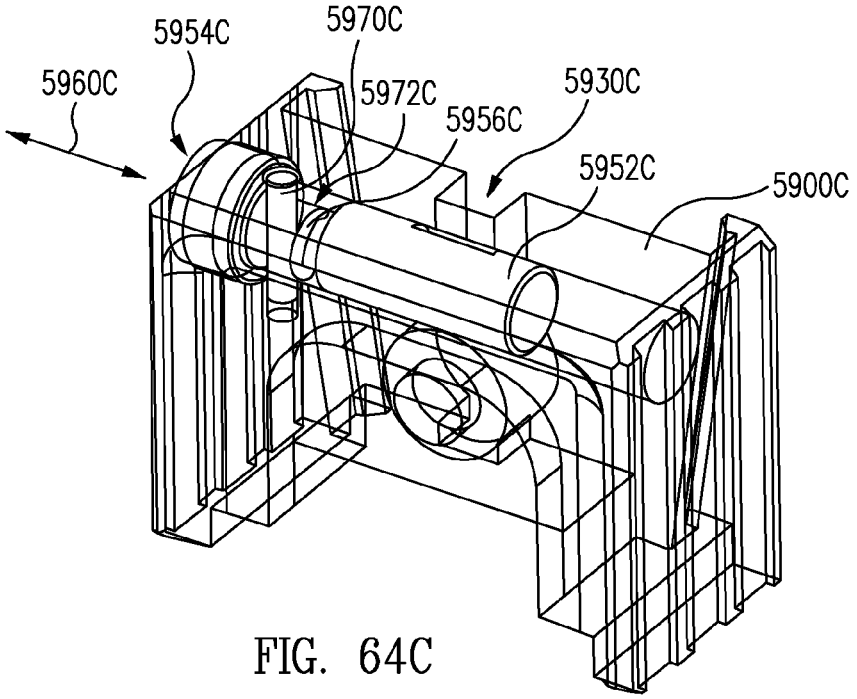
Figure 64D:
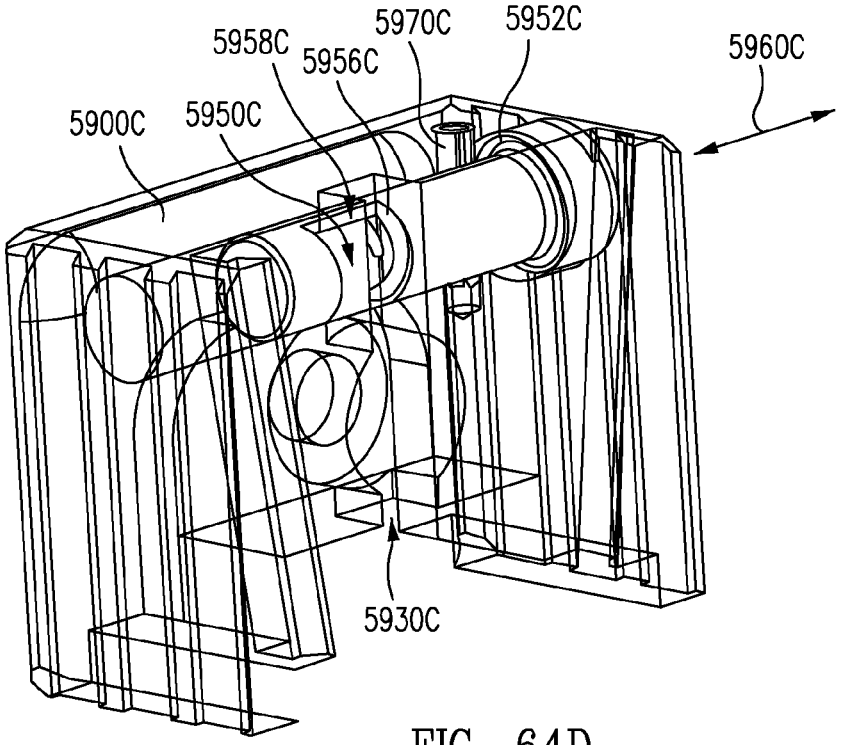
Figure 73A:
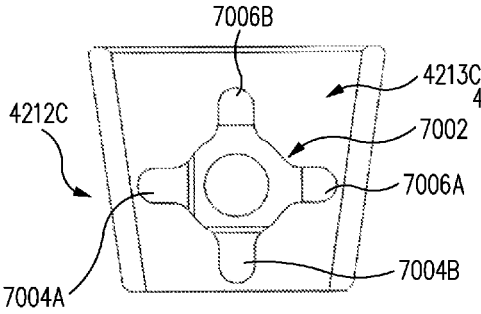
FIGS. 73A-75D illustrate an alignment system for a gun sight in accordance with embodiments of the invention.
Figure 73B:
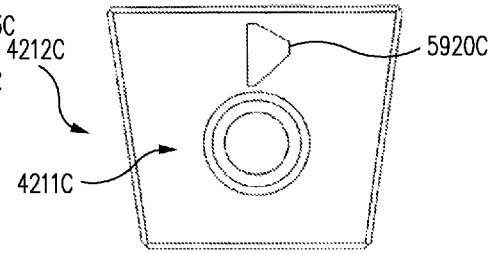
Figure 73C:
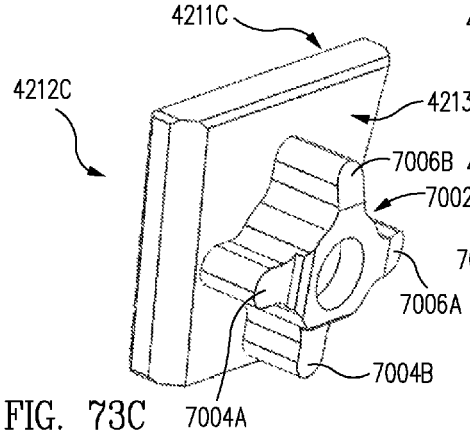
Figure 73D:
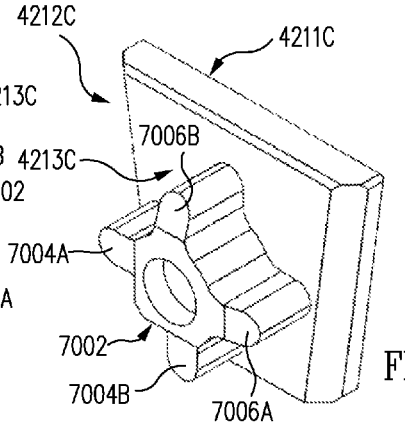
Figure 73E:
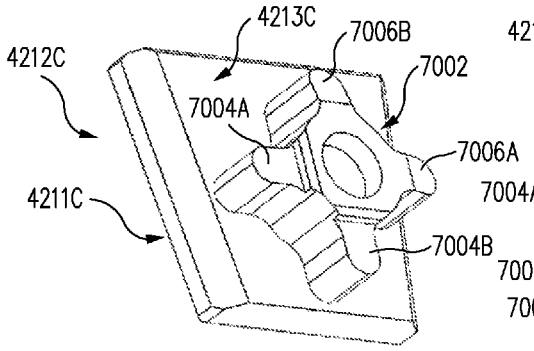
Figure 73F:
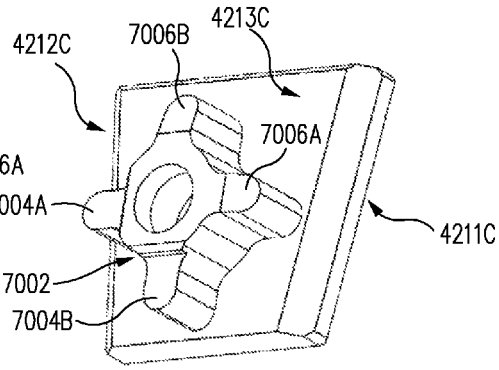
Figure 74A:
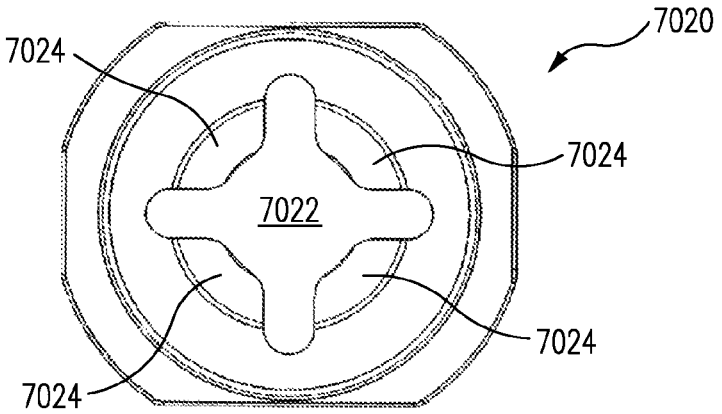
Figure 74B:
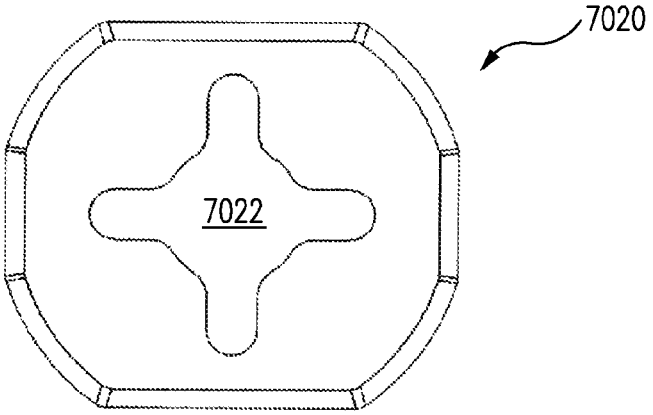
Figure 74C:
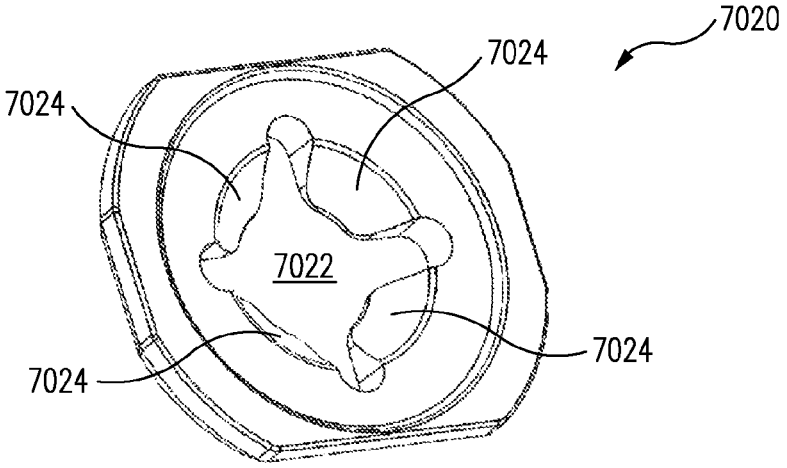

FIGS. 64C-D illustrate various aspects of another wedge attachment mechanism for a gun sight in accordance with embodiments of the invention. In particular, a wedge retaining member 5900C is illustrated which includes similar features as shown in FIGS. 64A-B. Wedge retaining member 5900C may be used with a wedge mounting member (e.g., wedge mounting member 4212C shown in FIGS. 73A-F) having an engagement member (e.g., engagement member 5920C shown in FIG. 73B) in a reversed orientation from that of wedge mounting member 4212B. As shown, wedge retaining member 5900C includes a channel 5930C, a tooth 5950C, a shaft 5952C (e.g., operating along an axis 5960C), a user-operable surface 5954C, a spring 5956C, a recess 5958C, a pin 5970C, and a recess 5972C, which may operate in a similar, but reversed fashion as similar components of FIGS. 64A-B (see FIGS. 70A-B).

As another example, FIGS. 65A-68 illustrate various aspects of a rotary attachment mechanism 6590 for gun sight 4010A/4010B in accordance with embodiments of the invention. In some embodiments, rotary attachment mechanism 6590 may be used in place of wedge attachment mechanism 5990 to releasably attach gun sight 4010A/4010B to gun 4000.

Rotary attachment mechanism 6590 includes a mounting member implemented as a rotary mounting member 6550 (e.g., configured to rotate relative to a retaining member), and also includes a retaining member implemented as a rotary retaining member 6500. Rotary mounting member 6550 is used to releasably attach gun sight 4010A/4010B to rotary retaining member 6500 mounted behind the barrel of gun 4000. In some embodiments, rotary retaining member 6500 may be mounted to slide 4001 of gun 4000. In some embodiments, rotary mounting member 6550 may be attached to gun sight 4010A/4010B by a screw, such as screw 4210A of FIGS. 42A-B.

Rotary mounting member 6550 includes an engagement member 6554 (e.g., having flanges 6552), a pin 6570, a lock member 6572 (e.g., a pin or other device), and a spring 6574 (e.g., a leaf spring in some embodiments). Rotary retaining member 6500 includes an aperture 6502, a pin 6506, and a cavity 6504 bounded at least in part by front and rear walls 6508, and side walls 6510.

Figure 68:
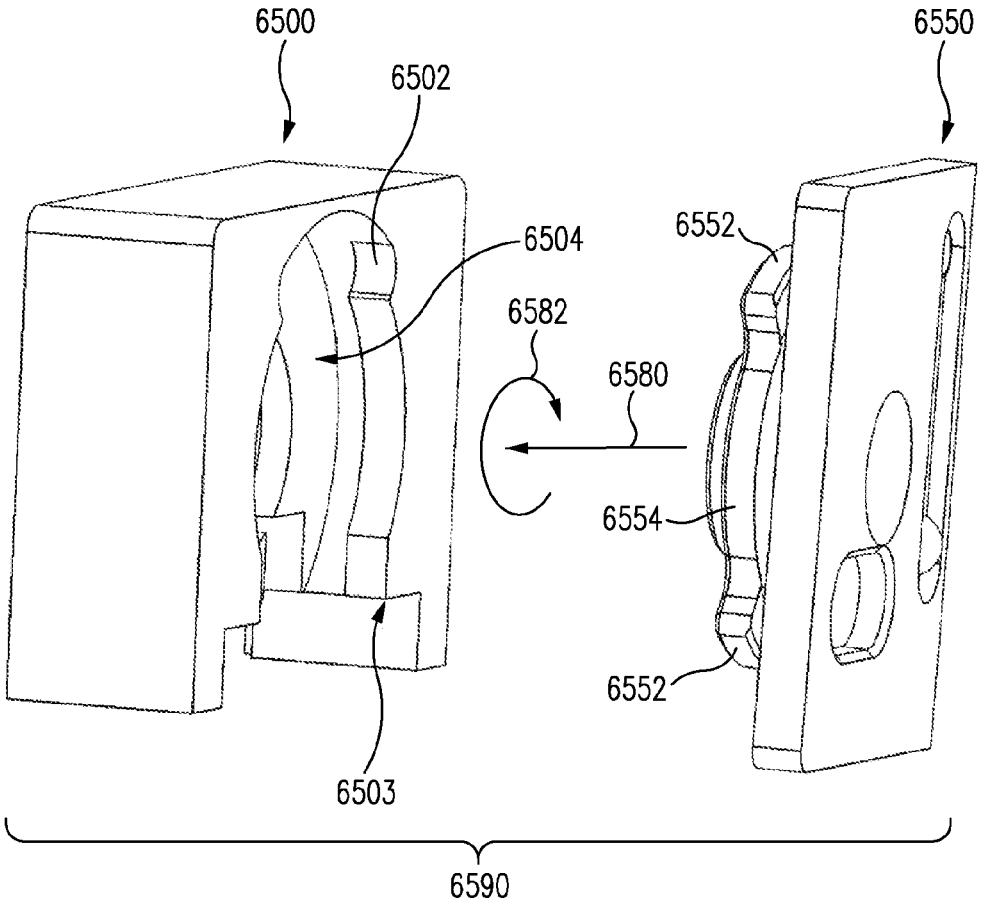

Aperture 6502 is shaped to receive engagement member 6554. In particular, aperture 6502 is shaped to substantially correspond to at least one of flanges 6552 of engagement member 6554. Accordingly, as shown in FIG. 68, rotary mounting member 6550 may be rotated approximately 90 degrees relative to rotary retaining member 6550 such that engagement member 6554 and at least one of flanges 6552 is aligned with aperture 6502. Rotary mounting member 6550 may be moved in the direction of an arrow 6580 until engagement member 6554 is substantially within cavity 6504. Following the insertion of engagement member 6554 into rotary retaining member 6500, rotary mounting member 6550 may be rotated approximately 90 degrees in the direction of an arrow 6582 (e.g., clockwise in some embodiments) to cause one of flanges 6552 to contact pin 6506 within cavity 6504

Figure 65A:
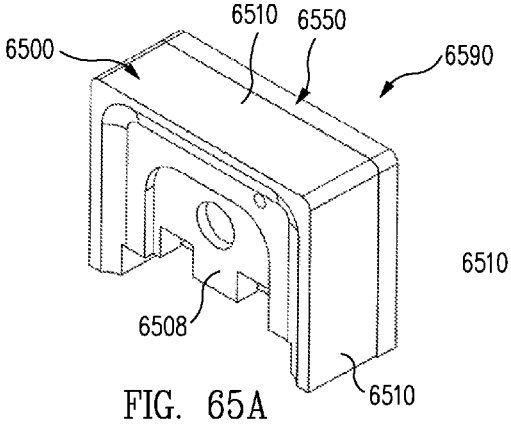
FIGS. 65A-68 illustrate various aspects of a rotary attachment mechanism for a gun sight in accordance with embodiments of the invention.
Figure 65B:
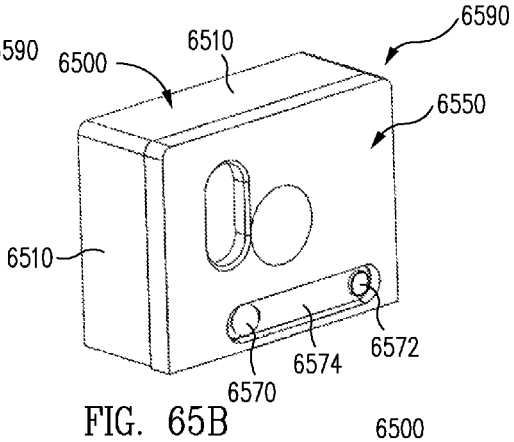
Figure 66A:
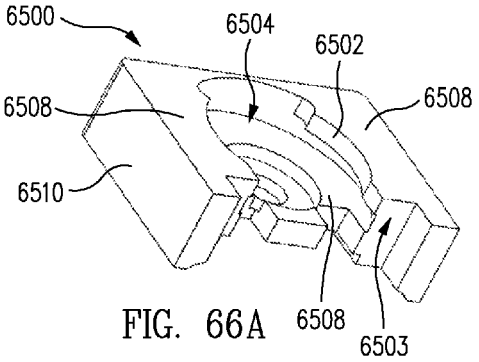
Figure 66B:
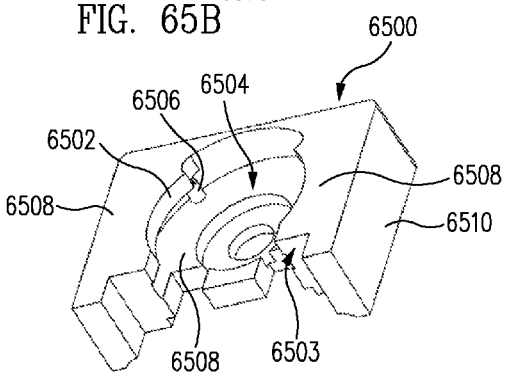
Figure 67A:
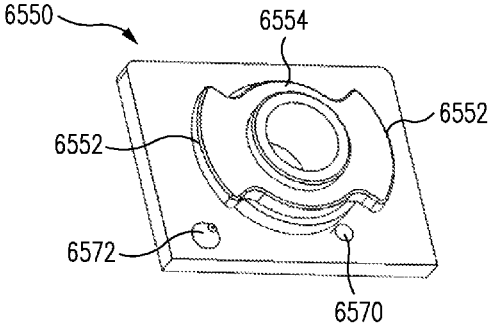
Figure 67B:
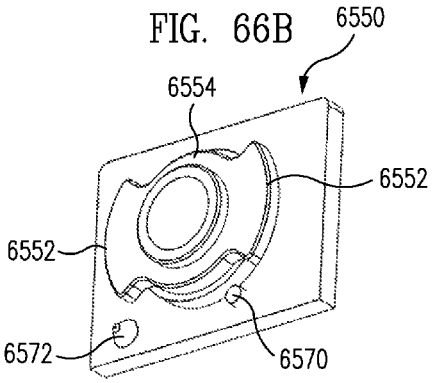

(see FIG. 66B) to align rotary mounting member 6550 and rotary retaining member 6500 with each other in the manner shown in FIGS. 65A-B and bound the rotation of rotary mounting member 6550 and engagement member 6554.

While so aligned, flanges 6552 are disposed between, and retained by, front and rear walls 6508. Also, lock member 6572 (e.g., under tension from spring 6574 which is held by pin 6570) may slide under a recess 6503 (e.g., a lip) of rotary retaining member 6500 to lock rotary mounting member 6550 in place and prevent rotary mounting member 6550 from rotating back (e.g., opposite the direction of arrow 6582). The user may unlock rotary mounting member 6550 from rotary retaining member 6500 by pulling and/or sliding lock member 6572 and/or spring 6574 to withdraw lock member 6572 from lip 6503 which permits rotary mounting member 6550 to be rotated opposite the direction of arrow 6582 for removal from rotary retaining member 6500.

Thus, rotary mounting member 6550 may be selectively engaged and disengaged with rotary retaining member 6500 in a convenient manner through the operation of engagement member 6554, flanges 6552, pin 6506, lock member 6572, and spring 6574. Such a configuration permits gun sight 4010A/4010B to be accurately sighted while being rigidly attached to gun 4000. In addition, adjustment members 4214/4216 are mounted behind rotary mounting member 6550 (e.g., near gun sight 4010A/4010B). As a result, gun sight 4010A/4010B may be selectively attached to and removed from gun 4000 (e.g., through the installation and removal of rotary mounting member 6550 with rotary retaining member 6500 which is attached to the rear of gun 4000) in a secure, rigid manner without requiring the user to resight gun 4000 (e.g., readjust the alignment of gun sight 4010A/4010B) each time gun sight 4010A/4010B is attached and removed.

Figure 69A:
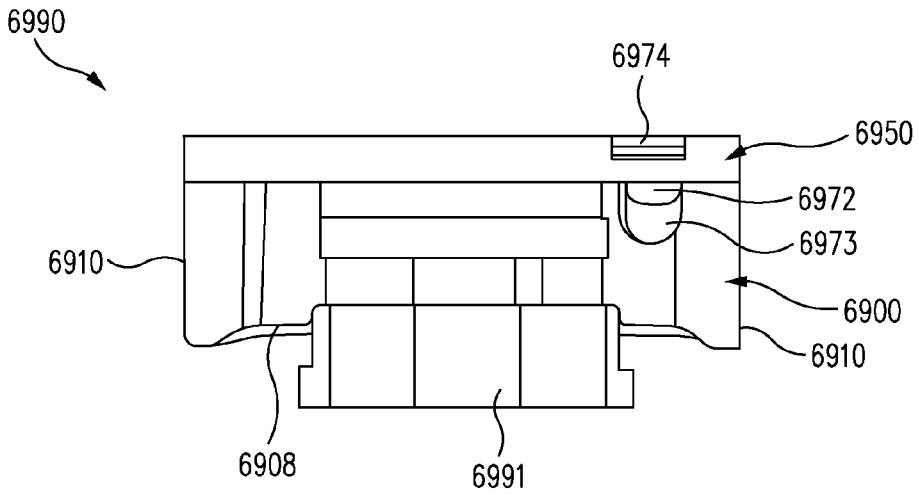
FIGS. 69A-C illustrate various aspects of another rotary attachment mechanism for a gun sight in accordance with embodiments of the invention.
Figure 69B:
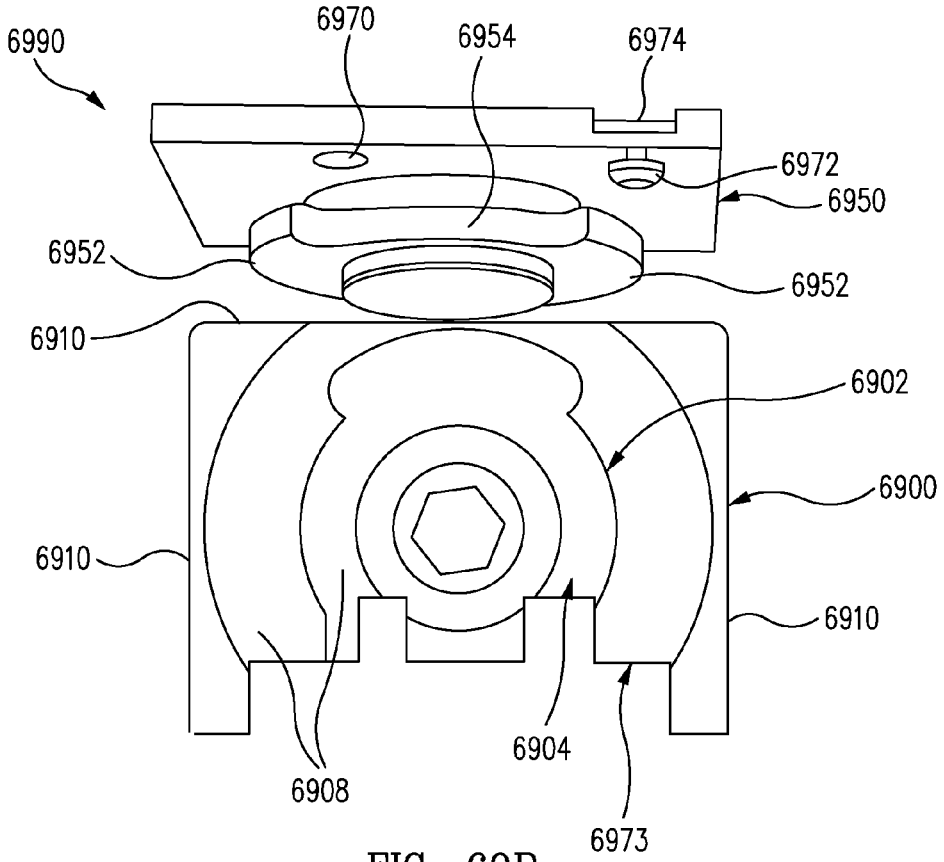
Figure 69C:
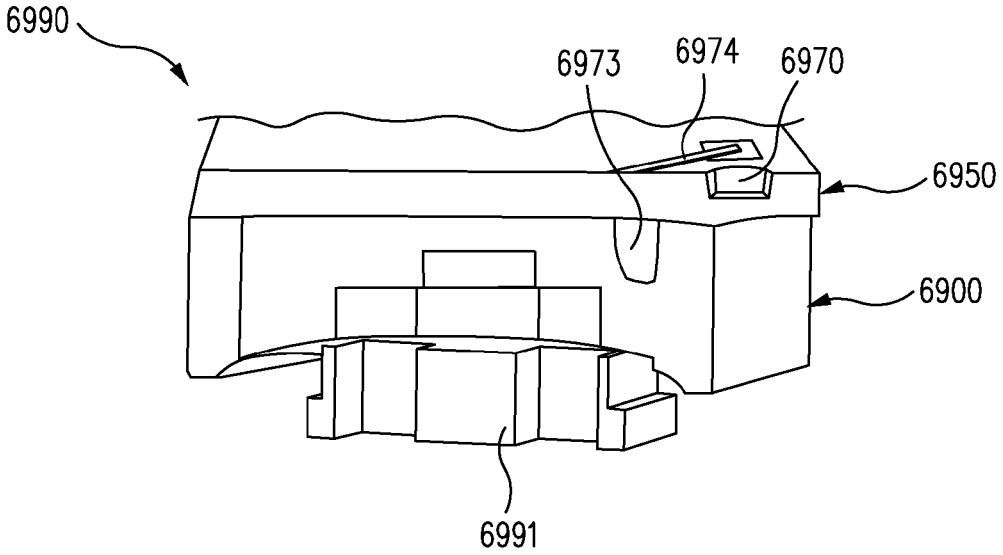

FIGS. 69A-C illustrate various aspects of another rotary attachment mechanism 6990 for a gun sight in accordance with embodiments of the invention. In some embodiments, rotary attachment mechanism 6990 may be used in place of wedge attachment mechanism 5990 or rotary attachment mechanism 6950 to releasably attach gun sight 4010A/4010B to gun 4000.

As shown, rotary attachment mechanism 6990 may be implemented with various similarities to rotary attachment mechanism 6950. For example, rotary attachment mechanism 6990 includes a rotary mounting member 6950 and a rotary retaining member 6900. FIG. 69A illustrates rotary mounting member 6950 installed in rotary retaining member 6900 attached to a gun interface 6991 (e.g., gun interface 6991 may be part of, or used to attach rotary retaining member 6900 to, slide 4001 of gun 4000). FIG. 69B illustrates rotary mounting member 6950 uninstalled from rotary retaining member 6900. FIG. 69C illustrates rotary mounting member 6950 partially installed in rotary retaining member 6900 (e.g., inserted into and partially rotated relative to rotary retaining member 6900), with rotary retaining member 6900 also attached to gun interface 6991.

Rotary mounting member 6950 includes an engagement member 6954 (e.g., having flanges 6952), a pin 6970, a lock member 6972 (e.g., a pin or other device), and a spring 6974 (e.g., a leaf spring in some embodiments). Rotary retaining member 6900 includes an aperture 6902, a pin (not shown) similar to pin 6506, and a cavity 6904 bounded at least in part by front and rear walls 6908, and side walls 6910.

Engagement member 6954 may be inserted into cavity 6904, and rotary mounting member 6950 may be rotated in a similar manner as described with regard to rotary attachment mechanism 6950 to align rotary mounting member 6950 with rotary retaining member 6900 as shown in FIG. 69A. While so aligned, flanges 6952 are disposed between, and retained by, front and rear walls 6908. Also, lock member 6972 (e.g., under tension from spring 6974 which is held by pin 6970) may slide into a recess 6903 of rotary retaining member 6900 to lock rotary mounting member 6950 in place and prevent rotary mounting member 6950 from rotating back. The user may unlock rotary mounting member 6950 from rotary retaining member 6900 by pulling and/or sliding lock member 6972 and/or spring 6974 to withdraw lock member 6972 from lip 6503 which permits rotary mounting member 6550 to be rotated for removal from rotary retaining member 6900.

Thus, rotary mounting member 6950 may be selectively engaged and disengaged with rotary retaining member 6900 in a convenient manner through the operation of engagement member 6954, flanges 6952, pin 6906, lock member 6972, and spring 6974. Such a configuration permits gun sight 4010A/4010B to be accurately sighted while being rigidly attached to gun 4000. In addition, adjustment members 4214/4216 are mounted behind rotary mounting member 6950 (e.g., near gun sight 4010A/4010B). As a result, gun sight 4010A/4010B may be selectively attached to and removed from gun 4000 (e.g., through the installation and removal of rotary mounting member 6950 with rotary retaining member 6900 which is attached to the rear of gun 4000) in a secure, rigid manner without requiring the user to resight gun 4000 (e.g., readjust the alignment of gun sight 4010A/4010B) each time gun sight 4010A/4010B is attached and removed.

Figure 70A:
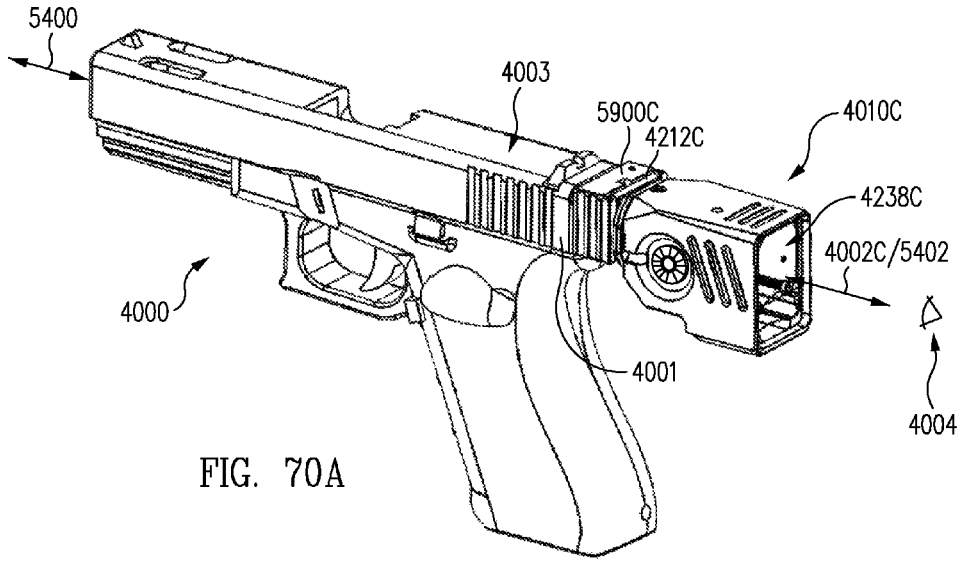
FIGS. 70A-B illustrate various mountings of a gun sight on a gun in accordance with embodiments of the invention.
Figure 70B:
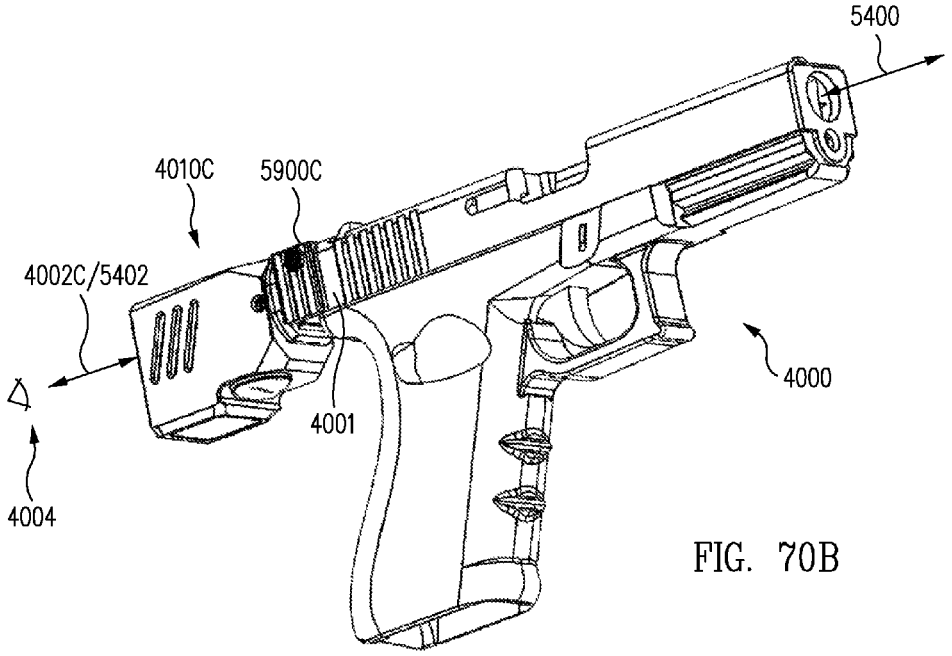

FIGS. 70A-B illustrate various mountings of a gun sight 4010C on gun 4000 in accordance with embodiments of the invention. Gun sight 4010C is positioned behind the barrel of gun 4000 and mounted substantially along axis 5402 that may be adjusted relative to longitudinal axis 5400 of the barrel of gun 4000 in response to the adjustment of one or more user-operable screws 7040A-B as further described herein. In FIGS. 70A-B, axes 5400 and 5402 are aligned with each other.

Figure 72A:
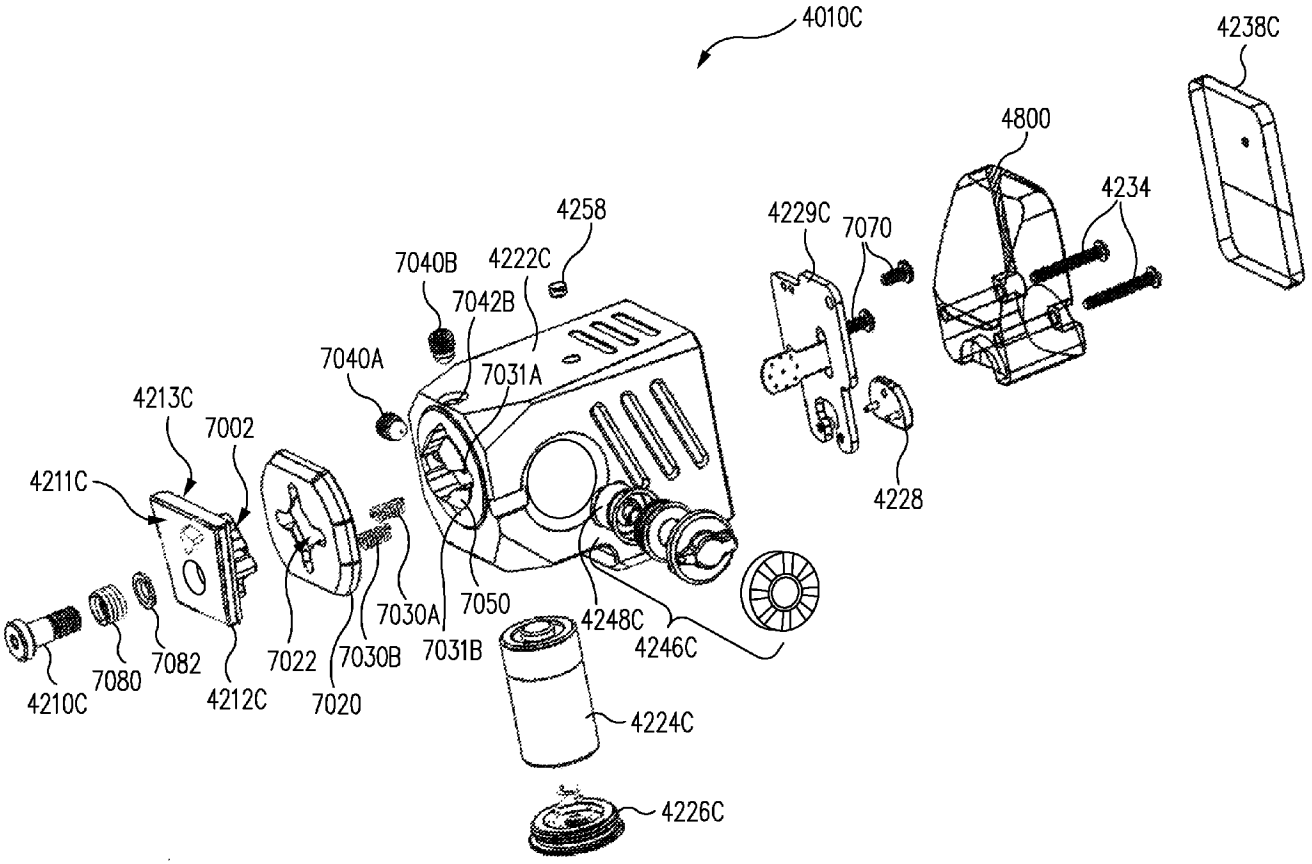
FIGS. 72A-B illustrate exploded views of a gun sight in accordance with embodiments of the invention.
Figure 72B:
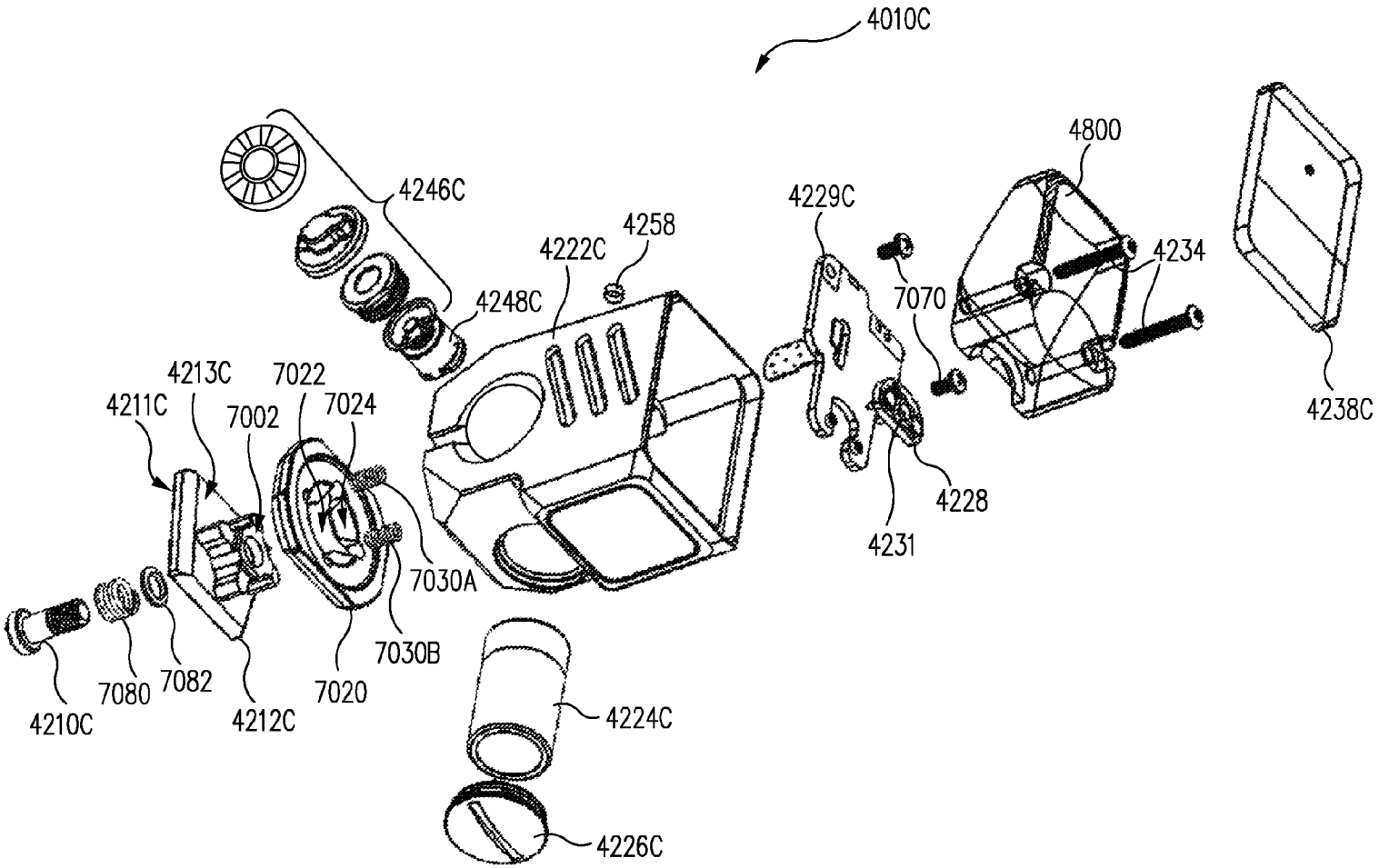

Gun sight 4010C includes light source 4231 (e.g., any type of light source, such as those described herein, see FIG. 72B) that projects light through optical element 4800 (see FIG. 48; one or more optical elements, such as optical element 4232, may be used in other embodiments) to provide a reticle as a collimated beam at a rear window 4238C for viewing by the user along an axis 4002C, which is aligned with axes 5400 and 5402 in FIGS. 70A-B. Gun sight 4010C is implemented as an occluded sight as similarly described for OEG 100 and gun sight 4010B.

Figure 71A:
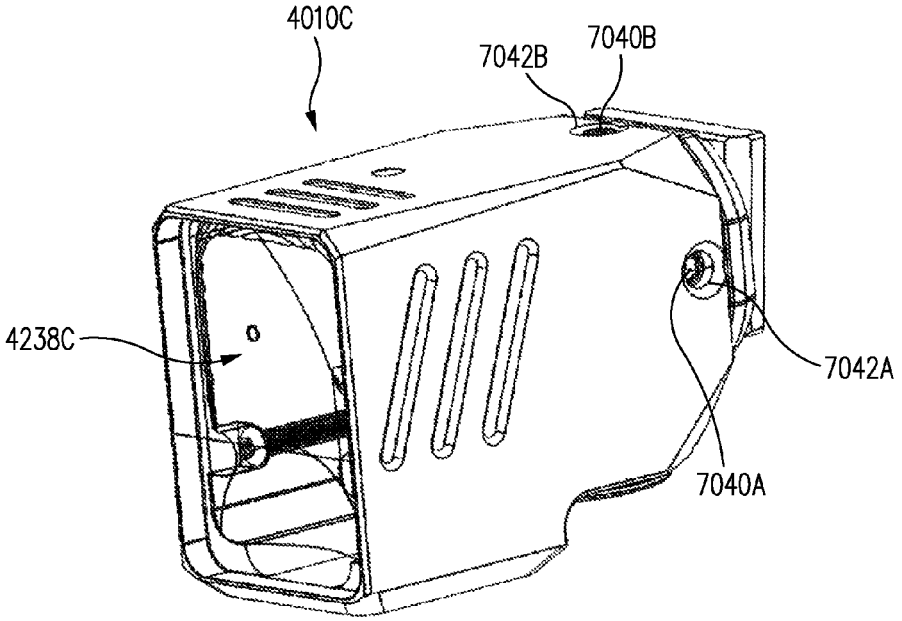
FIGS. 71A-B illustrate isometric views of a gun sight in accordance with embodiments of the invention.
Figure 71B:
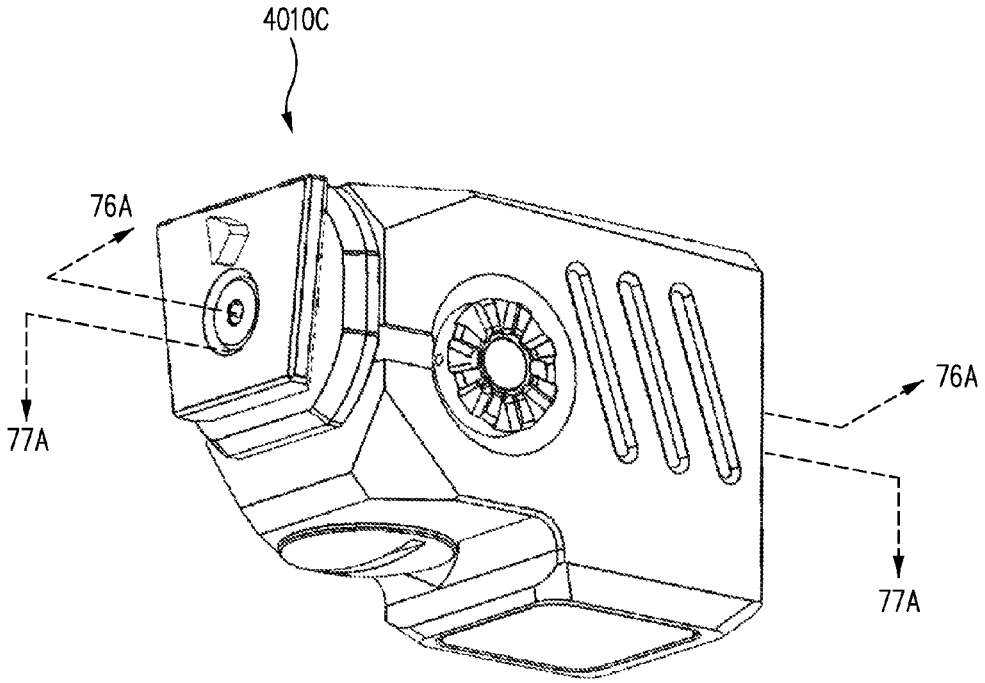

FIGS. 71A-B illustrate isometric views of gun sight 4010C in accordance with embodiments of the invention, and FIGS. 72A-B illustrate exploded views of gun sight 4010C in accordance with embodiments of the invention. As shown, gun sight 4010C includes a housing 4222C configured to receive various components. Optical element 4800 is secured within housing 4222C by screws 4234. Circuit board 4228 is affixed to a circuit board 4229C (e.g., which is secured to housing 4222C by screws 7070) and includes light source 4231 to project light for the reticle into optical element 4800. Battery 4224C provides power to circuitry of gun sight 4010C and is secured within housing 4222C by cover 4226C. In some embodiments, multiple batteries 4224C may be used.

A user-operable knob 4246C actuates a switch 4248C (e.g., an implementation of a user control) to selectively operate light source 4231 and/or other features of gun sight 4010C as similarly described for knob 4246 and switch 4248 of gun sight 4010A. A window 4258 is also provided on a top surface of housing 4222C. Rear window 4238C is positioned in an aperture in housing 4222C.

A wedge mounting member 4212C operates to releasably attach gun sight 4010C to wedge retaining member 5900C behind the barrel of gun 4000 (e.g., wedge retaining member 5900C may be mounted to slide 4001 of gun 4000; see FIGS. 70A-B). Wedge mounting member 4212C includes an aperture for a screw 4210C (e.g., to secure it to housing 4222C) and may also receive a spring 7080 and a washer 7082. As shown, wedge mounting member 4212C includes front and rear surfaces 4211C and 4213C.

FIGS. 73A-75D illustrate an alignment system for gun sight 4010C in accordance with embodiments of the invention. In this regard, wedge mounting member 4212C may be used with various other components to permit azimuth and/or elevation adjustment of gun sight 4010C relative to gun 4000. Screw 4210C may be loosened (e.g., at least partially unscrewed from threads of housing 4222C while still keeping wedge mounting member 4212C attached to housing 4222C in some embodiments) to permit movement of housing 4222C and wedge mounting member 4212C relative to each other in response to springs 7030A-B and screws 7040A-B to adjust azimuth and/or elevation alignment of gun sight 4010C as further described herein. After such adjustment has been made, screw 4210C may be tightened (e.g., screwed into threads of housing 4222C) to secure the alignment.

Figure 75A:
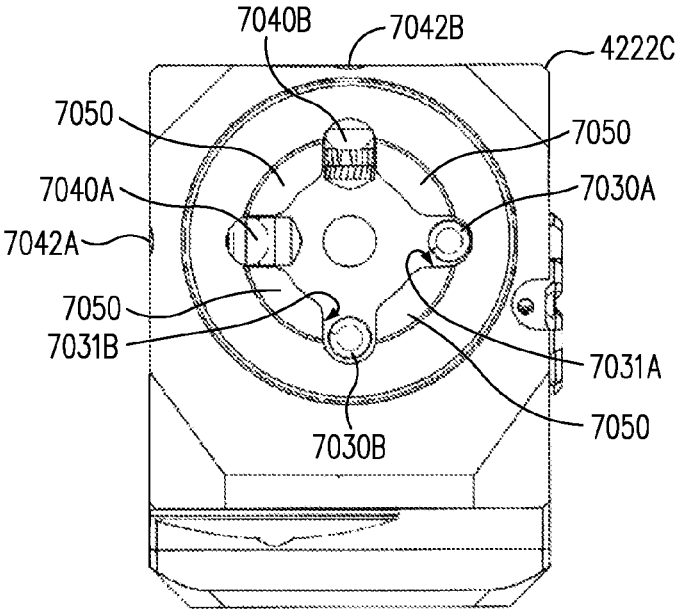
Figure 75B:
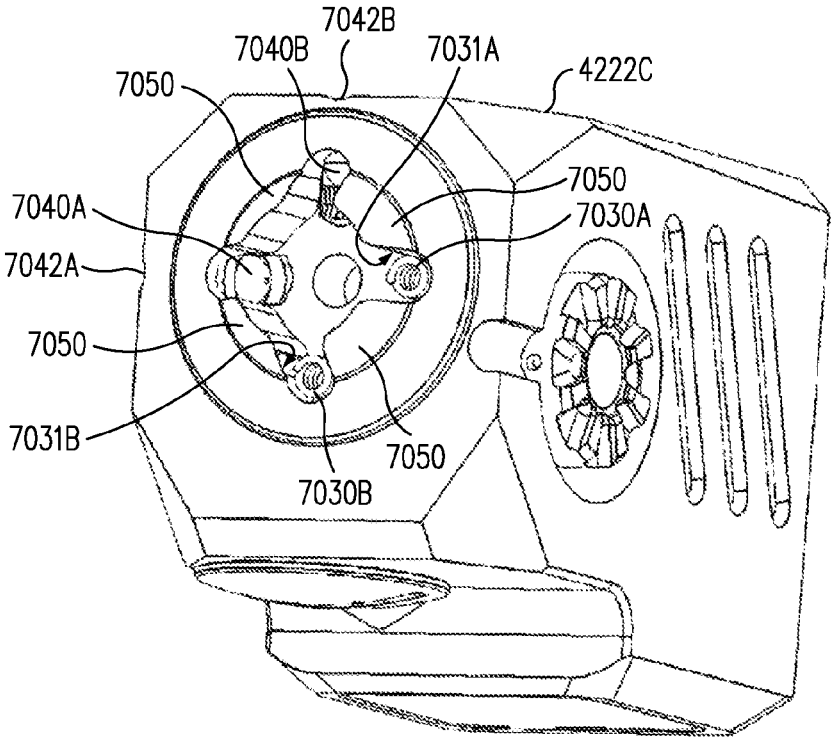
Figure 75C:
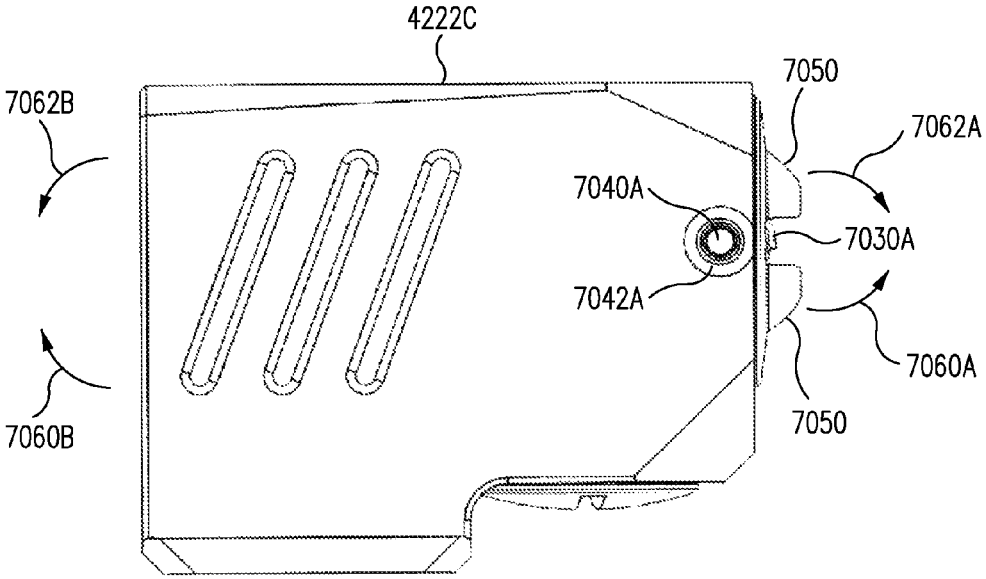
Figure 75D:
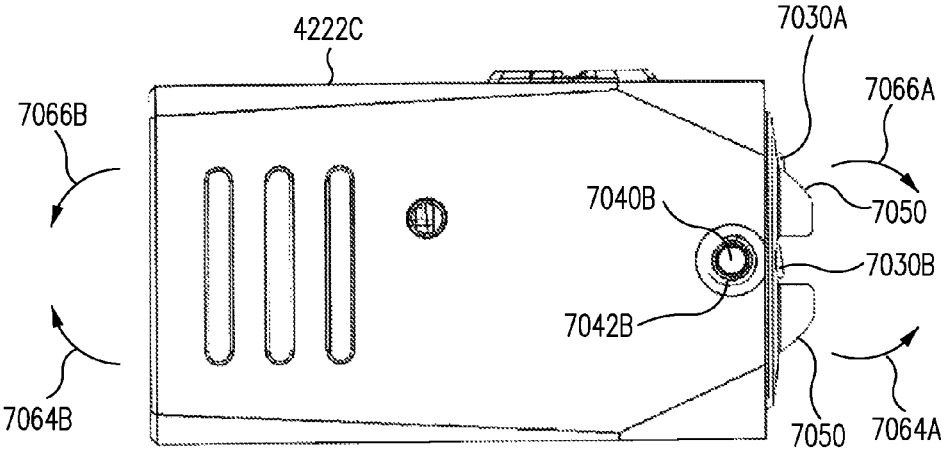

As shown in FIGS. 72A-B and 73A-F, wedge mounting member 4212C includes a generally cross-shaped protrusion 7002 (e.g., alignment member) having a plurality of alignment surfaces 7004A-B and 7006A-B. Springs 7030A-B are provided in recesses 7031A-B of housing 4222C, and screws 7040A-B are provided in apertures 7042A-B of housing 4222C (e.g., which, in some embodiments, may be implemented as part of a larger aperture in housing 4222C as shown in FIGS. 75A-B). Alignment surfaces 7004A and 7004B are configured to contact springs 7030A and 7030B, respectively. Alignment surfaces 7006A and 7006B are configured to contact screws 7040A and 7040B, respectively.

A spacer 7020 is positioned between wedge mounting member 4212C and housing 4222C. As shown in FIGS. 72A-B and 74A-C, spacer 7020 includes an aperture 7022 configured to receive protrusion 7002 therethrough. In this regard, protrusion 7002 may pass through aperture 7022 to expose alignment surfaces 7004A-B and 7006A-B to springs 7030A-B and screws 7040A-B.

While wedge mounting member 4212C is attached to housing 4222C by screw 4210C, alignment surfaces 7004A-B are held in tension against springs 7030A-B. In this regard, springs 7030A-B may become compressed and exert force against housing 4222C and alignment surfaces 7004A-B. For example, spring 7030A may exert force against alignment surface 7004A to push wedge mounting member 4212C and housing 4222C away from each other in the directions of arrows 7066A-B (e.g., in substantially opposite arcs) to adjust an azimuth alignment of gun sight 4010C relative to gun 4000 (e.g., see FIGS. 75D and 77A). Spring 7030B may exert force against alignment surface 7004B to push wedge mounting member 4212C and housing 4222C away from each other in the directions of arrows 7060A-B (e.g., in substantially opposite arcs) to adjust an elevation alignment of gun sight 4010C relative to gun 4000 (e.g., see FIGS. 75C and 76A).

Screws 7040A-B may be selectively operated by a user to counteract the forces exerted by springs 7030A-B. For example, screw 7040A may exert force against alignment surface 7006A to push wedge mounting member 4212C and housing 4222C away from each other in the directions arrows 7064A-B (e.g., in substantially opposite arcs) to adjust the azimuth alignment of gun sight 4010C relative to gun 4000 in a manner substantially opposite to arrows 7066A-B (e.g., see FIGS. 75D and 77A-B). Screw 7040B may exert force against alignment surface 7006B to push wedge mounting member 4212C and housing 4222C away from each other in the directions of arrows 7062A-B (e.g., in substantially opposite arcs) to adjust the elevation alignment of gun sight 4010C relative to gun 4000 in a manner substantially opposite to arrows 7060A-B (e.g., see FIGS. 75C and 76A-B).

Alignment surfaces 7006A-B may be beveled, chamfered, and/or otherwise inclined (e.g., see FIGS. 73C-F). Accordingly, as screws 7040A-B are further advanced (e.g., screwed) into threads of housing 4222C, screws 7040A-B push further against alignment surfaces 7006A-B, thus causing wedge mounting member 4212C and housing 4222C to rotate relative to each other in the directions of arrows 7064A-B and 7062A-B and counteract the rotational forces exerted by springs 7030A-B.

Figure 76B:
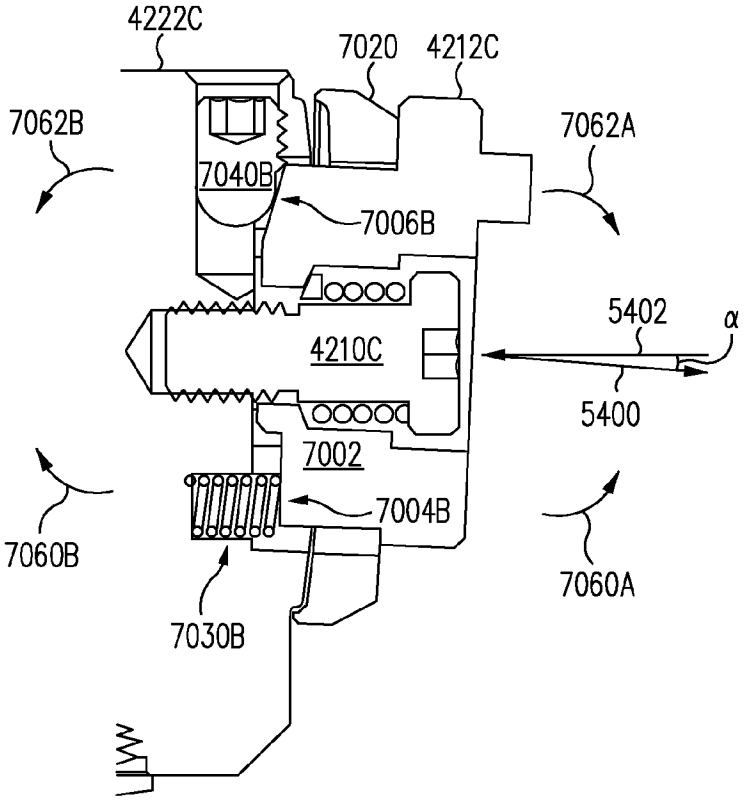
FIGS. 76A-B illustrate cross-sectional views through the gun sight of FIG. 71B as seen along the lines 76A-76A taken therein in accordance with embodiments of the invention.
Figure 76A:
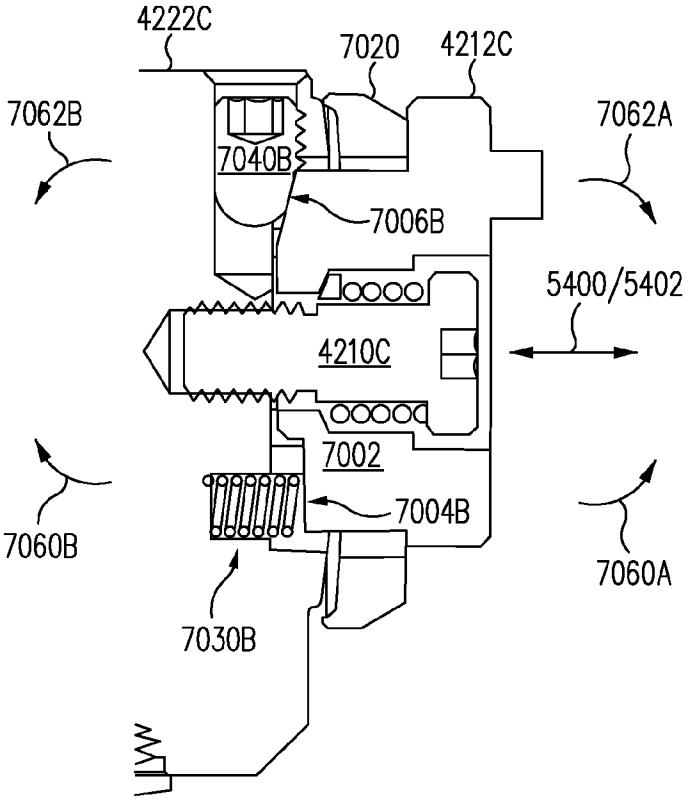

For example, in the side cross-sectional view of FIG. 76A, spring 7030B and screw 7040B exert substantially equal forces against alignment surfaces 7004B and 7006B, respectively. As a result, the mounting axis 5402 of gun sight 4010C is substantially aligned in the same horizontal plane as the longitudinal axis 5400 of the barrel of gun 4000.

In the side cross-sectional view of FIG. 76B, screw 7040B has been further advanced into threads of housing 4222C to push further down onto alignment surface 7006B. This advancement of screw 7040B counteracts the force exerted by spring 7030B, thus causing the mounting axis 5402 of gun sight 4010C to be adjusted relative to the longitudinal axis 5400 of the barrel of gun 4000 by an angle alpha as screw 7040B causes wedge mounting member 4212C and housing 4222C to rotate relative to each other in the directions of arrows 7062A-B.

Figure 77B:
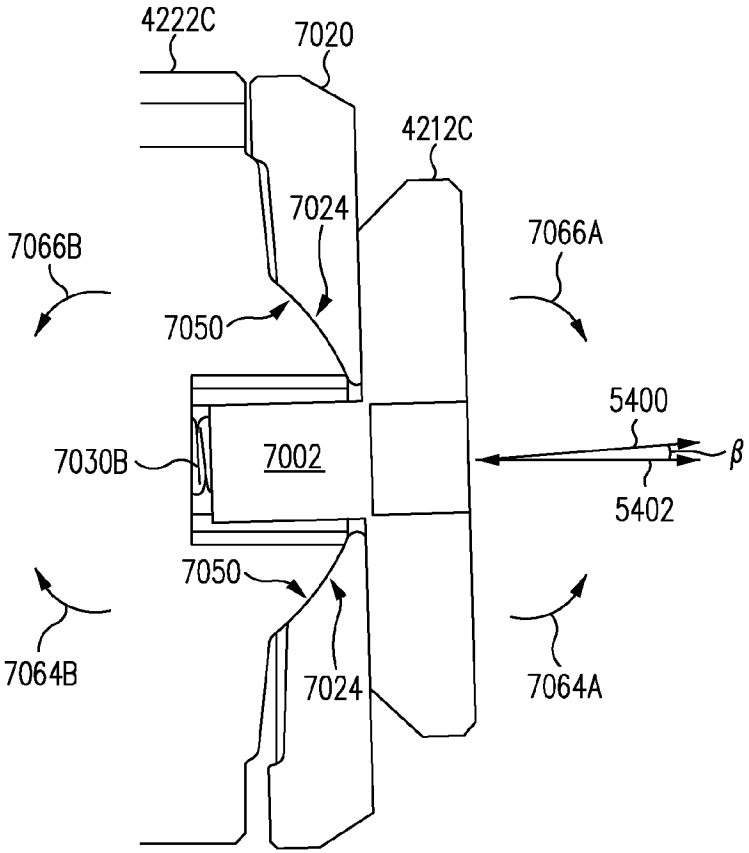
FIGS. 77A-B illustrate cross-sectional views through the gun sight of FIG. 71B as seen along the lines 77A-77A taken therein in accordance with embodiments of the invention.
Figure 77A:
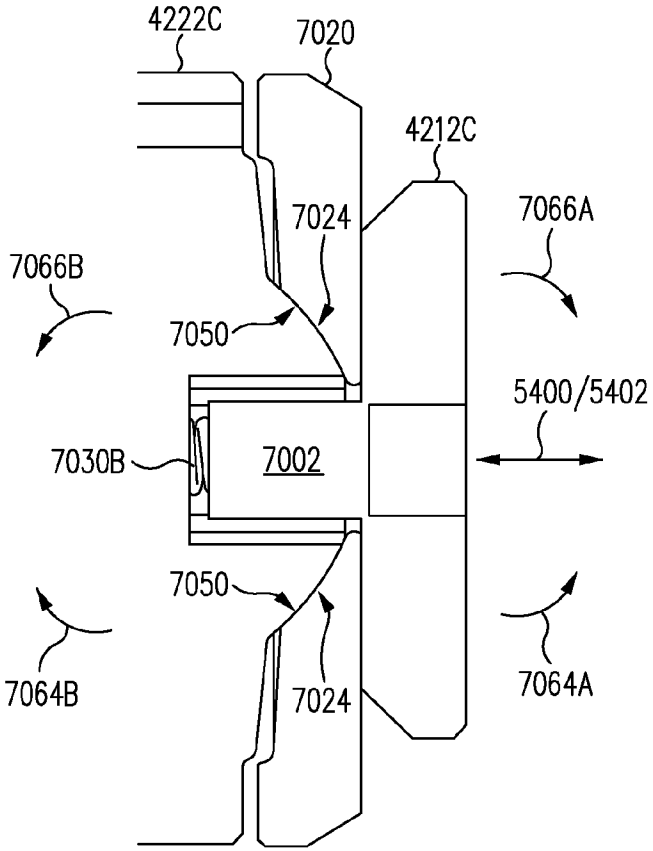

In the top cross-sectional view of FIG. 77A, spring 7030A and screw 7040A exert substantially equal forces against alignment surfaces 7004A and 7006A, respectively (e.g., some of the described components illustrated in other figures are not shown in FIGS. 77A-B but the effects of the described configurations are shown). As a result, the mounting axis 5402 of gun sight 4010C is substantially aligned in the same vertical plane as the longitudinal axis 5400 of the barrel of gun 4000.

In the top cross-sectional view of FIG. 77B, screw 7040A has been further advanced into threads of housing 4222C to push further down onto alignment surface 7006A. This advancement of screw 7040A counteracts the force exerted by spring 7030A, thus causing the mounting axis 5402 of gun sight 4010C to be adjusted relative to the longitudinal axis 5400 of the barrel of gun 4000 by an angle beta as screw 7040A causes wedge mounting member 4212C and housing 4222C to rotate relative to each other in the directions of arrows 7064A-B.

As screws 7040A-B are unscrewed from threads of housing 4222C, screws 7040A-B exert less force (or no force at all), thus causing less (or no) relative rotation of housing 4222C and wedge mounting member 4212C in the directions of arrows 7064A-B and 7062A-B. Springs 7030A-B may remain in tension against alignment surfaces 7004A-B. Thus, as screws 7040A-B are unscrewed, springs 7030A-B may cause wedge mounting member 4212C and housing 4222C to rotate relative to each other in the directions of arrows 7066A-B and 7060A-B as discussed.

Thus, by selectively operating screws 7040A-B, a user may adjust the azimuth and/or elevation alignment of gun sight 4010C relative to gun 4000. In this regard, such operations may adjust the mounting axis 5402 of gun sight 4010C relative to the longitudinal axis 5400 of the barrel of gun 4000.

The orientation of axis 4002C along which the reticle is projected to the user is substantially parallel to mounting axis 5402 and is thus also adjusted as the alignment of gun sight 4010C changes. In some embodiments, such configurations may permit an azimuth adjustment over a range of approximately +3 degrees to approximately −3 degrees, and an elevation adjustment over a range of approximately +3 degrees to approximately −3 degrees.

Spacer 7020 and housing 4222C are configured to permit relative movement of wedge mounting member 4212C and housing 4222C. As shown in FIGS. 74 A and 74C, spacer 7020 includes substantially concave recessed surfaces 7024. As shown in FIGS. 75A-D, housing 4222C includes substantially rounded surfaces 7050. In some embodiments, surfaces 7024 and 7050 may exhibit complimentary substantially spherical contours.

Surfaces 7024 and 7050 are configured to slide against each other in a ball-and-socket arrangement as the azimuth and elevation alignment of gun sight 4010C are adjusted. For example, as shown the top cross-sectional views of FIGS. 77A-B, surfaces 7024 and 7050 are slideably engaged with each other to permit rotation of wedge mounting member 4212C relative to housing 4222C.

Figure 78A:
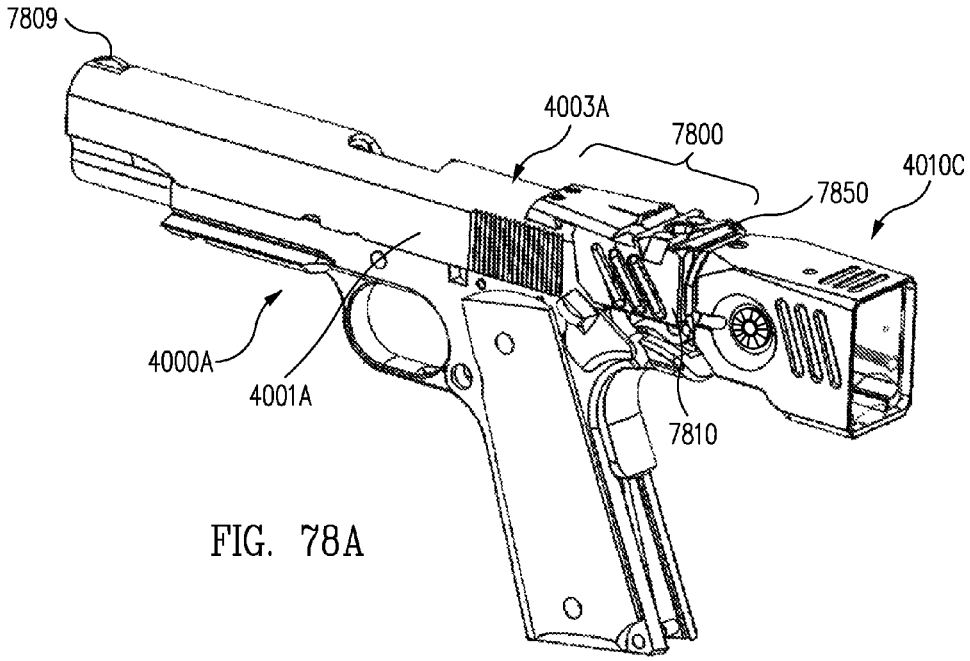
FIGS. 78A-B illustrate various mountings of a gun sight on a gun in accordance with embodiments of the invention.
Figure 78B:
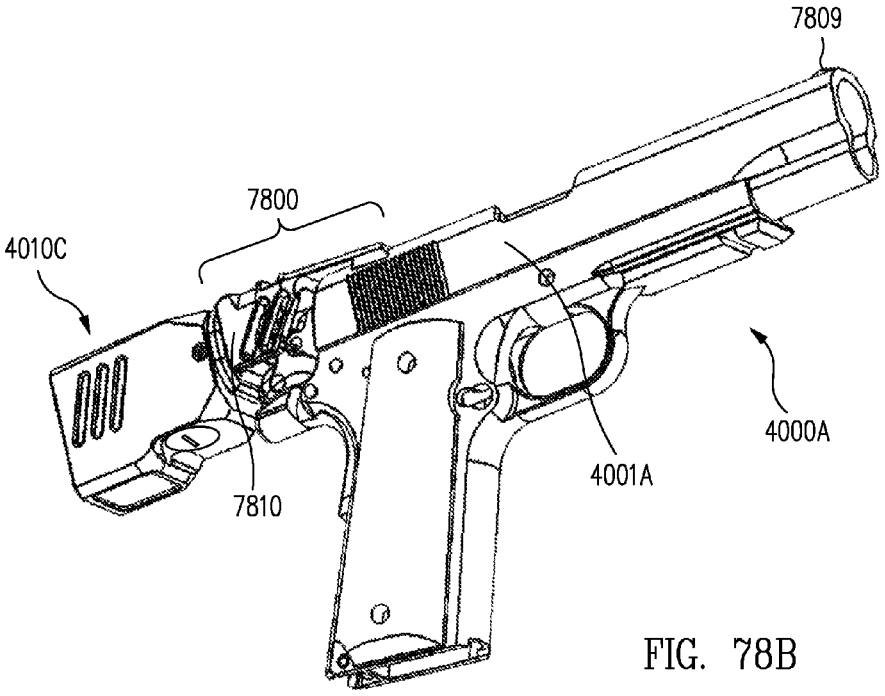

Other attachment mechanisms may be used to releasably attach a gun sight behind a barrel of a gun. For example, FIGS. 78A-B illustrate various mountings of gun sight 4010C on a gun 4000A in accordance with embodiments of the invention. Gun sight 4010C may be releasably attached to (e.g., mounted on) gun 4000A using an attachment mechanism 7800. Gun sight 4010C is positioned behind the barrel of gun 4000A while attached and may be adjusted in the manner previously described.

Figure 79:
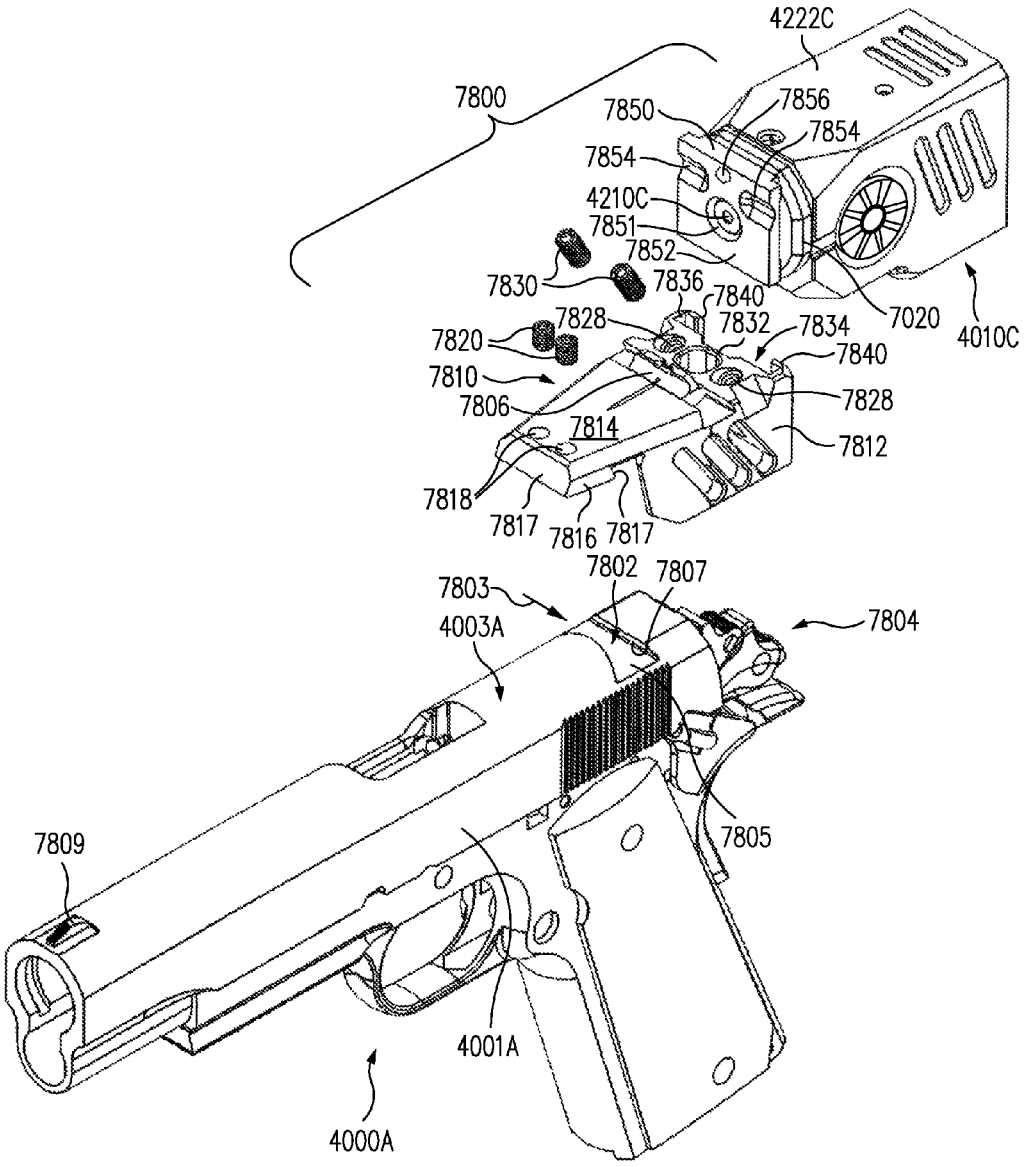
FIG. 79 illustrates an exploded view of an attachment mechanism for a gun sight in accordance with an embodiment of the invention.
Figure 80B:
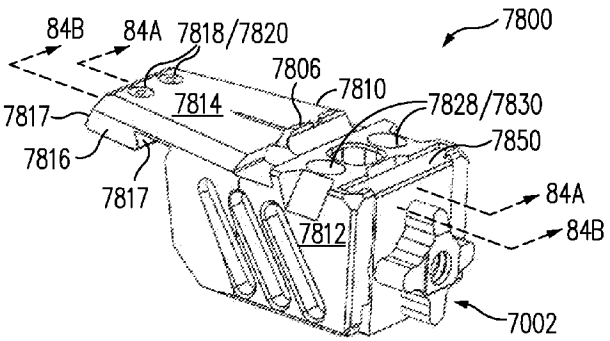
FIGS. 80A-82B illustrate various assembled and disassembled views of an attachment mechanism for a gun sight in accordance with embodiments of the invention.
Figure 80A:
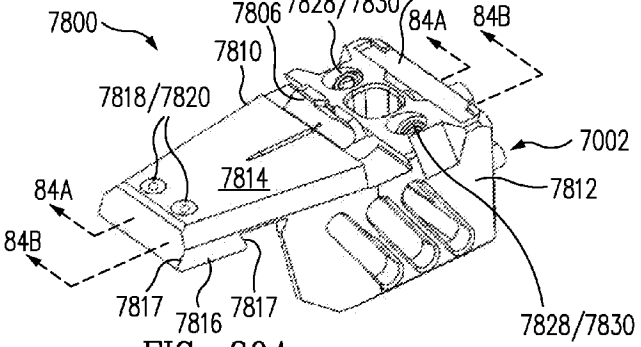
Figure 81B:
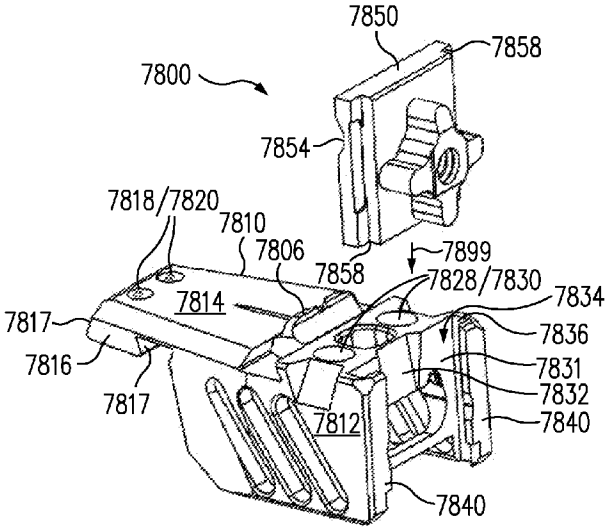
Figure 81A:
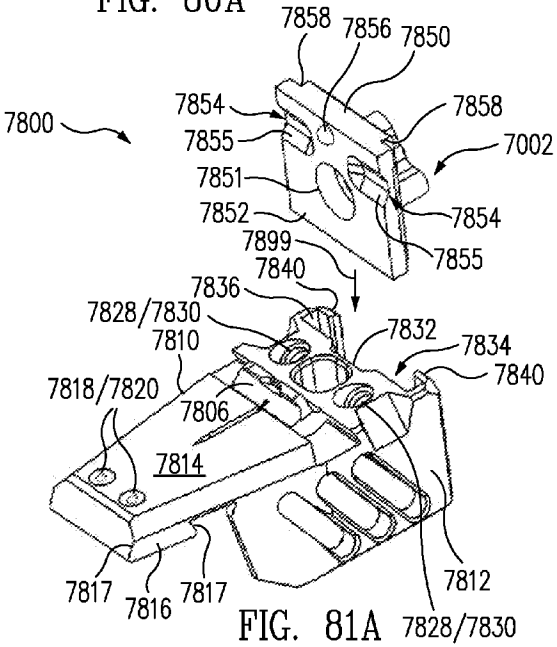
Figure 82A:
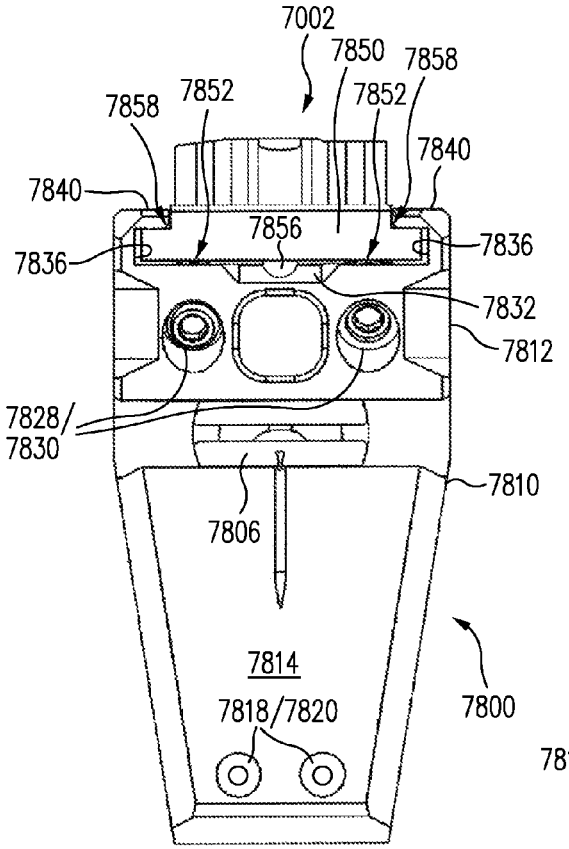
Figure 82B:
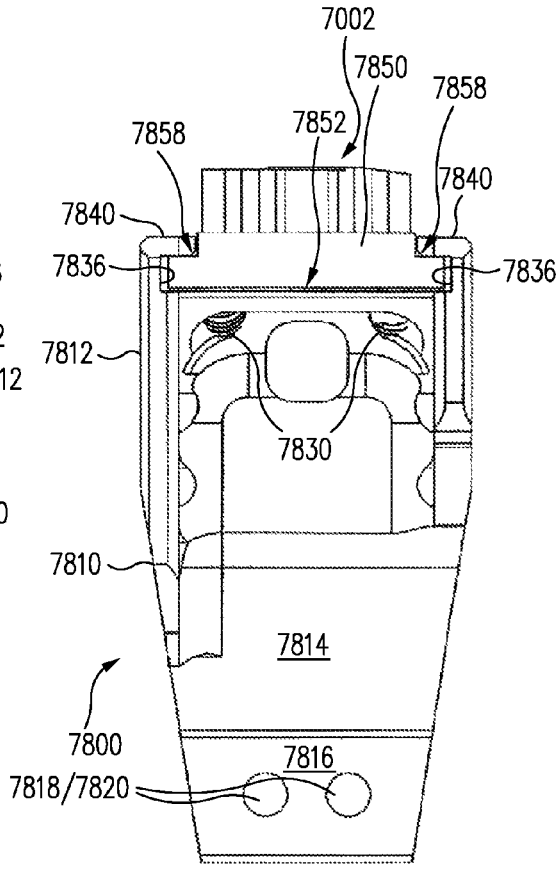
Figure 83A:
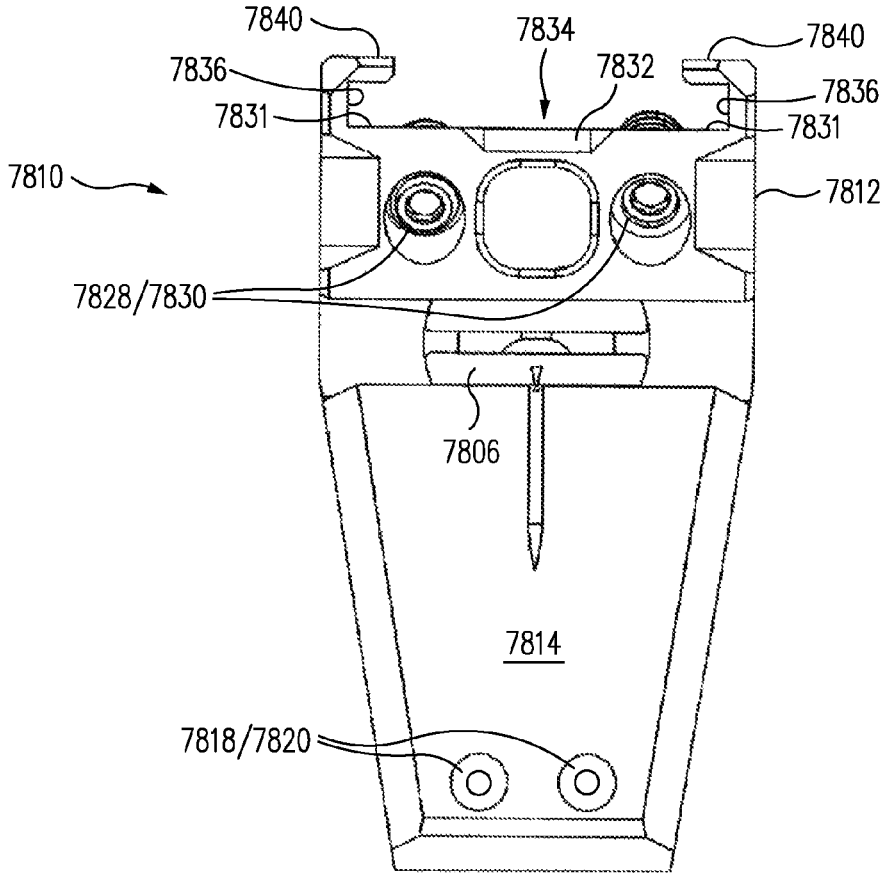
FIGS. 83A-83B illustrate various views of a retaining member of an attachment mechanism for a gun sight in accordance with embodiments of the invention.
Figure 83B:
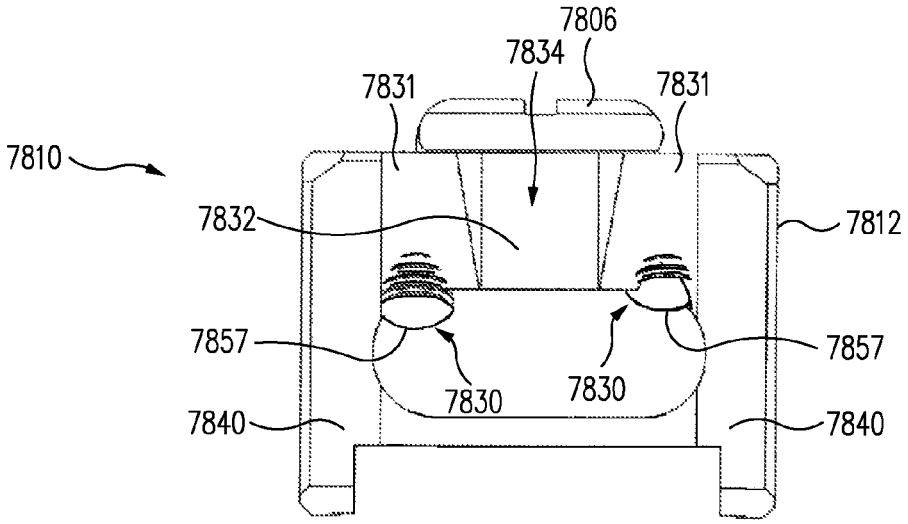
Figure 84A:
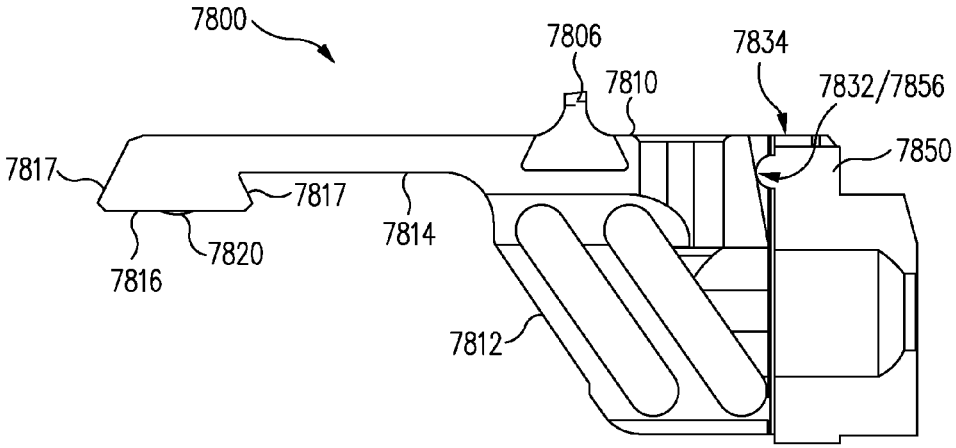
FIG. 84A illustrates a cross-sectional view through the attachment mechanism of FIGS. 80A-B as seen along the lines 84A-84A taken therein in accordance with an embodiment of the invention.
Figure 84B:
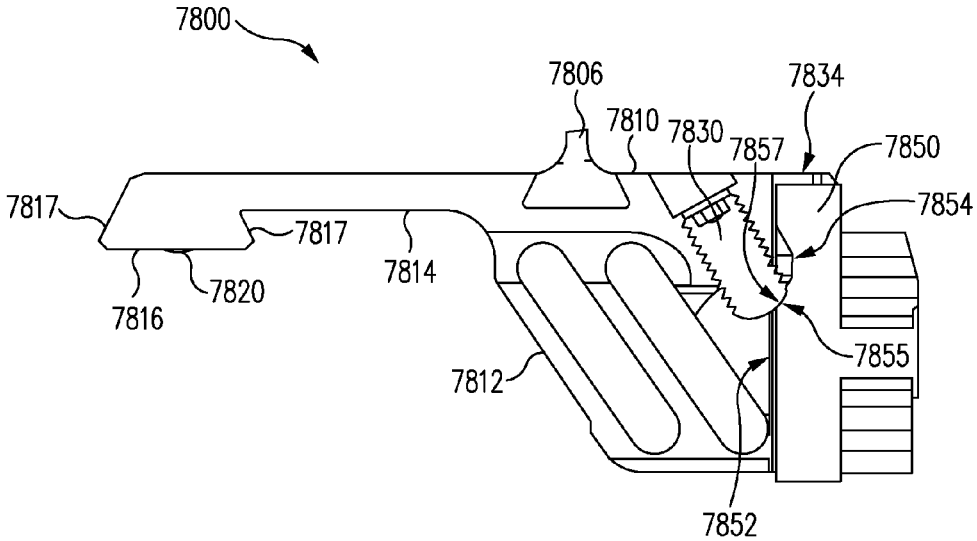
FIG. 84B illustrates a cross-sectional view through the attachment mechanism of FIGS. 80A-B as seen along the lines 84B-84B taken therein in accordance with an embodiment of the invention.

FIG. 79 illustrates an exploded view of attachment mechanism 7800 in accordance with an embodiment of the invention. FIGS. 80A-82B illustrate various assembled and disassembled views of attachment mechanism 7800 in accordance with embodiments of the invention. FIGS. 83A-83B illustrate various views of a retaining member 7810 of attachment mechanism 7800 in accordance with embodiments of the invention. FIG. 84A illustrates a cross-sectional view through attachment mechanism 7800 of FIGS. 80A-B as seen along the lines 84A-84A taken therein in accordance with an embodiment of the invention. FIG. 84B illustrates a cross-sectional view through attachment mechanism 7800 of FIGS. 80A-B as seen along the lines 84B-84B taken therein in accordance with an embodiment of the invention.

Although FIGS. 78A-84B are described with regard to gun 4000A, gun sight 4010C, and attachment mechanism 7800, any of the various guns, gun sights, attachment mechanisms, and/or other components described herein may be combined as appropriate.

Referring now to FIGS. 78A-84B, attachment mechanism 7800 includes a retaining member 7810, a mounting member 7850, screws 7820, and screws 7830. Retaining member 7810 includes a cantilevered portion 7814 that is configured to be positioned generally over a portion of a top surface 4003A of a slide 4001A of gun 4000A (e.g., see FIGS. 78A-B). Cantilevered portion 7814 includes a tongue 7816 configured to engage a recess 7802 in top surface 4003A of slide 4001A. For example, in some embodiments, tongue 7816 may slide laterally (e.g., horizontally) into recess 7802 in the direction of an arrow 7803 (e.g., see FIG. 79). In some embodiments, tongue 7816 and recess 7802 may exhibit complementary dovetail shapes to prevent tongue 7816 from moving vertically relative to recess 7802. Although particular contours are illustrated for tongue 7816 and recess 7802 in FIG. 79, any desired implementation may be used (e.g., tongue/groove, pin/tail, and/or other implementations).

Cantilevered portion 7814 also includes threaded apertures 7818 configured to receive screws 7820. After tongue 7816 has been inserted into recess 7802, screws 7820 may be tightened against a lower surface 7805 of recess 7802. For example, as shown in FIGS. 84A-B, screws 7820 may extend through and protrude out the bottom side of tongue 7816. This permits screws 7820 to contact lower surface 7805 of recess 7802. As screws 7820 are tightened and push against lower surface 7805, angled external surfaces 7817 of tongue 7816 push against angled internal surfaces 7807 of recess 7802. As a result, tongue 7816 is held in tension within recess 7802 to secure retaining member 7810 to slide 4003A of gun 4000A.

Retaining member 7810 also includes a back end portion 7812 that is configured to be positioned generally behind slide 4003A and proximate a hammer 7804 of gun 4000A (e.g., see FIGS. 78A-B and 79). Back end portion 7812 includes threaded apertures 7828 configured to receive screws 7830. When tightened, screws 7830 may protrude into a cavity 7834 (e.g., see FIGS. 83A-B). Cavity 7834 may be bounded by, for example: rear surfaces 7831 and 7832 of retaining member 7810; inner surfaces 7836 of retaining member 7810; and flanges 7840 of retaining member 7810. In some embodiments, screws 7830 may protrude substantially the same distance into cavity 7834, or may be tightened differently to protrude at different distances.

In some embodiments, retaining member 7810 also includes a rear sight 7806 which may be used with a front sight 7809 to aim gun 4000A. In various embodiments, sights 7806/7809 may be used in addition to or instead of gun sight 4010C. For example, sights 7806/7809 may be used while gun sight 4010C is removed.

Mounting member 7850 is configured to be inserted into cavity 7834 of retaining member 7810. For example, in some embodiments, mounting member 7850 may be lowered into retaining member 7810 in the direction of an arrow 7899 (e.g., see FIGS. 81A-B) which is substantially perpendicular to top surface 4003A of slide 4001A).

Mounting member 7850 includes an aperture 7851, protrusion 7002, a front surface 7852, recesses 7854, an engagement member 7856, and grooves 7858 in side and/or rear surfaces thereof. Aperture 7851 is configured to receive screw 4210C (e.g., to secure mounting member 7850 to housing 4222C in front of spacer 7020) and may also receive spring 7080 and washer 7082 as previously described. Rear protrusion 7002 may be implemented as previously described.

As mounting member 7850 is inserted into cavity 7834, front surface 7852 of mounting member 7850 slides against rear surface 7831 of retaining member 7810, and grooves 7858 receive and slide against flanges 7840 in a complementary fashion. Mounting member 7850 continues to slide into cavity 7834 until engagement member 7856 (e.g., exhibiting a substantially hemispherical engagement surface in some embodiments) contacts tapered rear surface 7832 of retaining member 7810 (e.g., see FIG. 84A), thus preventing further downward travel of mounting member 7850 relative to retaining member 7810 (e.g., to determine a maximum insertion depth of mounting member 7850 within cavity 7834 and a vertical position of gun sight 4010C).

Mounting member 7850 may then be secured within cavity 7834 by screws 7830. In this regard, as screws 7830 are tightened and protrude into cavity 7834, they engage with recesses 7854 in front surface 7852 of mounting member 7850 to prevent mounting member 7850 from being withdrawn from retaining member 7810 (e.g., see FIG. 84B). As a result, mounting member 7850 (and thus gun sight 4010C attached thereto) may be secured to gun 4000A. As shown in FIG. 84B, recesses 7854 may include receiving surfaces 7855 that are inclined relative to front surface 7852 of mounting member 7850 and complementary to bottom surfaces 7857 of screws 7830.

Gun sight 4010C may be subsequently aligned and operated using any of the various techniques described herein, as appropriate.

Any of the various features described herein may be combined in one or more embodiments as desired to implement various devices, methods, and/or other embodiments. For example, the various sighting techniques, mounting techniques, sighting techniques and/or other features referenced herein may be used with any of the various gun sights described herein and/or other gun sights as appropriate.

Where applicable, the various components set forth herein can be combined into composite components and/or separated into sub-components without departing from the spirit of the present invention. Similarly, where applicable, the ordering of various steps described herein can be changed, combined into composite steps, and/or separated into sub-steps to provide features described herein.

Embodiments described above illustrate but do not limit the invention. It should also be understood that numerous modifications and variations are possible in accordance with the principles of the present invention. Accordingly, the scope of the invention is defined only by the following claims.

What is claimed is:

1. A gun sight comprising:
a light source adapted to project light;
a user-viewable interface; and
an optical element comprising:
a substantially central external surface adapted to pass the light to provide a reticle at a substantially central area of the user-viewable interface, and
a substantially peripheral external surface adapted to refract the light to provide a guide at a peripheral area of the user-viewable interface to aid a user to reposition the gun sight to view the reticle.

2. The gun sight of claim 1, wherein:
the guide is visible to the user and the reticle is not visible to the user while the gun sight is at a first position;
the guide is visible to the user and the reticle is also visible to the user while the gun sight is at a second position; and
the guide remains continuously visible to the user as the user moves the gun sight from the first position to the second position.

3. The gun sight of claim 1, wherein the substantially peripheral external surface is one of a plurality of substantially peripheral external surfaces adapted to refract the light to provide guides at a plurality of peripheral areas of the user-viewable interface to aid the user to reposition the gun sight to view the reticle.

4. The gun sight of claim 3, wherein the peripheral areas comprise at least two sides of the user-viewable interface.

5. The gun sight of claim 1, wherein the substantially peripheral external surface comprises a plurality of non-uniformities adapted to refract the light as desired.

6. The gun sight of claim 5, wherein the non-uniformities comprise machined portions of the substantially peripheral external surface.

7. The gun sight of claim 1, wherein the optical element is adapted to project the reticle from the user-viewable interface as a collimated beam.

8. The gun sight of claim 1, wherein the reticle is a luminous disk.

9. The gun sight of claim 1, wherein the reticle is a red dot.

10. The gun sight of claim 1, further comprising a user control adapted to adjust an intensity of the reticle.

11. The gun sight of claim 1, wherein the gun sight is an occluded sight adapted to provide the reticle substantially co-axially aligned with a longitudinal axis of a barrel of a gun for use in aiming the gun.

12. The gun sight of claim 1, wherein the gun sight is a reflex sight adapted to superimpose the reticle over a target field for use in aiming a gun.

13. The gun sight of claim 1, further comprising a magnetometer adapted to provide a signal to adjust an operation of the gun sight based on a proximity of the magnetometer to a magnet of a holster.

14. The gun sight of claim 1, wherein the gun sight is adapted to be releasably attached to a gun by an attachment mechanism comprising a retaining member and a mounting member.

15. A method of operating a gun sight, the method comprising:
projecting light from a light source;
passing the light through a substantially central external surface of an optical element to provide a reticle at a substantially central area of a user-viewable interface; and
refracting the light by a substantially peripheral external surface of the optical element to provide a guide at a peripheral area of the user-viewable interface to aid a user to reposition the gun sight to view the reticle.

16. The method of claim 15, wherein:
the guide is visible to the user and the reticle is not visible to the user while the gun sight is at a first position;
the guide is visible to the user and the reticle is also visible to the user while the gun sight is at a second position; and
the guide remains continuously visible to the user as the user moves the gun sight from the first position to the second position.

17. The method of claim 15, wherein the substantially peripheral external surface is one of a plurality of substantially peripheral external surfaces, the method further comprising refracting the light by the substantially peripheral external surfaces to provide guides at a plurality of peripheral areas of the user-viewable interface to aid the user to reposition the gun sight to view the reticle.

18. The method of claim 17, wherein the peripheral areas comprise at least two sides of the user-viewable interface.

19. The method of claim 15, wherein the refracting comprises refracting the light by a plurality of non-uniformities of the substantially peripheral external surface.

20. The method of claim 19, wherein the non-uniformities comprise machined portions of the substantially peripheral external surface.

21. The method of claim 15, wherein the passing comprises projecting the reticle from the user-viewable interface as a collimated beam.

22. The method of claim 15, wherein the reticle is a luminous disk.

23. The method of claim 15, wherein the reticle is a red dot.

24. The method of claim 15, further comprising adjusting an intensity of the reticle in response to a user control.

25. The method of claim 15, wherein the gun sight is an occluded sight, the method further comprising providing the reticle substantially co-axially aligned with a longitudinal axis of a barrel of a gun for use in aiming the gun.

26. The method of claim 15, wherein the gun sight is a reflex sight, the method further comprising superimposing the reticle over a target field for use in aiming a gun.

27. The method of claim 15, further comprising providing a signal by a magnetometer to adjust an operation of the gun sight based on a proximity of the magnetometer to a magnet of a holster.

28. A method of operating a gun sight, the method comprising:

moving the gun sight to a first position;

viewing a guide at a peripheral area of a user-viewable interface of the gun sight while the gun sight is at the first position;

moving the gun sight to a second position based on the guide; and viewing the reticle at a substantially central area of the user-viewable interface while the gun sight is at the second position, wherein the reticle is not viewable by the user while the gun sight is at the first position.

29. The method of claim 28, wherein:

the guide is visible to the user and the reticle is also visible to the user while the gun sight is at the second position; and the guide remains continuously visible to the user as the user moves the gun sight from the first position to the second position.

30. The method of claim 28, wherein the gun sight comprises:

a light source adapted to project light; and an optical element comprising:

a substantially central external surface adapted to pass the light to provide the reticle, and a substantially peripheral external surface adapted to refract the light to provide the guide to aid a user to reposition the gun sight to view the reticle.

31. The method of claim 30, wherein the substantially peripheral external surface is one of a plurality of substantially peripheral external surfaces adapted to refract the light to provide guides at a plurality of peripheral areas of the user-viewable interface to aid the user to reposition the gun sight to view the reticle.

32. The method of claim 31, wherein the peripheral areas comprise at least two sides of the user-viewable interface.

33. The method of claim 30, wherein the substantially peripheral external surface comprises a plurality of non-uniformities adapted to refract the light as desired.

34. The method of claim 33, wherein the non-uniformities comprise machined portions of the substantially peripheral external surface.

35. The method of claim 30, wherein the optical element is adapted to project the reticle from the user-viewable interface as a collimated beam.

36. The method of claim 28, wherein the reticle is a luminous disk.

37. The method of claim 28, wherein the reticle is a red dot.

38. The method of claim 28, further comprising operating a user control of the gun sight to adjust an intensity of the reticle.

39. The method of claim 28, wherein the gun sight is an occluded sight adapted to provide the reticle substantially co-axially aligned with a longitudinal axis of a barrel of a gun for use in aiming the gun.

40. The method of claim 28, wherein the gun sight is a reflex sight adapted to superimpose the reticle over a target field for use in aiming a gun.

41. The method of claim 28, wherein:

the gun sight is attached to a gun;

the method comprises removing the gun from a holster to adjust an operation of the gun sight; and the gun sight comprises a magnetometer adapted to provide a signal to adjust the operation of the gun sight based on a proximity of the magnetometer to a magnet of the holster.

* * * * *